US010714054B2

(12) United States Patent
Kimura et al.

(10) Patent No.: US 10,714,054 B2
(45) **Date of Patent: *Jul. 14, 2020**

(54) DISPLAY DEVICE

(71) Applicant: TIANMA JAPAN, LTD., Kawasaki, Kanagawa (JP)

(72) Inventors: Hiroaki Kimura, Kawasaki (JP); Yojiro Matsueda, Kawasaki (JP)

(73) Assignee: TIANMA JAPAN, LTD., Kawasaki, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/398,357

(22) Filed: Apr. 30, 2019

(65) Prior Publication Data

US 2019/0341002 A1 Nov. 7, 2019

(30) Foreign Application Priority Data

May 1, 2018 (JP) ..... 2018-088169

(51) Int. Cl.
*G09G 5/10* (2006.01)
*G09G 3/20* (2006.01)
*G09G 3/3208* (2016.01)

(52) U.S. Cl.
CPC ..... *G09G 5/10* (2013.01); *G09G 3/2003* (2013.01); *G09G 3/3208* (2013.01); *G09G 2300/0413* (2013.01); *G09G 2300/0452* (2013.01); *G09G 2320/029* (2013.01); *G09G 2320/0673* (2013.01); *G09G 2340/0457* (2013.01)

(58) Field of Classification Search
CPC ... G09G 2300/0413; G09G 2300/0452; G09G 5/10; G09G 3/2003; G09G 3/3208
See application file for complete search history.

(56) References Cited

U.S. PATENT DOCUMENTS

2003/0174151 A1 9/2003 Awamoto et al.
2016/0055780 A1* 2/2016 Guo ..... G09G 3/2003 345/55
2016/0277722 A1* 9/2016 Guo ..... H04N 13/324
2017/0039911 A1* 2/2017 Guo ..... G02F 1/1362
2017/0178554 A1* 6/2017 Xiao ..... G09G 3/2074
2019/0236998 A1* 8/2019 Kimura ..... G09G 3/3225
2019/0341002 A1* 11/2019 Kimura ..... G09G 3/2003
2019/0371269 A1* 12/2019 Matsueda ..... G09G 3/3233

FOREIGN PATENT DOCUMENTS

JP 2003-271088 A 9/2003

* cited by examiner

*Primary Examiner* — Kent W Chang
*Assistant Examiner* — Nathaniel P Brittingham
(74) *Attorney, Agent, or Firm* — Sughrue Mion, PLLC

(57) ABSTRACT

The relative luminance value of each subpixel in the panel unit area is determined by calculation of the relative luminance value and the weight of the plurality of frame pixels. The plurality of frame pixels constitute a plurality of frame pixel lines extending in the first direction and a plurality of frame pixel lines extending in the second direction, respectively. A first frame pixel line extending in the first direction that includes the closest frame pixel and a second frame pixel line extending in the second direction that includes the closest frame pixel are composed of frame pixels assigned positive weights. Each of the frame pixel lines except for the first frame pixel line and the second frame pixel line includes a frame pixel assigned a negative weight.

13 Claims, 35 Drawing Sheets

DISPLAY DEVICE

CROSS-REFERENCE TO RELATED APPLICATIONS

This Non-provisional application claims priority under 35 U.S.C. § 119(a) on Patent Application No. 2018-088169 filed in Japan on May 1, 2018, the entire content of which is hereby incorporated by reference.

BACKGROUND

This disclosure relates to a display device.

The display region of a color display device is generally composed of red (R) subpixels, green (G) subpixels, and blue (B) subpixels arrayed on the substrate of a display panel. Various arrangements of subpixels (pixel arrangements) have been proposed; for example, RGB stripe arrangement and delta-nabla arrangement (also simply referred to as delta arrangement) have been known (for example, refer to JP 2003-271088 A).

In the RGB stripe arrangement, the boundaries of pixels in a picture frame (data) coincide with the boundaries of subpixels of the display panel; each R subpixel, G subpixel, and B subpixel can be associated with one pixel in a picture frame. In the delta-nabla arrangement, however, the boundaries of pixels in a picture frame do not coincide with the boundaries of subpixels of the display panel. This disagreement could cause impairment of image quality particularly in a display device employing delta-nabla arrangement that virtually increases the resolution by rendering.

SUMMARY

An aspect of the disclosure is a display device including: a display panel; and a controller configured to convert relative luminance data for a picture frame to relative luminance data for the display panel. The picture frame includes a region composed of a plurality of frame unit regions disposed in a matrix. Each of the plurality of frame unit regions includes: a first frame pixel, a second frame pixel, and a third frame pixel disposed in a first direction along a first axis in order of the first frame pixel, the second frame pixel, and the third frame pixel; and a fourth frame pixel, a fifth frame pixel, and a sixth frame pixel disposed in the first direction to be adjacent to the first frame pixel, the second frame pixel, and the third frame pixel, respectively, in a second direction along a second axis perpendicular to the first axis. A display region of the display panel includes a region composed of a plurality of panel unit regions disposed in a matrix. Each of the plurality of panel unit regions includes: a first subpixel line including a first subpixel of a first color, a first subpixel of a second color, and a first subpixel of a third color disposed in the second direction in order of the first subpixel of the first color, the first subpixel of the second color, and the first subpixel of the third color; a second subpixel line including a second subpixel of the third color, a second subpixel of the first color, and a second subpixel of the second color disposed in the second direction in order of the second subpixel of the third color, the second subpixel of the first color, and the second subpixel of the second color, the second subpixel line being adjacent to the first subpixel line in the first direction; a third subpixel line including a third subpixel of the first color, a third subpixel of the second color, and a third subpixel of the third color disposed in the second direction in order of the third subpixel of the first color, the third subpixel of the second color, and the third subpixel of the third color, the third subpixel line being adjacent to the second subpixel line in the first direction; and a fourth subpixel line including a fourth subpixel of the third color, a fourth subpixel of the first color, and a fourth subpixel of the second color disposed in the second direction in order of the fourth subpixel of the third color, the fourth subpixel of the first color, and the fourth subpixel of the second color, the fourth subpixel line being adjacent to the third subpixel line in the first direction. A relative luminance value for each subpixel in the panel unit region is determined by calculation of relative luminance values of a plurality of frame pixels with weights. The plurality of frame pixels include a frame pixel closest to the subpixel. The plurality of frame pixels are disposed in a plurality of frame pixel lines each extending in the first direction and in a plurality of frame pixel lines each extending in the second direction. A first frame pixel line extending in the first direction that includes the closest frame pixel and a second frame pixel line extending in the second direction that includes the closest frame pixel are composed of frame pixels assigned positive weights. Each of the frame pixel lines except for the first frame pixel line and the second frame pixel line includes a frame pixel assigned a negative weight. A sum of weights for the first frame pixel line is larger than a sum of weights for any one of the other frame pixel lines extending in the first direction. A sum of weights for the second frame pixel line is larger than a sum of weights for any one of the other frame pixel line extending in the second direction.

It is to be understood that both the foregoing general description and the following detailed description are exemplary and explanatory and are not restrictive of this disclosure.

EMBODIMENTS

Figure 1:
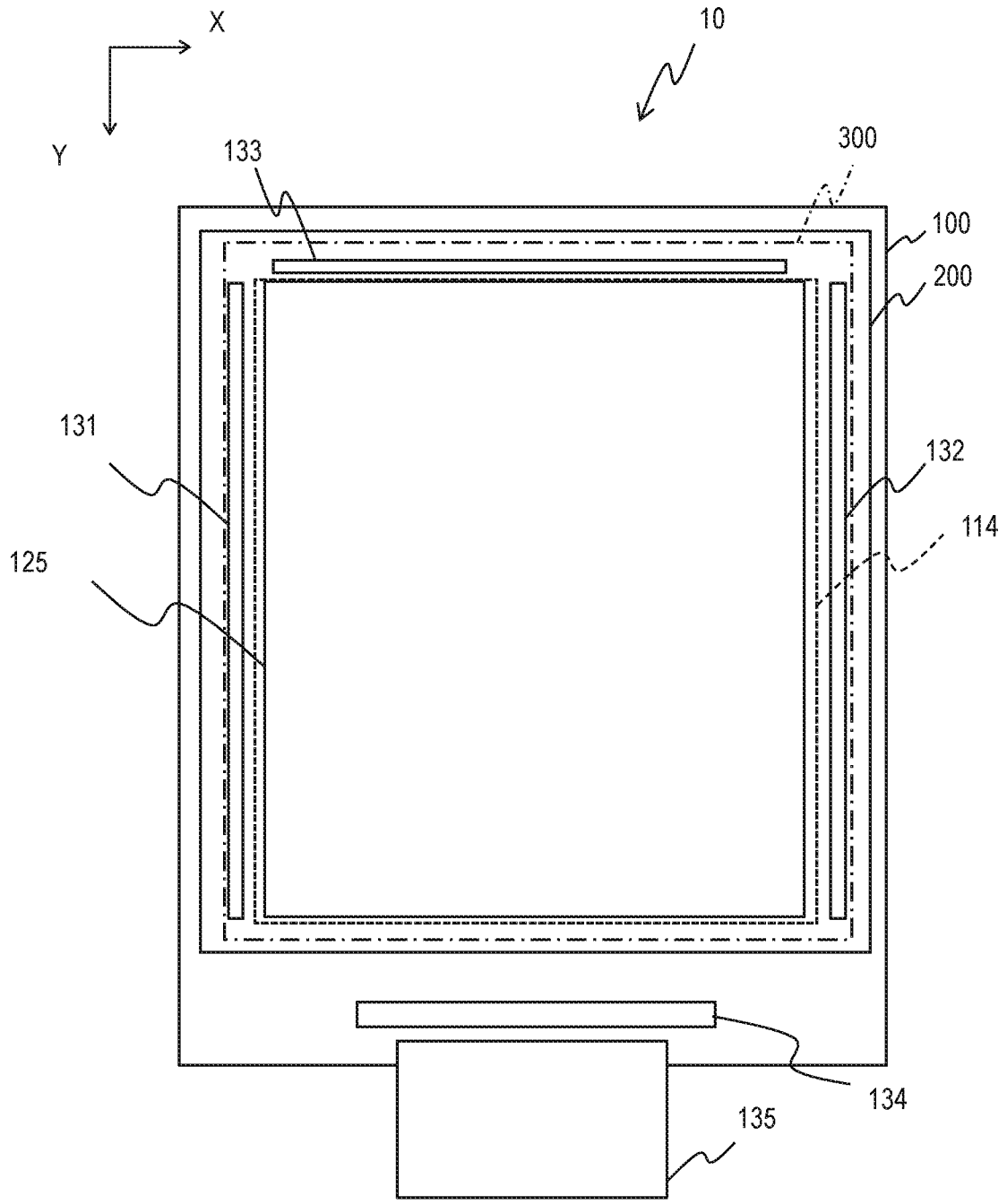
FIG. 1 schematically illustrates a configuration example of an OLED display device in Embodiment 1.

Hereinafter, embodiments of this disclosure will be described with reference to the accompanying drawings. It should be noted that the embodiments are merely examples to implement this disclosure and are not to limit the technical scope of this disclosure. Elements common to the drawings are denoted by the same reference signs.

Embodiment 1

Configuration of Display Device

An overall configuration of a display device in this embodiment is described with reference to FIGS. 1 and 2. The elements in the drawings may be exaggerated in size or shape for clear understanding of the description. In the following, an organic light-emitting diode (OLED) display device is described as an example of the display device; however, the features of this disclosure are applicable to any type of display device other than the OLED display device, such as the liquid crystal display device or the quantum dot display device.

FIG. 1 schematically illustrates a configuration example of an OLED display device 10. The OLED display device 10 includes an OLED display panel and a control device. The OLED display panel includes a thin film transistor (TFT) substrate 100 on which OLED elements are formed, an encapsulation substrate 200 for encapsulating the OLED elements, and a bond (glass frit sealer) 300 for bonding the TFT substrate 100 with the encapsulation substrate 200. The space between the TFT substrate 100 and the encapsulation substrate 200 is filled with dry air and sealed up with the bond 300.

In the periphery of a cathode electrode forming region 114 outer than the display region 125 of the TFT substrate 100, a scanning driver 131, an emission driver 132, a protection circuit 133, and a driver IC 134 are provided. These are connected to the external devices via flexible printed circuits (FPC) 135. The driver IC 134 is included in the control device. The scanning driver 131, the emission driver 132, and the protection circuit 133 are included in the control device or the combination of the OLED display panel and the display device.

The scanning driver 131 drives scanning lines on the TFT substrate 100. The emission driver 132 drives emission control lines to control the light emission periods of subpixels. The protection circuit 133 protects the elements from electrostatic discharge. The driver IC 134 is mounted with an anisotropic conductive film (ACF), for example.

The driver IC 134 provides power and timing signals (control signals) to the scanning driver 131 and the emission driver 132 and further, provides signals corresponding to picture data to the data lines. In other words, the driver IC 134 has a display control function. As will be described later, the driver IC 134 has a function to convert relative luminance data for the pixels of a picture frame into relative luminance data for the subpixels of the display panel.

In FIG. 1, the axis extending from the left to the right is referred to as X-axis and the axis extending from the top to the bottom is referred to as Y-axis. The scanning lines extend along the X-axis. The pixels or subpixels disposed in a line along the X-axis within the display region 125 are referred to as a pixel row or subpixel row; the pixels or subpixels disposed in a line along the Y-axis within the display region 125 are referred to as a pixel column or subpixel column.

Next, a detailed structure of the OLED display device 10 is described. FIG. 2 schematically illustrates a part of a cross-sectional structure of the OLED display device 10. The OLED display device 10 includes a TFT substrate 100 and an encapsulation structural unit opposed to the TFT substrate 100. An example of the encapsulation structural unit is a flexible or inflexible encapsulation substrate 200. The encapsulation structural unit can be a thin film encapsulation (TFE) structure, for example.

The TFT substrate 100 includes a plurality of lower electrodes (for example, anode electrodes 162), one upper electrode (for example, a cathode electrode 166), and a plurality of organic light-emitting layers 165 disposed between an insulating substrate 151 and the encapsulation structural unit. The cathode electrode 166 is a transparent electrode that transmits the light from the organic light-emitting layers 165 (also referred to as organic light-emitting films 165) toward the encapsulation structural unit.

An organic light-emitting layer 165 is disposed between the cathode electrode 166 and an anode electrode 162. The plurality of anode electrodes 162 are disposed on the same plane (for example, on a planarization film 161) and an organic light-emitting layer 165 is disposed on an anode electrode 162.

The OLED display device 10 further includes a plurality of spacers 164 standing toward the encapsulation structural unit and a plurality of circuits each including a plurality of switches. Each of the plurality of circuits is formed between the insulating substrate 151 and an anode electrode 162 and controls the electric current to be supplied to the anode electrode 162.

Figure 2:
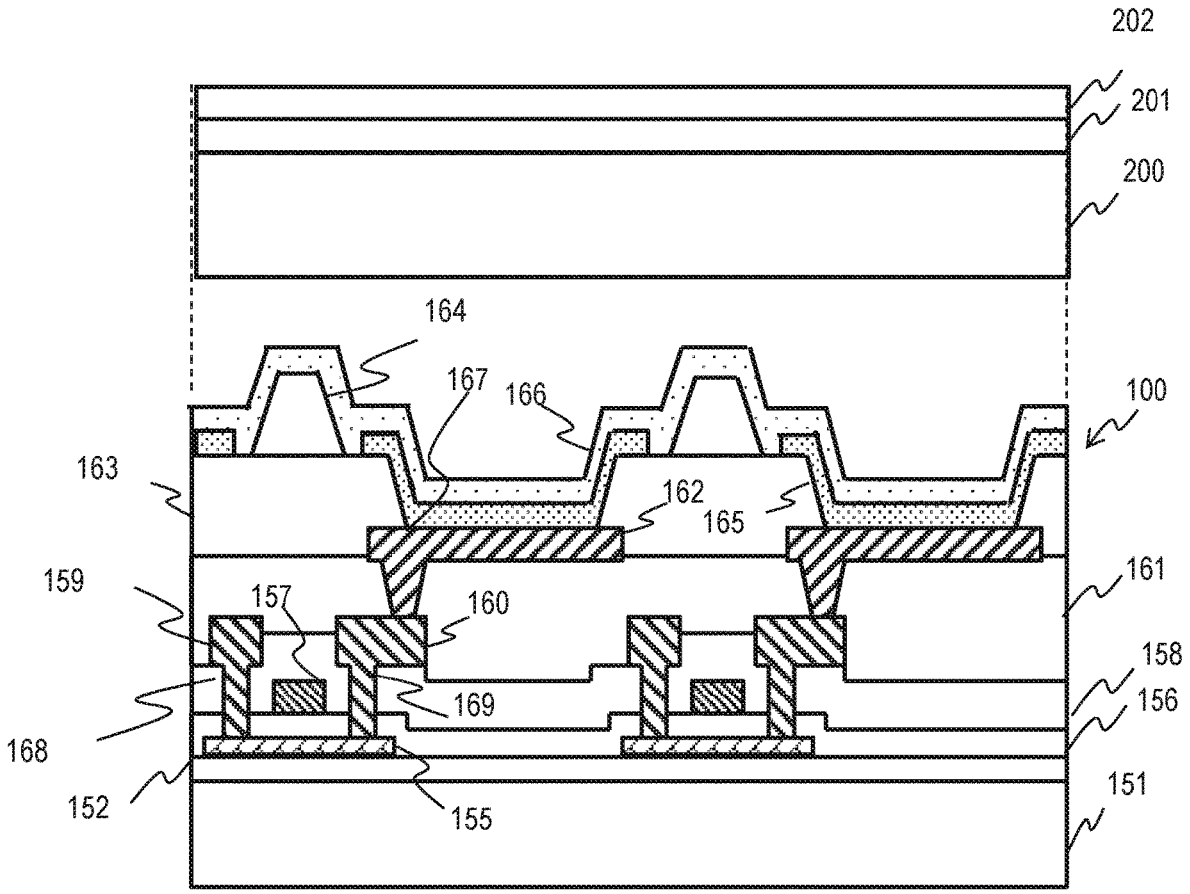
FIG. 2 schematically illustrates a part of a cross-sectional structure of an OLED display device in Embodiment 1.

FIG. 2 illustrates an example of a top-emission pixel structure. The top-emission pixel structure is configured in such a manner that the cathode electrode 166 common to a plurality of pixels is provided on the light emission side (the upper side of the drawing). The cathode electrode 166 has a shape that fully covers the entire display region 125. The features of this disclosure are also applicable to an OLED display device having a bottom-emission pixel structure. The bottom-emission pixel structure has a transparent anode electrode and a reflective cathode electrode to emit light to the external through the TFT substrate 100.

Hereinafter, the OLED display device 10 is described in more detail. The TFT substrate 100 includes subpixels arrayed within the display region 125 and lines provided in the wiring region surrounding the display region 125. The lines connect the pixel circuits with the circuits 131, 132, and 134 provided in the wiring region.

The display region 125 in this embodiment is composed of subpixels arrayed in delta-nabla arrangement. The details of the delta-nabla arrangement will be described later. Hereinafter, the OLED display panel may be referred to as delta-nabla panel. A subpixel is a light emitting region for displaying one of the colors of red (R), green (G), and blue (B). Although the example described in the following displays an image with the combination of these three colors, the OLED display device 10 may display an image with the combination of three colors different from these.

The light emitting region is included in an OLED element which is composed of an anode electrode as a lower electrode, an organic light-emitting layer, and a cathode electrode as an upper electrode. A plurality of OLED elements are formed of one cathode electrode 166, a plurality of anode electrodes 162, and a plurality of organic light-emitting layers 165.

The insulating substrate 151 is made of glass or resin, for example, and is flexible or inflexible. In the following description, the side closer to the insulating substrate 151 is defined as lower side and the side farther from the insulating substrate 151 is defined as upper side. Gate electrodes 157 are provided on a gate insulating film 156. An interlayer insulating film 158 is provided over the gate electrodes 157.

Within the display region 125, source electrodes 159 and drain electrodes 160 are provided above the interlayer insulating film 158. The source electrodes 159 and the drain electrodes 160 are formed of a metal having a high melting point or an alloy of such a metal. Each source electrode 159 and each drain electrode 160 are connected with a channel 155 on an insulating layer 152 through contacts 168 and 169 provided in contact holes of the interlayer insulating film 158.

Over the source electrodes 159 and the drain electrodes 160, an insulative planarization film 161 is provided. Above the insulative planarization film 161, anode electrodes 162 are provided. Each anode electrode 162 is connected with a drain electrode 160 through a contact provided in a contact hole in the planarization film 161. The pixel circuits (TFTs) are formed below the anode electrodes 162.

Above the anode electrodes 162, an insulative pixel defining layer (PDL) 163 is provided to separate OLED elements. An OLED element is composed of an anode electrode 162, an organic light-emitting layer 165, and the cathode electrode 166 (a part thereof) laminated together. The light-emitting region of an OLED element is formed in an opening 167 of the pixel defining layer 163.

Each insulative spacer 164 is provided on the pixel defining layer 163 and between anode electrodes 162. The top face of the spacer 164 is located higher than the top face of the pixel defining layer 163 or closer to the encapsulation substrate 200 and maintains the space between the OLED elements and the encapsulation substrate 200 by supporting the encapsulation substrate 200 when the encapsulation substrate 200 is deformed.

Above each anode electrode 162, an organic light-emitting layer 165 is provided. The organic light-emitting layer 165 is in contact with the pixel defining layer 163 in the opening 167 of the pixel defining layer 163 and its periphery. A cathode electrode 166 is provided over the organic light-emitting layer 165. The cathode electrode 166 is a transparent electrode. The cathode electrode 166 transmits all or part of the visible light from the organic light-emitting layer 165.

The laminated film of the anode electrode 162, the organic light-emitting layer 165, and the cathode electrode 166 formed in an opening 167 of the pixel defining layer 163 corresponds to an OLED element. Electric current flows only within the opening 167 of the pixel defining layer 163 and accordingly, the region of the organic light-emitting layer 165 exposed in the opening 167 is the light emitting region (subpixel) of the OLED element. The cathode electrode 166 is common to the anode electrodes 162 and the organic light-emitting layers 165 (OLED elements) that are formed separately. A not-shown cap layer may be provided over the cathode electrode 166.

The encapsulation substrate 200 is a transparent insulating substrate, which can be made of glass. A λ/4 plate 201 and a polarizing plate 202 are provided over the light emission surface (top face) of the encapsulation substrate 200 to prevent reflection of light entering from the external.

Configuration of Driver IC

Figure 3:
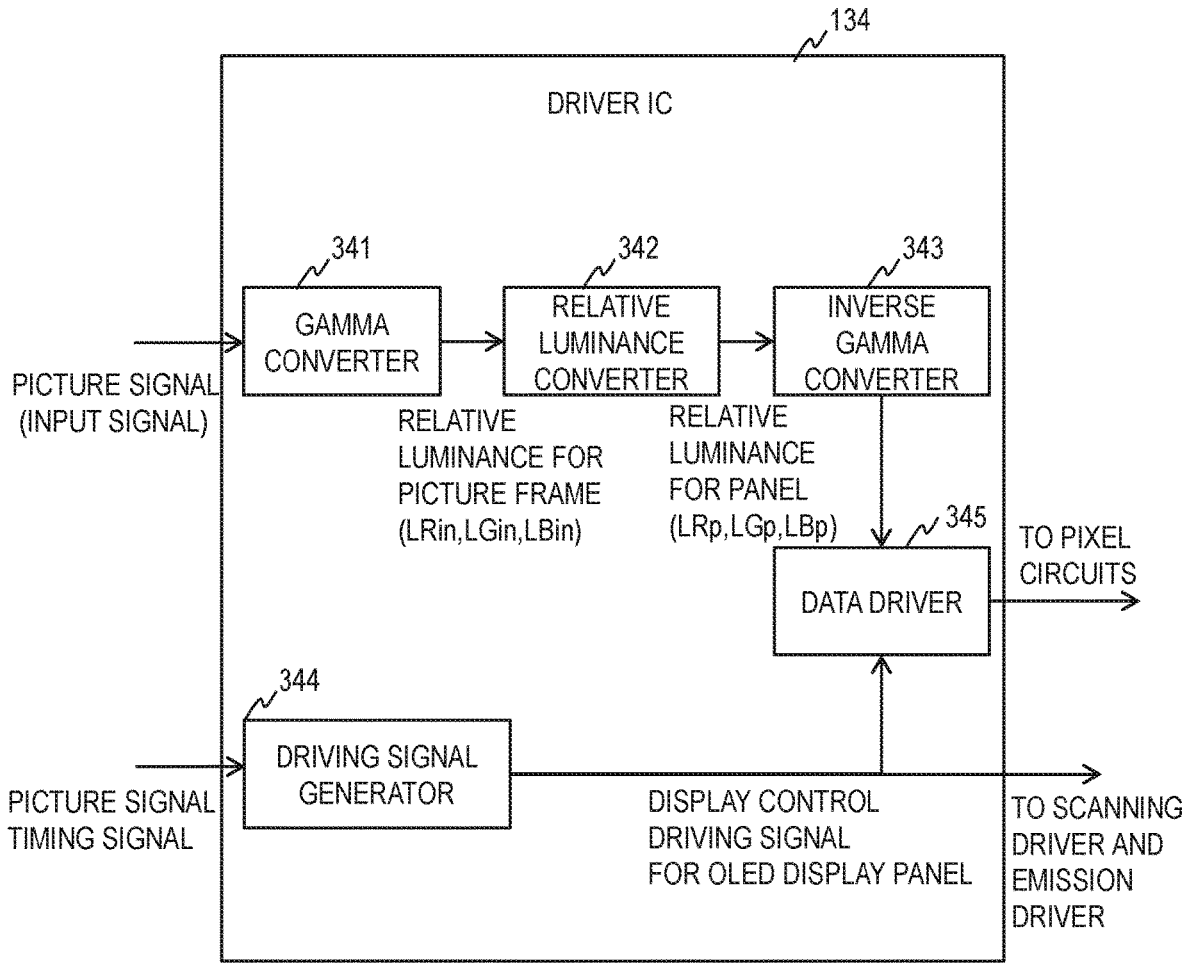
FIG. 3 illustrates logical elements of a driver IC in Embodiment 1.

FIG. 3 illustrates logical elements of the driver IC 134. The driver IC 134 includes a gamma converter 341, a relative luminance converter 342, an inverse gamma converter 343, a driving signal generator 344, and a data driver 345.

The driver IC 134 receives a picture signal and a picture signal timing signal from a not-shown main controller. The picture signal includes data (signal) for successive picture frames. The gamma converter 341 converts the RGB scale values (signal) included in the input picture signal to RGB relative luminance values. More specifically, the gamma converter 341 converts the R scale values, the G scale values, and the B scale values for individual pixels of each picture frame into R relative luminance values (LRin), G relative luminance values (LGin), and B relative luminance values (LBin). The relative luminance values for a pixel are luminance values normalized in the picture frame.

The relative luminance converter 342 converts the R, G, B relative luminance values (LRin, LGin, LBin) for individual pixels of a picture frame into R, G, B relative luminance values (LRp, LGp, LBp) for subpixels of the OLED display panel. The details of the arithmetic processing of the relative luminance converter 342 will be described later. The relative luminance value for a subpixel is a luminance value for the subpixel normalized in the OLED display panel.

The inverse gamma converter 343 converts the relative luminance values for the R subpixels, G subpixels, and B subpixels calculated by the relative luminance converter 342 to scale values for the R subpixels, G subpixels, and B subpixels. The data driver 345 sends a driving signal in accordance with the scale values for the R subpixels, G subpixels, and B subpixels to the pixel circuits.

The driving signal generator 344 converts an input picture signal timing signal to a display control driving signal for the OLED display panel. The picture signal timing signal includes a dot clock (pixel clock) for determining the data transfer rate, a horizontal synchronization signal, a vertical synchronization signal, and a data enable signal.

The driving signal generator 344 converts the frequency of the dot clock of the input picture signal timing signal to ⅔ of the frequency in accordance with the number of pixels in the delta-nabla panel (OLED display panel). As will be described later, the number of pixels in the direction along a scanning line (also referred to as row direction) in the delta-nabla panel in this embodiment is ⅔ of the number of pixels in the direction along the scanning line in the picture frame. This embodiment virtually increases the resolution of the OLED display panel through rendering.

The driving signal generator 344 further generates control signals for the data driver 345, the scanning driver 131, and the emission driver 132 of the delta-nabla panel (or the driving signal for the panel) from the data enable signal, the vertical synchronization signal, and the horizontal synchronization signal and outputs the signals to the drivers.

Pixel Arrangement in Picture Frame and Delta-Nabla Panel

Figure 4:
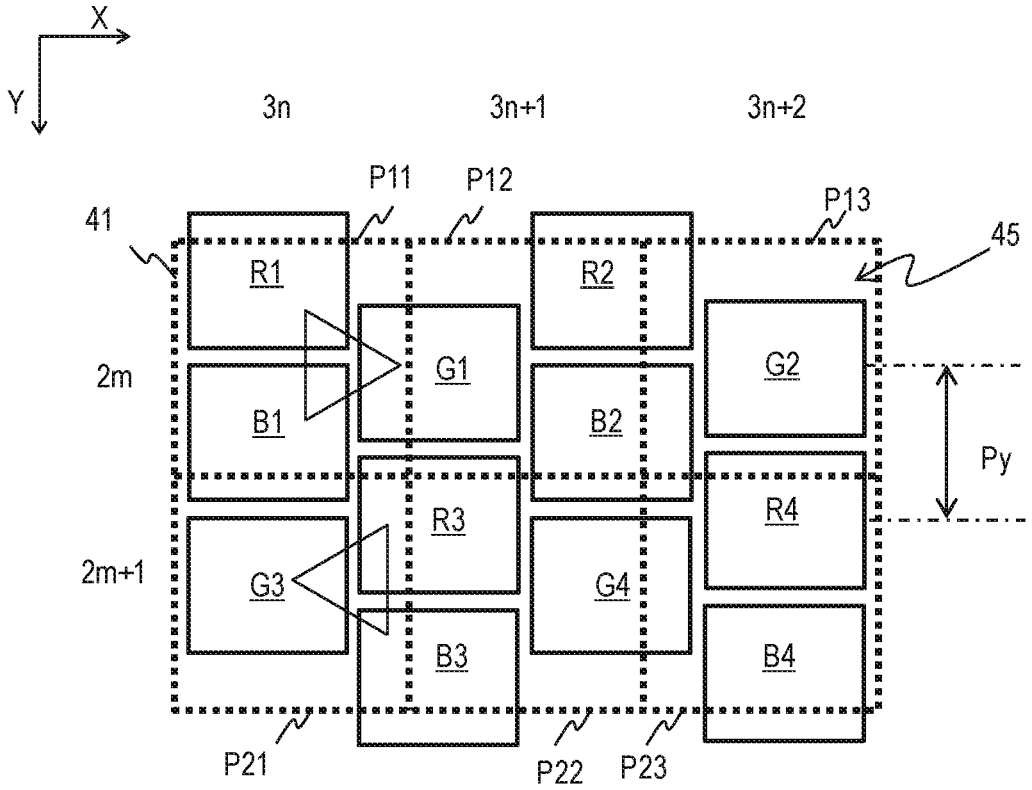
FIG. 4 illustrates a relation between a unit region of a picture frame and a unit region of a delta-nabla panel in Embodiment 1.

FIG. 4 illustrates a relation between a unit region of a picture frame and a unit region of a delta-nabla panel. The image displayed in a picture frame is composed of frame unit regions 41 repeatedly disposed in the row direction (the direction along the X-axis (the first axis)) and the column direction (the direction along the Y-axis (the second axis)). The image is composed of frame unit regions 41 disposed in a matrix. Only a part of the image may be composed of frame unit regions 41.

Each frame unit region 41 includes six frame pixels (also simply referred to as pixels) P11 to P13 and P21 to P23 in two rows by three columns. Each frame pixel includes information on relative luminance values for subpixels of three colors. The shapes of the pixels P11 to P23 are identical. The pixels P11 to P23 in this example have square shapes but the shape is not limited to this.

The pixels P11 to P23 are disposed in a matrix. The pixels P11, P12, and P13 are disposed side by side in this order in the row direction to be a pixel row (pixel line) extending in the row direction. The pixel P12 is adjacent to the pixels P11 and P13. The centroids of these pixels are located on a virtual straight line extending in the row direction at uniform intervals. The pixels P11, P12, and P13 are included in the 2m-th (m is 0 or a positive integer) pixel row in the picture frame.

The pixels P21, P22, and P23 are disposed side by side in this order in the row direction to be a pixel row (pixel line) extending in the row direction. The pixel P22 is adjacent to the pixels P21 and P23. The centroids of these pixels are located on a virtual straight line extending in the row direction at uniform intervals. The pixels P21, P22, and P23 are included in the (2m+1)th pixel row in the picture frame.

The pixels P11 and P21 adjacent to each other are disposed one above the other in the column direction to be a pixel column (pixel line) extending in the column direction. The centroids of these pixels are located on a virtual straight line extending in the column direction at a specific interval. The pixels P11 and P21 are included in the 3n-th (n is 0 or a positive integer) pixel column in the picture frame.

The pixels P12 and P22 adjacent to each other are disposed one above the other in the column direction to be a pixel column (pixel line) extending in the column direction. The centroids of these pixels are located on a virtual straight line extending in the column direction at a specific interval. The pixels P12 and P22 are included in the (3n+1)th pixel column in the picture frame.

The pixels P13 and P23 adjacent to each other are disposed one above the other in the column direction to be a pixel column (pixel line) extending in the column direction. The centroids of these pixels are located on a virtual straight line extending in the column direction at a specific interval. The pixels P13 and P23 are included in the (3n+2)th pixel column in the picture frame.

The display region 125 of the delta-nabla panel is composed of panel unit regions 45 repeatedly disposed in the row direction (the direction along the X-axis) and the column direction (the direction along the Y-axis). The display region 125 is composed of panel unit regions 45 disposed in a matrix. Only a part of the display region 125 may be composed of panel unit regions 45. FIG. 4 includes a frame unit region 41 and a panel unit region 45 corresponding to each other.

Each panel unit region 45 includes twelve panel subpixels (also simply referred to as subpixels) R1 to R4, B1 to B4, and G1 to G4. The Rs, Bs, and Gs in the reference signs for the subpixels represent red (an example of the first color), blue (an example of the second color), and green (an example of the third color), respectively. The shapes of the subpixels are identical. The subpixels in this example have horizontally long rectangular shapes but the shape of the subpixels is not limited to this. For example, the subpixels can have hexagonal or octagonal shapes; subpixels of different colors can have different shapes.

Defining a panel pixel including an R subpixel, a G subpixel, and a B subpixel adjacent to one another, a panel unit region 45 is composed of panel pixels in two rows by two columns. In FIG. 4, two panel pixels are indicated with a triangle (delta) and an inverted triangle (nabla) by way of example. The delta-nabla arrangement is configured so that delta-shaped panel pixels and nabla-shaped panel pixels are disposed alternately.

The subpixels R1, B1, and G3 are disposed one above another in this order in the column direction to be a subpixel column (subpixel line) extending in the column direction. The subpixel B1 is adjacent to the subpixels R1 and G3. The centroids of these subpixels are located on a virtual straight line extending in the column direction at uniform intervals. The subpixels G1, R3, and B3 are disposed one above another in this order in the column direction to be a subpixel column (subpixel line) extending in the column direction. The subpixel R3 is adjacent to the subpixels G1 and B3. The centroids of these subpixels are located on a virtual straight line extending in the column direction at uniform intervals.

The subpixels R2, B2, and G4 are disposed one above another in this order in the column direction to be a subpixel column (subpixel line) extending in the column direction. The subpixel B2 is adjacent to the subpixels R2 and G4. The centroids of these subpixels are located on a virtual straight line extending in the column direction at uniform intervals. The subpixels G2, R4, and B4 are disposed one above another in this order in the column direction to be a subpixel column (subpixel line) extending in the column direction. The subpixel R4 is adjacent to the subpixels G2 and B4. The centroids of these subpixels are located on a virtual straight line extending in the column direction at uniform intervals.

In the example of FIG. 4, the order of colors is the same among the subpixel columns; subpixels are disposed cyclically in the order of an R subpixel, a B subpixel, and a G subpixel. Each subpixel in each subpixel column is adjacent to subpixels of the other colors in the adjacent subpixel columns. For example, an R subpixel is adjacent to G subpixels and B subpixels in the adjacent subpixel columns.

In the example of FIG. 4, the layout of subpixels R1 to R4, G1 to G4, and B1 to B4 constituting a panel unit region 45 is a staggered arrangement. The centroid of each subpixel is located between the centroids of two subpixels in each adjacent subpixel column in the column direction and, in the example of FIG. 4, at the middle between the subpixels.

The locations and the colors of the subpixels in the column direction are the same among the odd-numbered subpixel columns. In similar, the locations and the colors of the subpixels in the column direction are the same among the even-numbered subpixel columns. In the example of FIG. 4, the sub-pixels are disposed at a regular pitch Py in each subpixel column. Each subpixel column is different in location with respect to its adjacent subpixel columns by (3/2)Py.

Each subpixel row is composed of subpixels of the same color disposed in a line in the row direction. A panel unit region 45 includes six subpixel rows. The six subpixel rows are an R subpixel row including subpixels R1 and R2, a G subpixel row including subpixels G1 and G2, a B subpixel row including subpixels B1 and B2, an R subpixel row including subpixels R3 and R4, a G subpixel row including subpixels G3 and G4, and a B subpixel row including subpixels B3 and B4. Each subpixel row is composed of subpixels in odd-numbered or even-numbered subpixel columns. The interval (pitch) in the column direction between subpixel rows of different colors adjacent to each other is (1/2)Py.

The layout of subpixels constituting a panel unit region 45 in FIG. 4 is an example. For example, the layout of subpixels constituting a panel unit region 45 does not need to be a staggered arrangement and can be a matrix arrangement. For example, each subpixel column in a panel unit region 45 can be composed of subpixels of three colors and each subpixel row can be composed of subpixels of two colors disposed alternately. The centroids of the subpixels in a subpixel column do not need to be located on a virtual straight line but the line connecting the centroids can be a bended line. Further, the intervals between the centroids of subpixels in a subpixel column do not need to be uniform.

Figure 5:
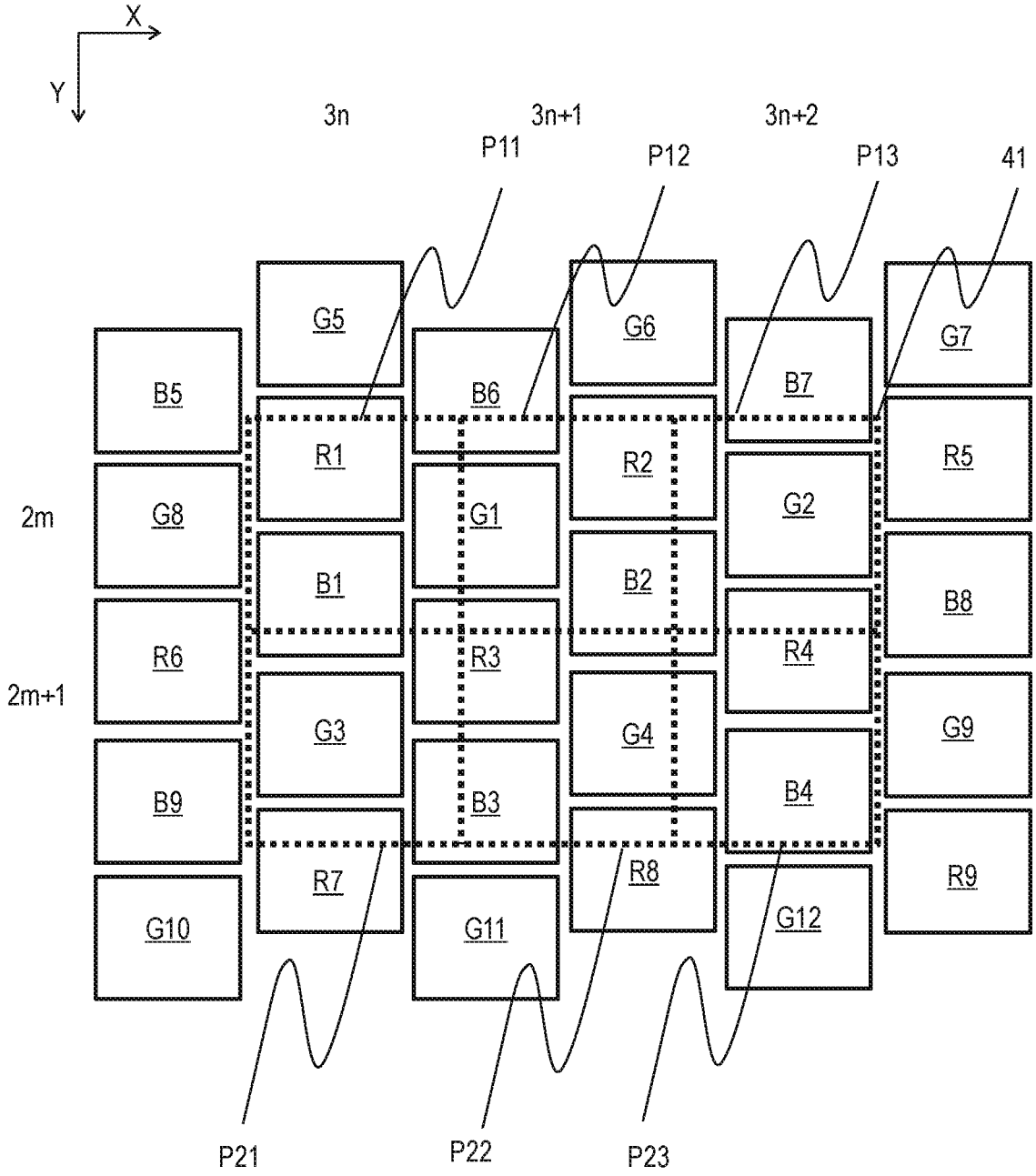
FIG. 5 illustrates a frame unit region and panel subpixels to be assigned the relative luminance values for the frame unit region in Embodiment 1.

FIG. 5 illustrates a frame unit region 41 and panel subpixels to be assigned the relative luminance values of the frame unit region 41. The relative luminance values of the frame unit region 41 are assigned to the corresponding panel unit region 45 and a plurality of subpixels R5 to R9, G5 to G12, and B5 to B9 adjacent to the panel unit region 45 in the row direction and the column direction. The subpixels R5 to R9, G5 to G12, and B5 to B9 surround the panel unit region 45.

As will be described later, one subpixel is assigned relative luminance values of frame pixels in a plurality of rows and a plurality of columns. The relative luminance value of a frame pixel is a tuple of an R relative luminance value, a G relative luminance value, and a B relative luminance value; the relative luminance value of the same color as a subpixel is assigned to the subpixel. The relative luminance values of individual colors of one frame pixel are assigned to a plurality of subpixels of the corresponding colors.

In the example described in the following, the frame pixels are associated with the panel subpixels through virtual mediatory pixels for the assignment of relative luminance values. As described above, a frame unit region 41 includes two pixel rows and a panel unit region 45 includes two subpixel rows for each color. However, the frame unit region 41 includes three pixel columns and the panel unit region 45 includes four subpixel columns.

Figure 6A:
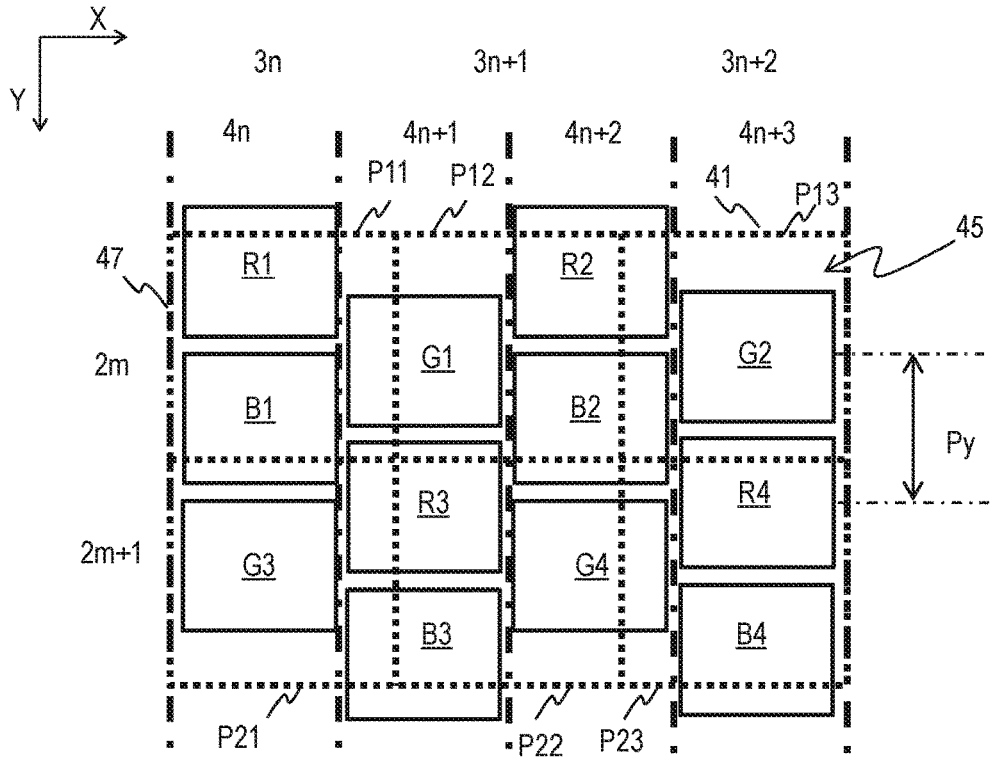
FIG. 6A illustrates a locational relation among a frame unit region, a panel unit region, and a mediatory unit region composed of mediatory pixels in Embodiment 1.
Figure 6B:
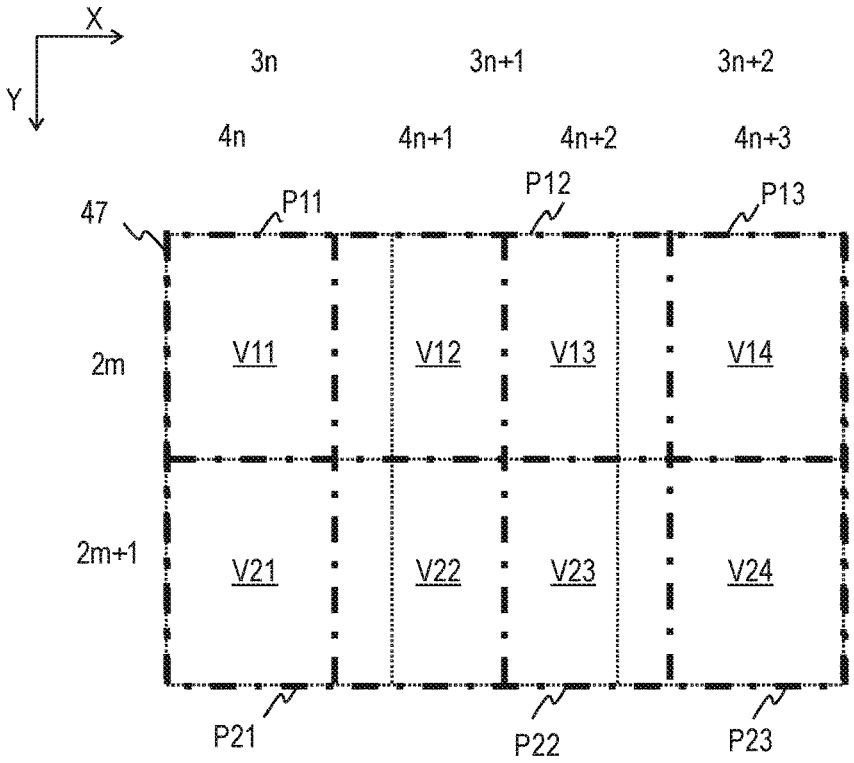
FIG. 6B is a diagram excluding the panel unit region from FIG. 6A to illustrate a locational relation between a frame unit region and a mediatory unit region in Embodiment 1.

For this reason, three frame pixel columns (the relative luminance values thereof) are associated with four mediatory pixel columns (the relative luminance values thereof). FIG. 6A illustrates a locational relation among a frame unit region 41, a panel unit region 45, and a mediatory unit region 47 composed of mediatory pixels. FIG. 6B is a diagram excluding the panel unit region 45 from FIG. 6A and illustrates a locational relation between a frame unit region 41 and a mediatory unit region 47.

The periphery of a mediatory unit region 47 coincides with the periphery of a frame unit region 41. A mediatory unit region 47 includes eight mediatory pixels V11 to V14 and V21 to V24. The mediatory pixels V11 to V24 have the identical shapes. The mediatory unit region 47 includes two mediatory pixel rows of the 2m-th and (2m+1)th mediatory pixel rows. The mediatory unit region 47 includes four mediatory pixel columns of the 4n-th to (4n+3)th mediatory pixel columns.

The number of rows in a mediatory unit region 47 is the same as the number of rows in a frame unit region 41. The number of columns in a mediatory unit region 47 is ⅔ times of the number of columns in a frame unit region 41. The pitch of mediatory pixel columns (the pitch in the row direction) is the same as the pitch of panel subpixel columns. Associating the relative luminance values of frame pixels with relative luminance values of panel subpixels through mediatory pixels facilitates designing appropriate assignment of relative luminance values.

Some examples of relations between the relative luminance values of a frame unit region 41 and the relative luminance values of a mediatory unit region 47 can be utilized. For example, linear interpolation can be utilized. The relative luminance values of a pixel row in a frame unit region 41 can be associated with the relative luminance values of the same numbered pixel row in the corresponding mediatory unit region 47.

For example, the relative luminance values of the frame pixels P11, P12, and P13 are associated with the relative luminance values of the mediatory pixels V11 to V14. Further, the relative luminance values of the frame pixels P21, P22, and P23 are associated with the relative luminance values of the mediatory pixels V21 to V24.

The mediatory pixel V11 is completely included in the frame pixel P11. In other words, the entire region of the mediatory pixel V11 overlaps the region of the frame pixel P11. Only the relative luminance value of the frame pixel P11 is assigned to the mediatory pixel V11 and their relative luminance values (tuples of R, G, and B relative luminance values) are the same. In other words, the weight in the assignment is 1. In the following description, the expression that the first element of a frame pixel, a mediatory pixel, or a subpixel includes a second element means that all or a part of the region of the second element overlaps the region of the first element.

In similar, the relative luminance values of the mediatory pixels V14, V21, and V24 are the same as the relative luminance values of the associated frame pixels. These relations are expressed as the following formulae:

$$L_V11=L_P11,$$

$$L_V14=L_P13,$$

$$L_V21=L_P21, \text{ and}$$

$$L_V24=L_P23,$$

where "L_" represents the relative luminance value (the tuple of R, G, and B relative luminance values) of the pixel specified by the suffix.

The mediatory pixel V12 is partially included in the frame pixel P11 and the remaining part thereof is included in the frame pixel P12. The part included in the frame pixel P12 is larger and the distance between the centroids of the frame pixel P12 and the mediatory pixel V12 is shorter than the distance between the centroids of the frame pixel P11 and the mediatory pixel V12. The mediatory pixel V12 is assigned relative luminance values of the frame pixels P11 and P12.

The weights in the assignment are determined by linear interpolation. As a result, the display device 10 can display a natural image more consistent with the picture frame. Specifically, the weight for the relative luminance value of the frame pixel P11 is ¼ and the weight for the relative luminance value of the frame pixel P12 is ¾. In similar, the relative luminance value for each of the mediatory pixels V13, V22, and V23 is determined from the relative luminance values of two panel pixels including the mediatory pixel. The relations between the relative luminance values of the mediatory pixels V12, V13, V22 and V23 and the relative luminance values of the frame pixels are expressed as the following formulae:

$$L_V12=(1/4)L_P11+(3/4)L_P12,$$

$$L_V13=(3/4)L_P12+(1/4)L_P13,$$

$$L_V22=(1/4)L_P21+(3/4)L_P22, \text{ and}$$

$$L_V23=(3/4)L_P22+(1/4)L_P23.$$

The foregoing example of calculation assigns each of the four mediatory pixels at both ends the relative luminance value of the frame pixel closest thereto. This means that the centroid of the mediatory pixel at an end is made to coincide with the centroid of the associated frame pixel (assuming that the mediatory pixel and the frame pixel have the same centroid). The foregoing example of calculation shifts the centroids of the four mediatory pixels in the middle in accordance with the shift of the centroids of the mediatory pixels at both ends. In the foregoing example of calculation, the weights are determined in accordance with this locational relation. This configuration simplifies the calculation.

Another example that utilizes linear interpolation can be expressed by the following formulae:

$$L_V11=(1/8)L_P10+(7/8)L_P11,$$

$$L_V12=(3/8)L_P11+(5/8)L_P12,$$

$$L_V13=(5/8)L_P12+(3/8)L_P13,$$

$$L_V14=(7/8)L_P13+(1/8)L_P14,$$

$$L_V21=(1/8)L_P20+(7/8)L_P21,$$

$$L_V22=(3/8)L_P21+(5/8)L_P22,$$

$$L_V23=(5/8)L_P22+(3/8)L_P23, \text{ and}$$

$$L_V24=(7/8)L_P23+(1/8)L_P24.$$

The foregoing calculation example determines relative luminance values for the mediatory pixels by linear interpolation based on the locations of the centroids of the mediatory pixels and the locations of the centroids of the frame pixels.

Figure 7:
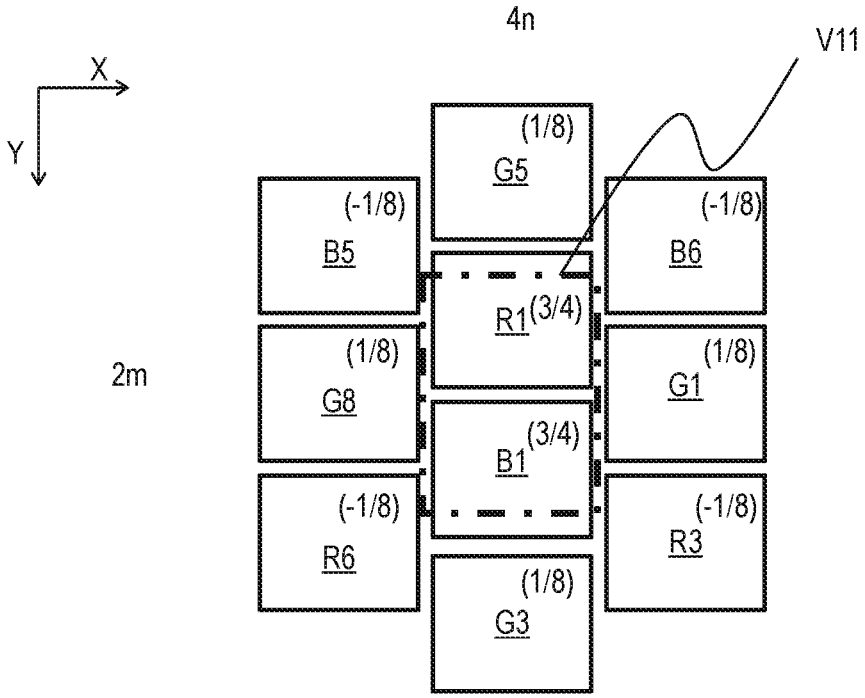
FIG. 7 illustrates a mediatory pixel and subpixels to be assigned the relative luminance value of the mediatory pixel in Embodiment 1.

The relative luminance values of individual colors are assigned from each mediatory pixel to a plurality of subpixels. In the following, relations between a mediatory pixel and the subpixels to be assigned the relative luminance value of the mediatory pixel are described. FIG. 7 illustrates the mediatory pixel V11 and the subpixels to be assigned the relative luminance value of the mediatory pixel V11. The relative luminance value of the mediatory pixel V11 is assigned to the subpixels R1, R3, R6, G1, G3, G5, G8, B1, B5, and B6.

The mediatory pixel V11 includes most parts of the subpixels R1 and B1 and the other subpixels are located outside of the mediatory pixel V11. In this example, the centroid of the mediatory pixel V11 is located at the middle between the centroids of the subpixels R1 and B1. The mediatory pixel V11 is surrounded by the subpixels other than the subpixels R1 and B1.

In FIG. 7, the fraction in parenthesis within each subpixel represents a weight (rate). Accordingly, the relative luminance value obtained by multiplying the relative luminance value of the mediatory pixel V11 by the weight is assigned to the subpixel. As indicated in FIG. 7, some of the subpixels are assigned negative weights. Specifically, the subpixels B5, B6, R6, and R3 are assigned a weight of −1/8. The other subpixels are assigned positive weights. The weights for the subpixels R1 and B1 are the largest.

Figure 8:
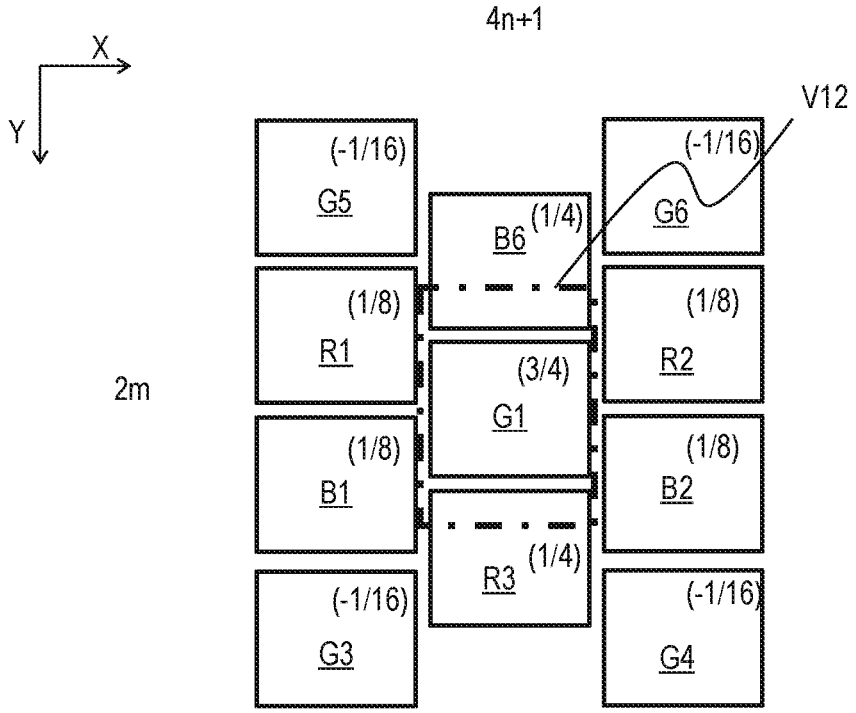
FIG. 8 illustrates a mediatory pixel and subpixels to be assigned the relative luminance value of the mediatory pixel in Embodiment 1.

FIG. 8 illustrates the mediatory pixel V12 and the subpixels to be assigned the relative luminance value of the mediatory pixel V12. The relative luminance value of the mediatory pixel V12 is assigned to the subpixels R1, R2, R3, G1, G3, G4, G5, G6, B1, B2, and B6.

The mediatory pixel V12 includes the entirety of the subpixel G1 and small parts of the subpixels R3 and B6. The other subpixels are located outside of the mediatory pixel V12. In this example, the centroid of the mediatory pixel V12 coincides with the centroid of the subpixel G1. The mediatory pixel V12 is surrounded by the subpixels other than the subpixel G1.

As indicated in FIG. 8, some of the subpixels are assigned negative weights. Specifically, the subpixels G3 to G6 are assigned a weight of −1/16. The other subpixels are assigned positive weights. The weight for the subpixel G1 is the largest.

Figure 9:
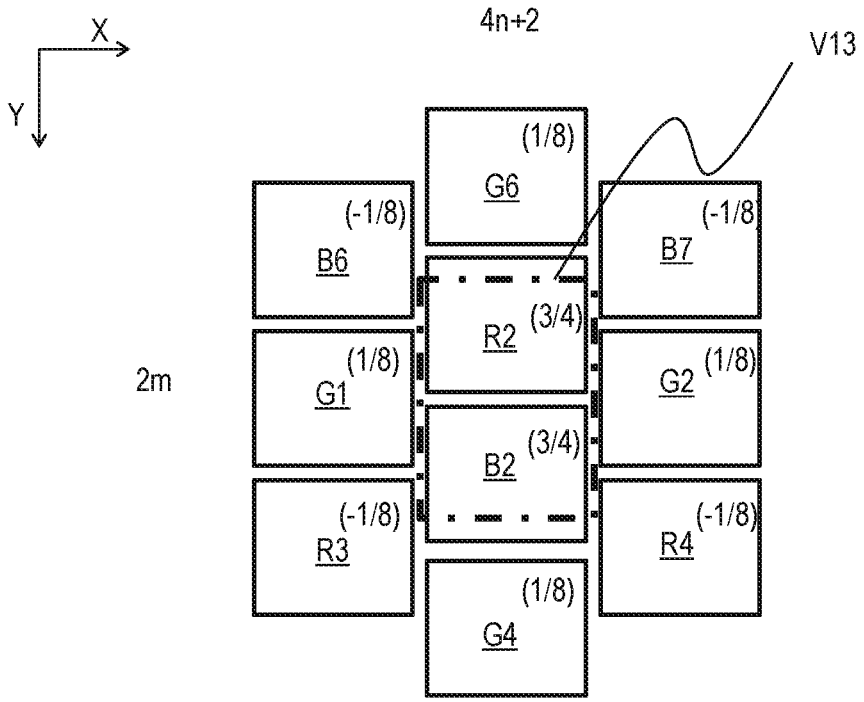
FIG. 9 illustrates a mediatory pixel and subpixels to be assigned the relative luminance value of the mediatory pixel in Embodiment 1.

FIG. 9 illustrates the mediatory pixel V13 and the subpixels to be assigned the relative luminance value of the mediatory pixel V13. The relative luminance value of the mediatory pixel V13 is assigned to the subpixels R2, R3, R4, G1, G2, G4, G6, B2, B6, and B7.

The mediatory pixel V13 includes most parts of the subpixels R2 and B2 and the other subpixels are located outside of the mediatory pixel V13. In this example, the centroid of the mediatory pixel V13 is located at the middle between the centroids of the subpixels R2 and B2. The mediatory pixel V13 is surrounded by the subpixels other than the subpixels R2 and B2.

As indicated in FIG. 9, some of the subpixels are assigned negative weights. Specifically, the subpixels B6, B7, R3, and R4 are assigned a weight of −1/8. The other subpixels are assigned positive weights. The weights for the subpixels R2 and B2 are the largest.

Figure 10:
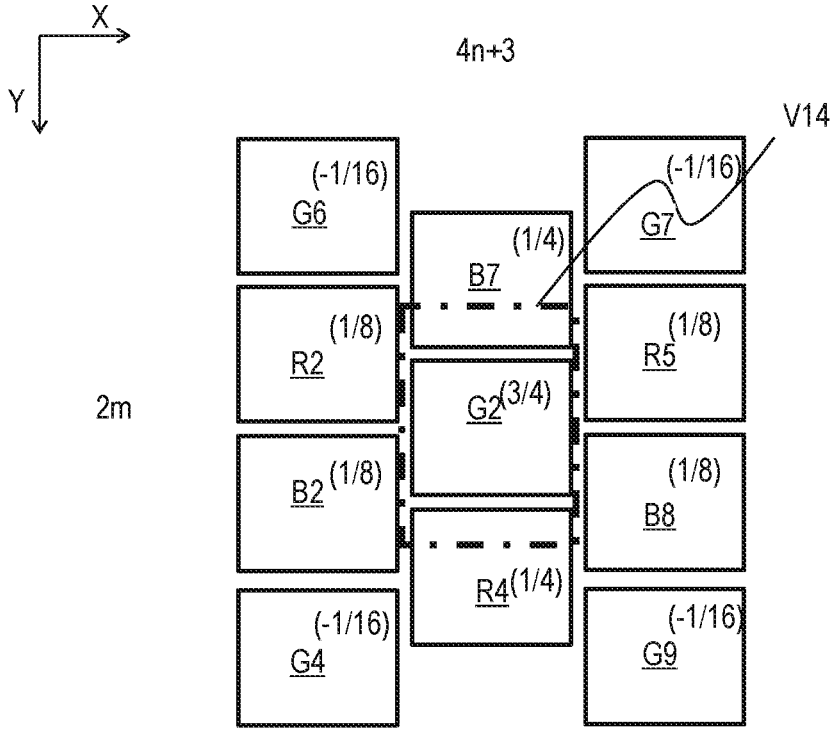
FIG. 10 illustrates a mediatory pixel and subpixels to be assigned the relative luminance value of the mediatory pixel in Embodiment 1.

FIG. 10 illustrates the mediatory pixel V14 and the subpixels to be assigned the relative luminance value of the mediatory pixel V14. The relative luminance value of the mediatory pixel V14 is assigned to the subpixels R2, R4, R5, G2, G4, G6, G7, G9, B2, B7, and B8.

The mediatory pixel V14 includes the entirety of the subpixel G2 and small parts of the subpixels R4 and B7. The other subpixels are located outside of the mediatory pixel V14. In this example, the centroid of the mediatory pixel V14 coincides with the centroid of the subpixel G2. The mediatory pixel V14 is surrounded by the subpixels other than the subpixel G2.

As indicated in FIG. 10, some of the subpixels are assigned negative weights. Specifically, the subpixels G4, G6, G7, and G9 are assigned a weight of −1/16. The other subpixels are assigned positive weights. The weight for the subpixel G2 is the largest.

Figure 11:
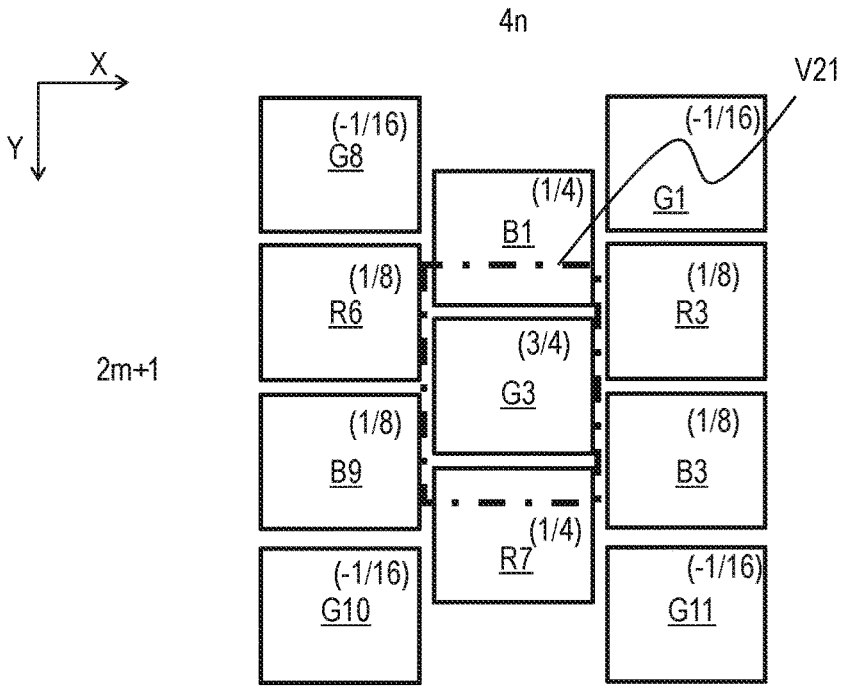
FIG. 11 illustrates a mediatory pixel and subpixels to be assigned the relative luminance value of the mediatory pixel in Embodiment 1.

FIG. 11 illustrates the mediatory pixel V21 and the subpixels to be assigned the relative luminance value of the mediatory pixel V21. The relative luminance value of the mediatory pixel V21 is assigned to the subpixels R3, R6, R7, G1, G3, G8, G10, G11, B1, B3, and B9.

The mediatory pixel V21 includes the entirety of the subpixel G3 and small parts of the subpixels R7 and B1. The other subpixels are located outside of the mediatory pixel V21. In this example, the centroid of the mediatory pixel V21 coincides with the centroid of the subpixel G3. The mediatory pixel V21 is surrounded by the subpixels other than the subpixel G3.

As indicated in FIG. 11, some of the subpixels are assigned negative weights. Specifically, the subpixels G1, G8, G10, and G11 are assigned a weight of −1/16. The other subpixels are assigned positive weights. The weight for the subpixel G3 is the largest.

Figure 12:
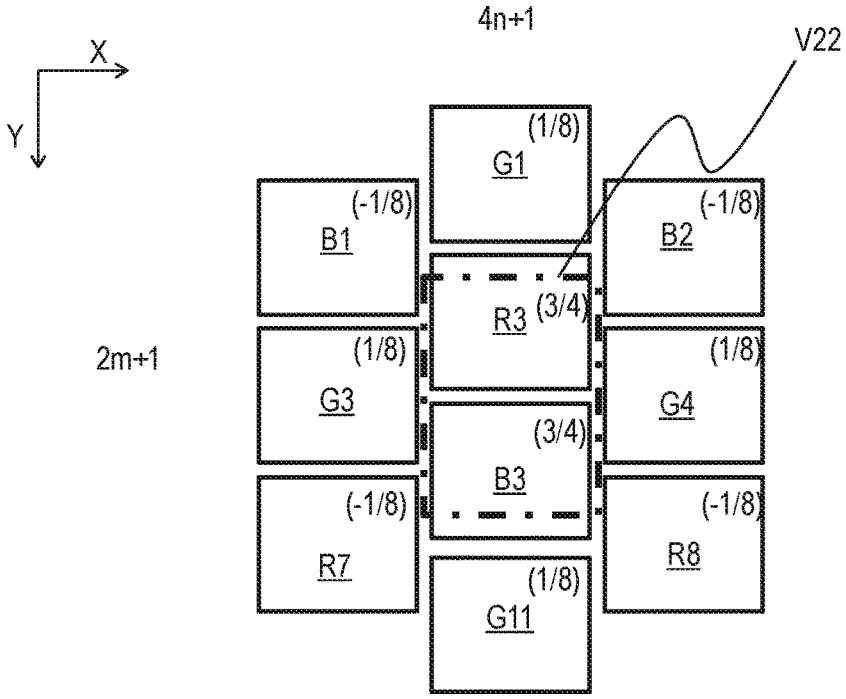
FIG. 12 illustrates a mediatory pixel and subpixels to be assigned the relative luminance value of the mediatory pixel in Embodiment 1.

FIG. 12 illustrates the mediatory pixel V22 and the subpixels to be assigned the relative luminance value of the mediatory pixel V22. The relative luminance value of the mediatory pixel V22 is assigned to the subpixels R3, R7, R8, G1, G3, G4, G11, B1, B2, and B3.

The mediatory pixel V22 includes most parts of the subpixels R3 and B3 and the other subpixels are located outside of the mediatory pixel V22. In this example, the centroid of the mediatory pixel V22 is located at the middle between the centroids of the subpixels R3 and B3. The mediatory pixel V22 is surrounded by the subpixels other than the subpixels R3 and B3.

As indicated in FIG. 12, some of the subpixels are assigned negative weights. Specifically, the subpixels B1, B2, R7, and R8 are assigned a weight of −1/8. The other subpixels are assigned positive weights. The weights for the subpixels R3 and B3 are the largest.

Figure 13:
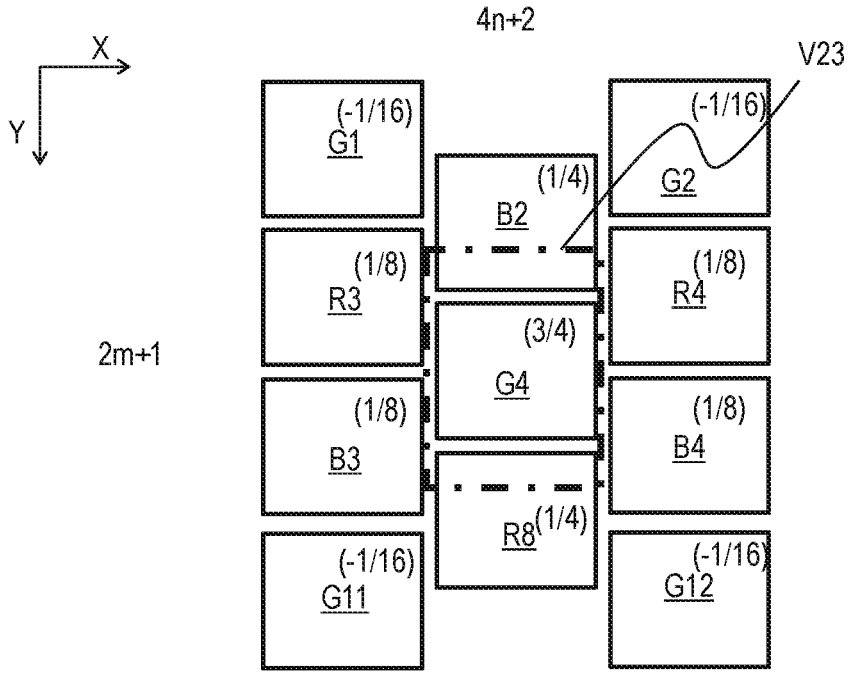
FIG. 13 illustrates a mediatory pixel and subpixels to be assigned the relative luminance value of the mediatory pixel in Embodiment 1.

FIG. 13 illustrates the mediatory pixel V23 and the subpixels to be assigned the relative luminance value of the mediatory pixel V23. The relative luminance value of the mediatory pixel V23 is assigned to the subpixels R3, R4, R8, G1, G2, G4, G11, G12, B2, B3, and B4.

The mediatory pixel V23 includes the entirety of the subpixel G4 and small parts of the subpixels R8 and B2. The other subpixels are located outside of the mediatory pixel V23. In this example, the centroid of the mediatory pixel V23 coincides with the centroid of the subpixel G4. The mediatory pixel V23 is surrounded by the subpixels other than the subpixel G4.

As indicated in FIG. 13, some of the subpixels are assigned negative weights. Specifically, the subpixels G1, G2, G11, and G12 are assigned a weight of −1/16. The other subpixels are assigned positive weights. The weight for the subpixel G4 is the largest.

Figure 14:
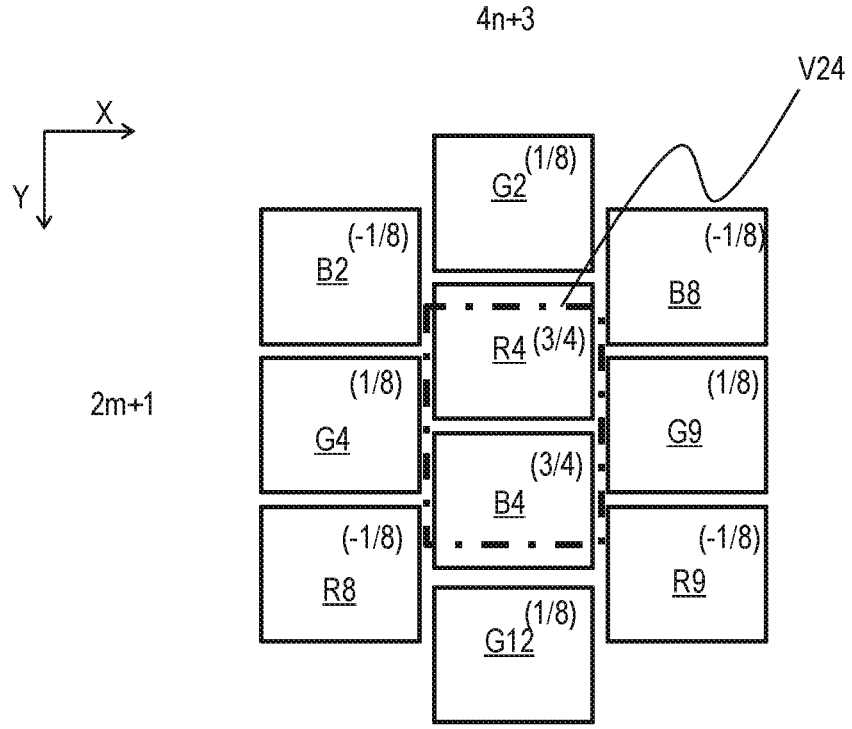
FIG. 14 illustrates a mediatory pixel and subpixels to be assigned the relative luminance value of the mediatory pixel in Embodiment 1.

FIG. 14 illustrates the mediatory pixel V24 and the subpixels to be assigned the relative luminance value of the mediatory pixel V24. The relative luminance value of the mediatory pixel V24 is assigned to the subpixels R4, R8, R9, G2, G4, G9, G12, B2, B4, and B8.

The mediatory pixel V24 includes most parts of the subpixels R4 and B4 and the other subpixels are located outside of the mediatory pixel V24. In this example, the centroid of the mediatory pixel V24 is located at the middle between the centroids of the subpixels R4 and B4. The mediatory pixel V24 is surrounded by the subpixels other than the subpixels R4 and B4.

As indicated in FIG. 14, some of the subpixels are assigned negative weights. Specifically, the subpixels B2, B8, R8, and R9 are assigned a weight of −1/8. The other subpixels are assigned positive weights. The weights for the subpixels R4 and B4 are the largest.

As understood from the description provided with reference to FIGS. 7 to 14, the arrangement patterns of a mediatory pixel and subpixels associated therewith are separated into two types. In one type of patterns, a mediatory pixel includes parts of an R subpixel and a B subpixel. In the other type of patterns, a mediatory pixel includes the entirety of a G subpixel. The weights assigned to the subpixels associated with one mediatory pixel are symmetric about the mediatory pixel.

The subpixels included in the panel pixel row overlapping the mediatory pixel row including a mediatory pixel are assigned positive weights. The panel pixel row overlapping the mediatory pixel row is composed of G subpixels included in a mediatory pixel and R and B subpixels mostly included in a mediatory pixel.

Furthermore, the subpixels included in the subpixel column overlapping the mediatory pixel column including a mediatory pixel are assigned positive weights. The panel pixel column overlapping the mediatory pixel column is composed of G subpixels included in a mediatory pixel and R and B subpixels mostly included in a mediatory pixel. The other subpixels or the subpixels located at the corners in each drawing are assigned negative weights.

As described with reference to FIGS. 7 to 14, the relative luminance value of one mediatory pixel is assigned to a plurality of subpixels of individual colors. The sums of the weights for the relative luminance values to be assigned from one mediatory pixel to three colors, or the sums of the weights for the relative luminance values to be assigned to the subpixels of three colors of R, G, and B that are associated with one mediatory pixel, are the same among the three colors. In this example, the value of the sums is ½. Such assignment that the rates of the relative luminance to be assigned from each mediatory pixel to subpixels are the same among the colors enables displayed colors to be more consistent with the colors of the picture frame.

Figure 15:
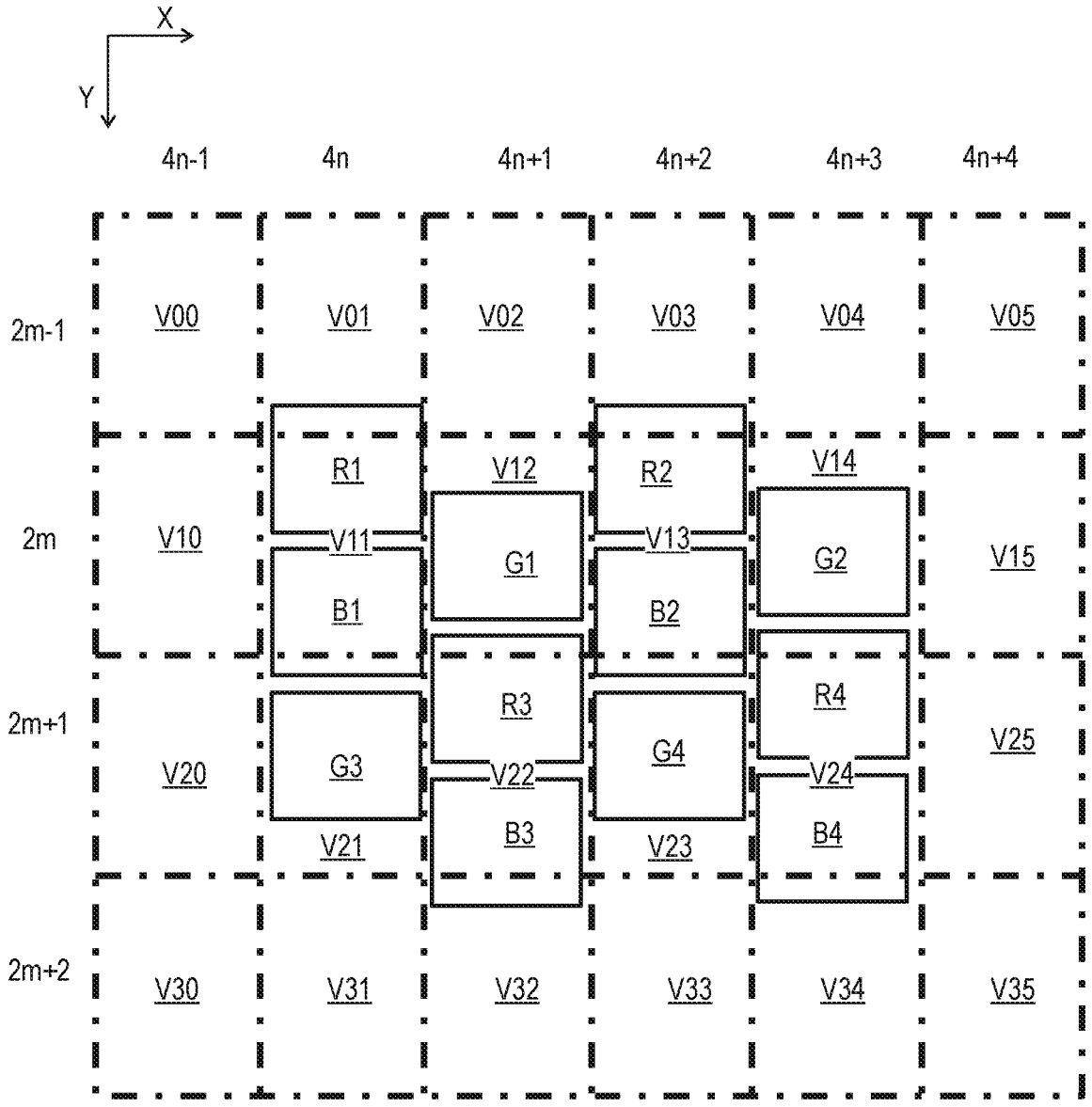
FIG. 15 illustrates a panel unit region and mediatory pixels to assign their relative luminance values to the panel unit region in Embodiment 1.

Next, the relative luminance values to be assigned from mediatory pixels to each subpixel in a panel unit region 45 are described. Each subpixel is assigned relative luminance values from a plurality of mediatory pixels. FIG. 15 illustrates a panel unit region 45 (the reference sign is omitted in FIG. 15) and the mediatory pixels to assign their relative luminance values to the panel unit region 45. The panel unit region 45 is assigned relative luminance values from the corresponding mediatory unit region 47 (the reference sign is omitted in FIG. 15) and the mediatory pixels in the adjacent mediatory unit regions surrounding the mediatory unit region 47.

Figure 16:
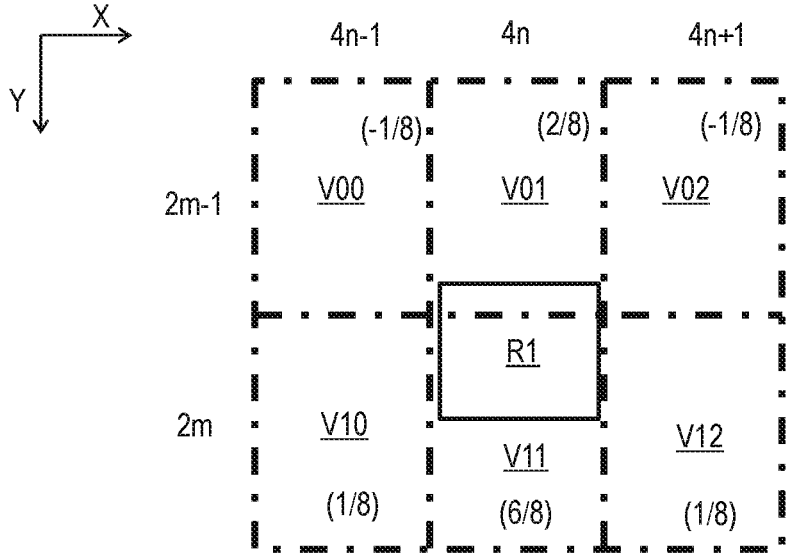
FIG. 16 illustrates a subpixel and mediatory pixels to assign their relative luminance values to the subpixel in Embodiment 1.

FIG. 16 illustrates the subpixel R1 and the mediatory pixels to assign their relative luminance values to the subpixel R1. The red relative luminance values of the mediatory pixels V01 and V11 each including a part of the subpixel R1 and the mediatory pixels V00, V02, V10, and V12 adjacent to the mediatory pixel V01 or V11 at outside of the subpixel R1 are assigned to the subpixel R1. These mediatory pixels surround the subpixel R1.

More specifically, the product sum of the relative luminance values and the assigned weights is the relative luminance value for the subpixel R1:

$$L_R1=(-1/8)L_V00+(2/8)L_V01+(-1/8)L_V02+(1/8)L_V10+(6/8)L_V11+(1/8)L_V12$$

The mediatory pixels V01 and V11 are in the mediatory pixel column including (overlapping) the subpixel R1 and they are assigned positive weights. The centroid of the subpixel R1 is closer to the mediatory pixel V11; the weight of the mediatory pixel V11 is larger than the weight of the mediatory pixel V01. The mediatory pixels V10 and V12 in the mediatory pixel row including the mediatory pixel V11 are assigned positive weights. Their values are the same and smaller than the weights of the mediatory pixels V11 and V01. The mediatory pixels V00 and V02 in the mediatory pixel row including the mediatory pixel V01 are assigned the same negative weights. The sum of the weights of the mediatory pixels to assign their relative luminance values to the subpixel R1 is 1.

The sum of the weights of the mediatory pixels V00, V01, and V02 included in the same mediatory pixel row is 0. The sum of the weights of the mediatory pixels V10, V11, and V12 included in the same pixel row is 1. The sum of the weights of the mediatory pixels V00 and V10 included in the same pixel column is 0. The sum of the weights of the mediatory pixels V02 and V12 included in the same pixel column is 0. The sum of the weights of the mediatory pixels V01 and V11 included in the same pixel column is 1.

Figure 17:
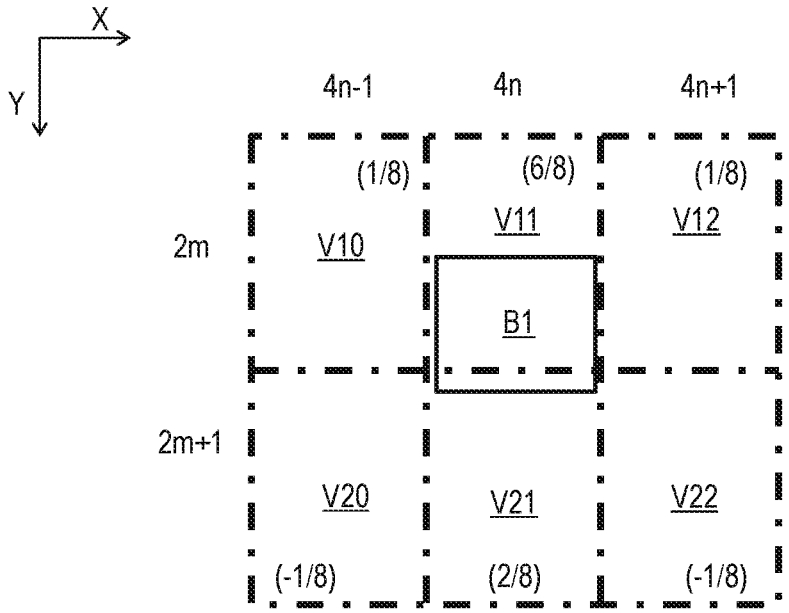
FIG. 17 illustrates a subpixel and mediatory pixels to assign their relative luminance values to the subpixel in Embodiment 1.

FIG. 17 illustrates the subpixel B1 and the mediatory pixels to assign their relative luminance values to the subpixel B1. The blue relative luminance values of the mediatory pixels V11 and V21 each including a part of the subpixel B1 and the mediatory pixels V10, V12, V20, and V22 adjacent to the mediatory pixel V11 or V21 at outside of the subpixel B1 are assigned to the subpixel B1. These mediatory pixels surround the subpixel B1.

More specifically, the product sum of the relative luminance values and the assigned weights is the relative luminance value for the subpixel B1:

$$L_B1=(1/8)L_V10+(6/8)L_V11+(1/8)L_V12+(-1/8)L_V20+(2/8)L_V21+(-1/8)L_V22$$

The mediatory pixels V11 and V21 are in the mediatory pixel column including (overlapping) the subpixel B1 and they are assigned positive weights. The centroid of the subpixel B1 is closer to the mediatory pixel V11; the weight of the mediatory pixel V11 is larger than the weight of the mediatory pixel V21. The mediatory pixels V10 and V12 in the mediatory pixel row including the mediatory pixel V11 are assigned positive weights. Their values are the same and smaller than the weights of the mediatory pixels V21 and V11. The mediatory pixels V20 and V22 in the mediatory pixel row including the mediatory pixel V21 are assigned the same negative weights. The sum of the weights of the mediatory pixels to assign their relative luminance values to the subpixel B1 is 1.

The sum of the weights of the mediatory pixels V20, V21, and V22 included in the same mediatory pixel row is 0. The sum of the weights of the mediatory pixels V10, V11, and V12 included in the same pixel row is 1. The sum of the weights of the mediatory pixels V10 and V20 included in the same pixel column is 0. The sum of the weights of the mediatory pixels V12 and V22 included in the same pixel column is 0. The sum of the weights of the mediatory pixels V11 and V21 included in the same pixel column is 1.

Figure 18:
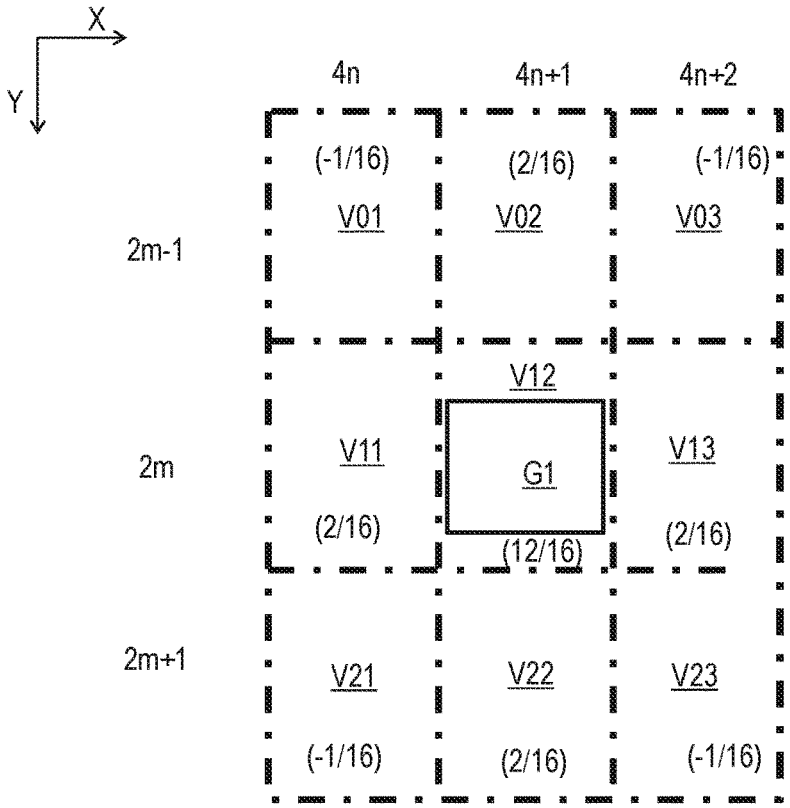
FIG. 18 illustrates a subpixel and mediatory pixels to assign their relative luminance values to the subpixel in Embodiment 1.

FIG. 18 illustrates the subpixel G1 and the mediatory pixels to assign their relative luminance values to the subpixel G1. The green relative luminance values of the mediatory pixel V12 including the entire subpixel G1 and the mediatory pixels V01, V02, V03, V11, V13, V21, V22, and V23 surrounding the subpixel G1 (the mediatory pixel V12) at outside of the subpixel G1 are assigned to the subpixel G1.

More specifically, the product sum of the relative luminance values and the assigned weights is the relative luminance value for the subpixel G1:

$$\begin{aligned} L_G1 = {} & (-1/16)L_V01 + (2/16)L_V02 + (-1/16)L_V03 + \\ & (2/16)L_V11 + (12/16)L_V12 + (2/16)L_V13 + \\ & (-1/16)L_V21 + (2/16)L_V22 + (-1/16)L_V23 \end{aligned}$$

The mediatory pixels V02, V12, and V22 are mediatory pixels in the mediatory pixel column including (overlapping) the subpixel G1 and they are assigned positive weights. The weight of the mediatory pixel V12 is larger than the weights of the mediatory pixels V02 and V22. The weights of the mediatory pixels V02 and V22 are the same.

The mediatory pixels V11 and V13 in the mediatory pixel row including the mediatory pixel V12 are assigned positive weights. Their values are the same and smaller than the weight of the mediatory pixel V12. The mediatory pixels V01, V03, V21, and V23 included in neither the mediatory pixel row nor the mediatory pixel column including the mediatory pixel V12 are assigned the same negative weights. The sum of the weights of the mediatory pixels to assign their relative luminance values to the subpixel G1 is 1.

The sum of the weights of the mediatory pixels V01, V02, and V03 included in the same mediatory pixel row is 0. The sum of the weights of the mediatory pixels V11, V12, and V13 included in the same mediatory pixel row is 1. The sum of the weights of the mediatory pixels V21, V22, and V23 included in the same mediatory pixel row is 0.

The sum of the weights of the mediatory pixels V01, V11, and V21 included in the same mediatory pixel column is 0. The sum of the weights of the mediatory pixels V02, V12, and V22 included in the same mediatory pixel column is 1. The sum of the weights of the mediatory pixels V03, V13, and V23 included in the same mediatory pixel column is 0.

Figure 19:
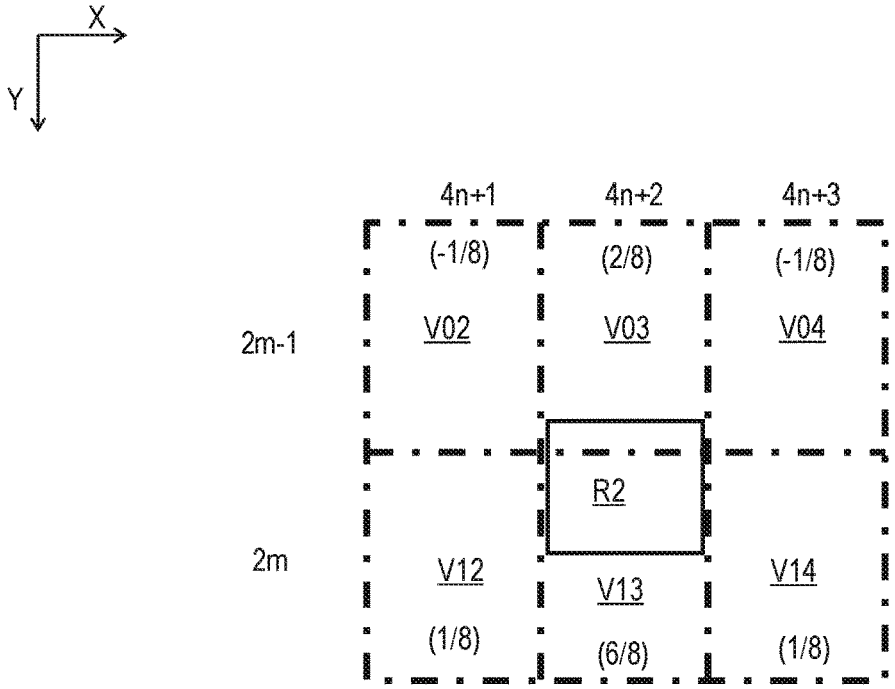
FIG. 19 illustrates a subpixel and mediatory pixels to assign their relative luminance values to the subpixel in Embodiment 1.

FIG. 19 illustrates the subpixel R2 and the mediatory pixels to assign their relative luminance values to the subpixel R2. The mediatory pixels V02, V03, V04, V12, V13, and V14 are associated with the subpixel R2. The relation between these mediatory pixels and the subpixel R2 is the same as the relation between the mediatory pixels V00, V01, V02, V10, V11, and V12 and the subpixel R1 described with reference to FIG. 16.

Figure 20:
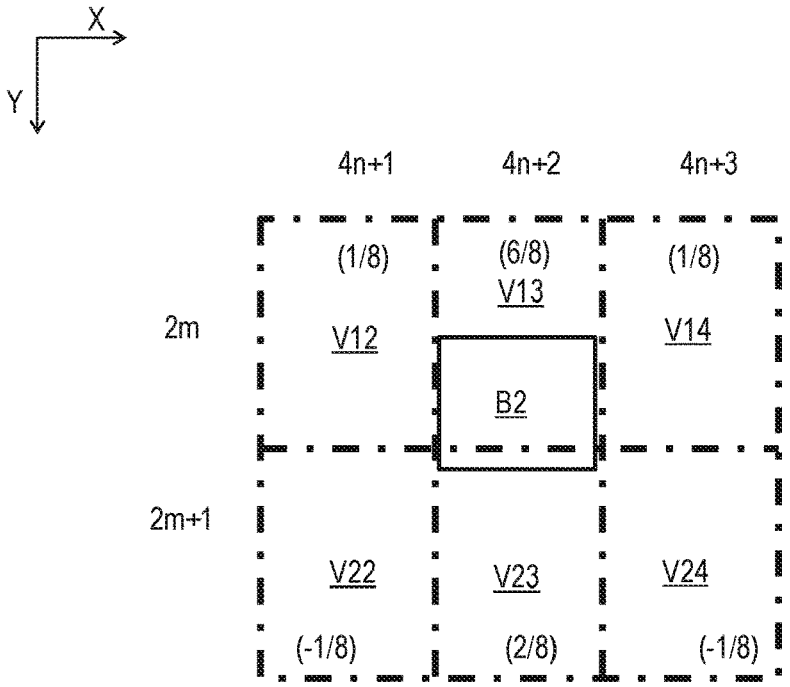
FIG. 20 illustrates a subpixel and mediatory pixels to assign their relative luminance values to the subpixel in Embodiment 1.

FIG. 20 illustrates the subpixel B2 and the mediatory pixels to assign their relative luminance values to the subpixel B2. The mediatory pixels V12, V13, V14, V22, V23, and V24 are associated with the subpixel B2. The relation between these mediatory pixels and the subpixel B2 is the same as the relation between the mediatory pixels V10, V11, V12, V20, V21, and V22 and the subpixel B1 described with reference to FIG. 17.

Figure 21:
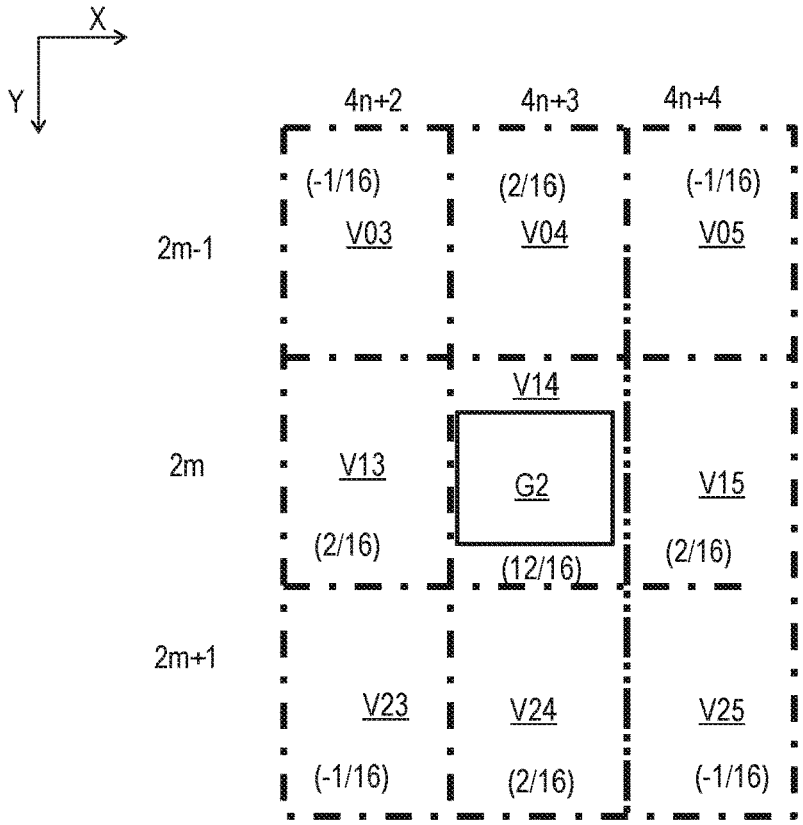
FIG. 21 illustrates a subpixel and mediatory pixels to assign their relative luminance values to the subpixel in Embodiment 1.

FIG. 21 illustrates the subpixel G2 and the mediatory pixels to assign their relative luminance values to the subpixel G2. The mediatory pixels V03, V04, V05, V13, V14, V15, V23, V24, and V25 are associated with the subpixel G2. The relation between these mediatory pixels and the subpixel G2 is the same as the relation between the mediatory pixels V01, V02, V03, V11, V12, V13, V21, V22, and V23 and the subpixel G1 described with reference to FIG. 18.

Figure 22:
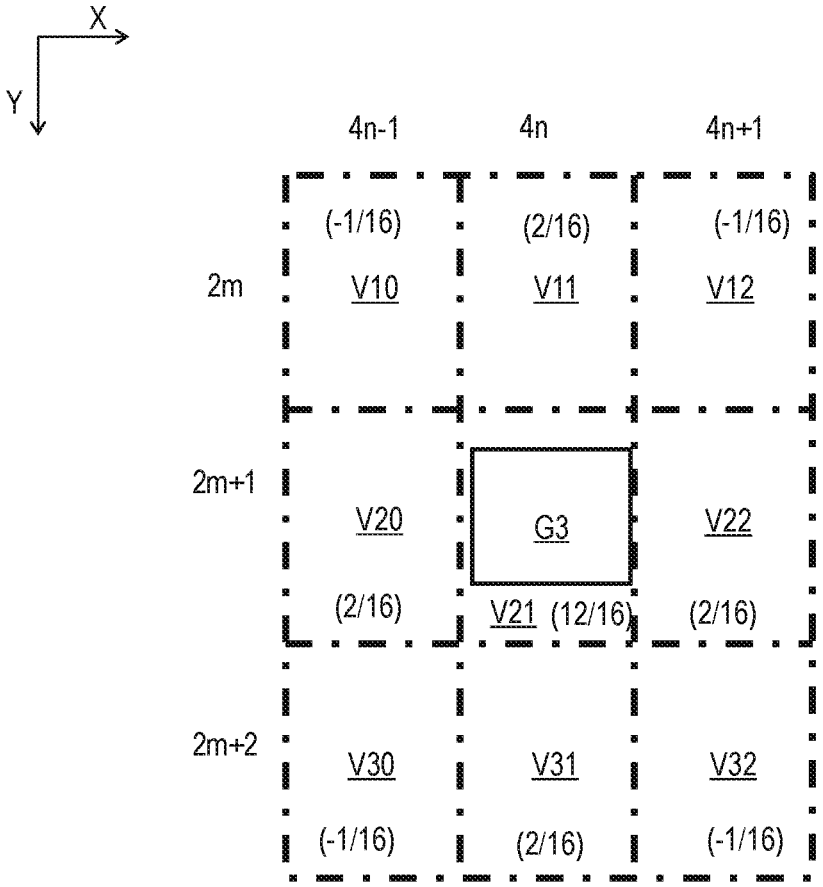
FIG. 22 illustrates a subpixel and mediatory pixels to assign their relative luminance values to the subpixel in Embodiment 1.

FIG. 22 illustrates the subpixel G3 and the mediatory pixels to assign their relative luminance values to the subpixel G3. The mediatory pixels V10, V11, V12, V20, V21, V22, V30, V31, and V32 are associated with the subpixel G3. The relation between these mediatory pixels and the subpixel G3 is the same as the relation between the mediatory pixels V01, V02, V03, V11, V12, V13, V21, V22, and V23 and the subpixel G1 described with reference to FIG. 18.

Figure 23:
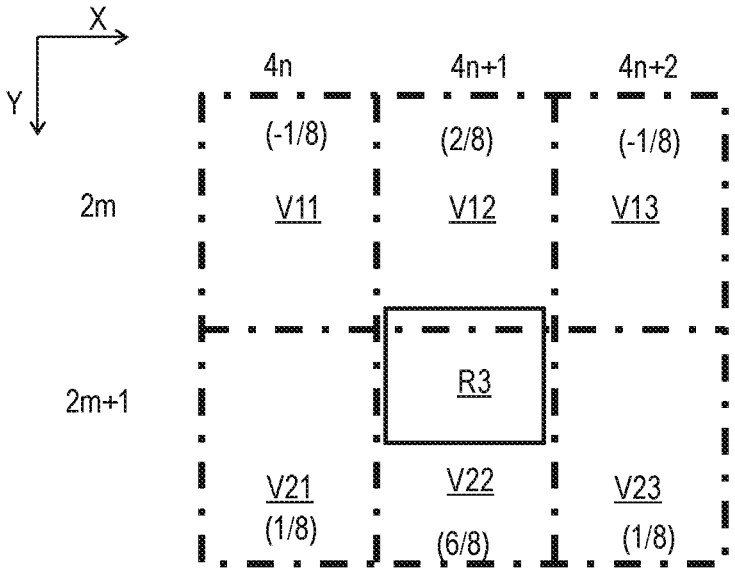
FIG. 23 illustrates a subpixel and mediatory pixels to assign their relative luminance values to the subpixel in Embodiment 1.

FIG. 23 illustrates the subpixel R3 and the mediatory pixels to assign their relative luminance values to the subpixel R3. The mediatory pixels V11, V12, V13, V21, V22, and V23 are associated with the subpixel R3. The relation between these mediatory pixels and the subpixel R3 is the same as the relation between the mediatory pixels V00, V01, V02, V10, V11, and V12 and the subpixel R1 described with reference to FIG. 16.

Figure 24:
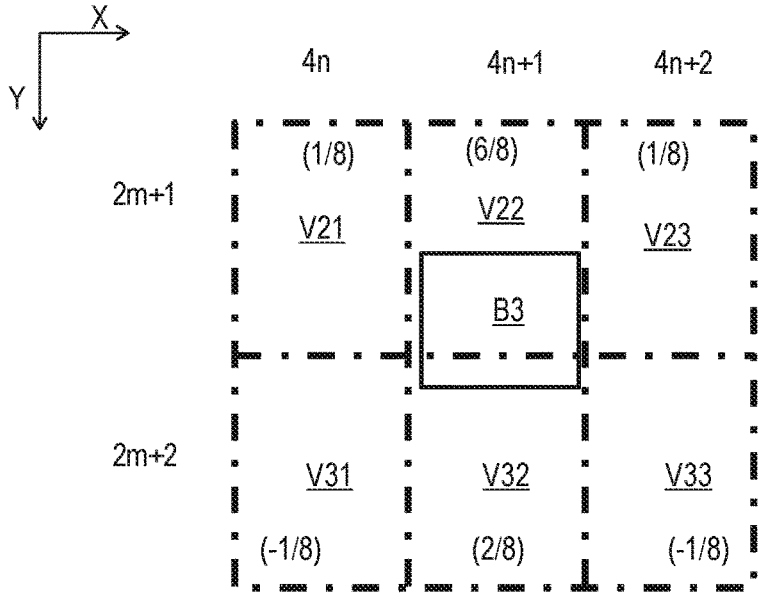
FIG. 24 illustrates a subpixel and mediatory pixels to assign their relative luminance values to the subpixel in Embodiment 1.

FIG. 24 illustrates the subpixel B3 and the mediatory pixels to assign their relative luminance values to the subpixel B3. The mediatory pixels V21, V22, V23, V31, V32, and V33 are associated with the subpixel B3. The relation between these mediatory pixels and the subpixel B3 is the same as the relation between the mediatory pixels V10, V11, V12, V20, V21, and V22 and the subpixel B1 described with reference to FIG. 17.

Figure 25:
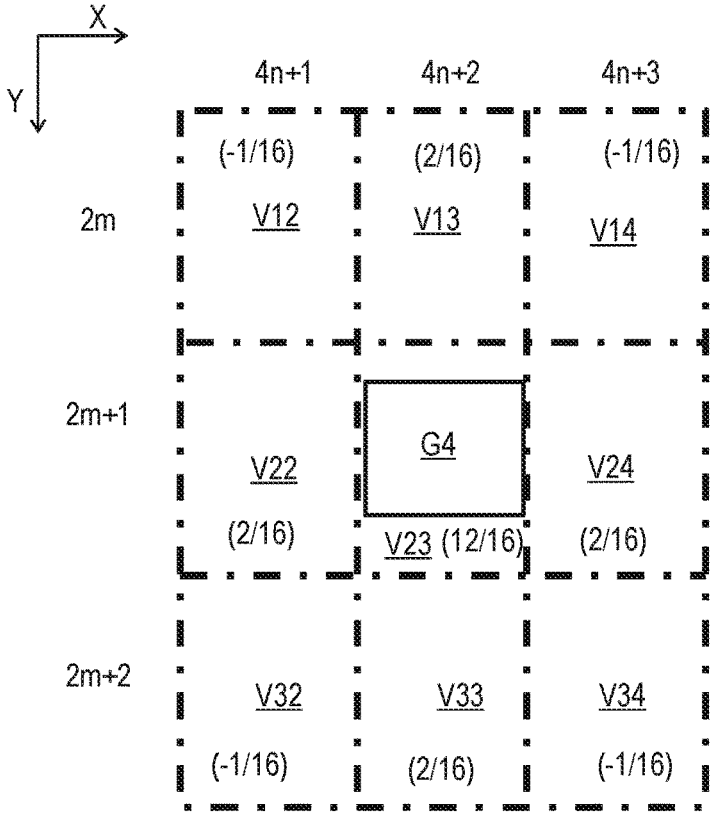
FIG. 25 illustrates a subpixel and mediatory pixels to assign their relative luminance values to the subpixel in Embodiment 1.

FIG. 25 illustrates the subpixel G4 and the mediatory pixels to assign their relative luminance values to the subpixel G4. The mediatory pixels V12, V13, V14, V22, V23, V24, V32, V33, and V34 are associated with the subpixel G4. The relation between these mediatory pixels and the subpixel G4 is the same as the relation between the mediatory pixels V01, V02, V03, V11, V12, V13, V21, V22, and V23 and the subpixel G1 described with reference to FIG. 18.

Figure 26:
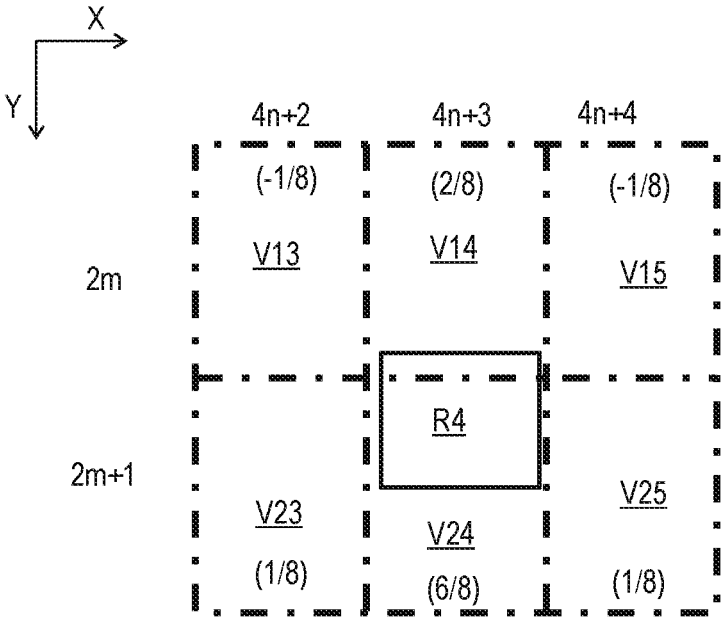
FIG. 26 illustrates a subpixel and mediatory pixels to assign their relative luminance values to the subpixel in Embodiment 1.

FIG. 26 illustrates the subpixel R4 and the mediatory pixels to assign their relative luminance values to the subpixel R4. The mediatory pixels V13, V14, V15, V23, V24, and V25 are associated with the subpixel R4. The relation between these mediatory pixels and the subpixel R4 is the same as the relation between the mediatory pixels V00, V01, V02, V10, V11, and V12 and the subpixel R1 described with reference to FIG. 16.

Figure 27:
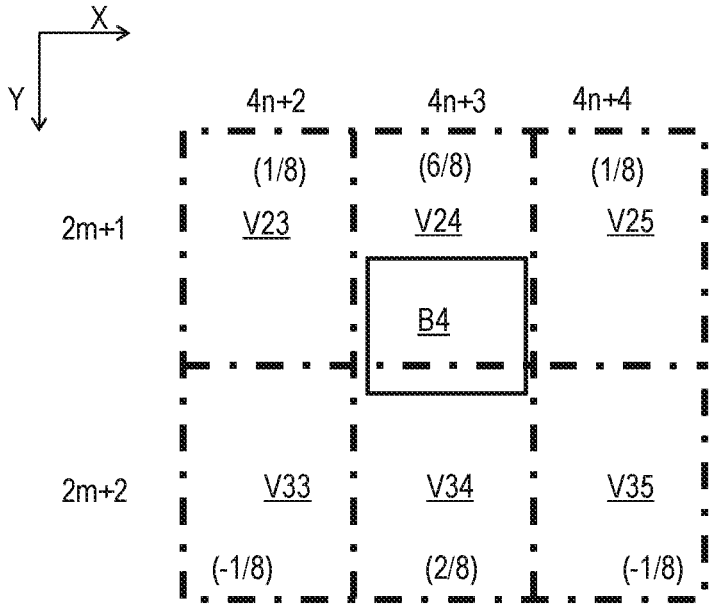
FIG. 27 illustrates a subpixel and mediatory pixels to assign their relative luminance values to the subpixel in Embodiment 1.

FIG. 27 illustrates the subpixel B4 and the mediatory pixels to assign their relative luminance values to the subpixel B4. The mediatory pixels V23, V24, V25, V33, V34, and V35 are associated with the subpixel B4. The relation between these mediatory pixels and the subpixel B4 is the same as the relation between the mediatory pixels V10, V11, V12, V20, V21, and V22 and the subpixel B1 described with reference to FIG. 17.

As described above, the mediatory pixels to determine the relative luminance value of a red or blue subpixel are the mediatory pixel closest to the subpixel, the mediatory pixels adjacent on both sides along the X-axis to the mediatory pixel closest to the subpixel, the mediatory pixel second closest to the subpixel along the Y-axis, and the mediatory pixels adjacent on both sides along the X-axis to the mediatory pixel second closest to the subpixel.

The mediatory pixels to determine the relative luminance value of a green subpixel are the mediatory pixel closest to the subpixel, the mediatory pixels adjacent on both sides along the X-axis to the mediatory pixel closest to the subpixel, the mediatory pixel adjacent in the upward direction to the mediatory pixel closest to the subpixel, the mediatory pixels adjacent on both sides along the X-axis to the mediatory pixel adjacent in the upward direction, the mediatory pixel adjacent in the downward direction to the mediatory pixel closest to the subpixel, and the mediatory pixels adjacent on both sides along the X-axis to the mediatory pixel adjacent in the downward direction.

As described with reference to FIGS. 16 to 27, among the mediatory pixels to assign their relative luminance values to a subpixel, only one mediatory pixel row and one mediatory pixel column including the largest part of the subpixel are composed of only mediatory pixels assigned positive weights. This configuration makes a line extending in the row direction or a line extending in the column direction be seen narrower, achieving fine display of a graphic drawn with lines like a letter. Moreover, the sum of the weights of the mediatory pixels in a mediatory pixel row or mediatory pixel column including a mediatory pixel assigned a negative weight is 0. This configuration achieves finer display of a line.

As described above, the sum of the weights of the mediatory pixels to assign their relative luminance values to a subpixel is 1. The configuration such that the sums of the weights of the mediatory pixels to assign their relative luminance values to individual subpixels are the same enables display in the colors consistent with the picture frame. Further, the configuration such that the sum of the weights (rates) is 1 enables maximum utilization of the dynamic range (the difference between the maximum luminance value and the minimum luminance value) of each subpixel. The sum of the weights can be a value smaller than 1.

Figure 28:
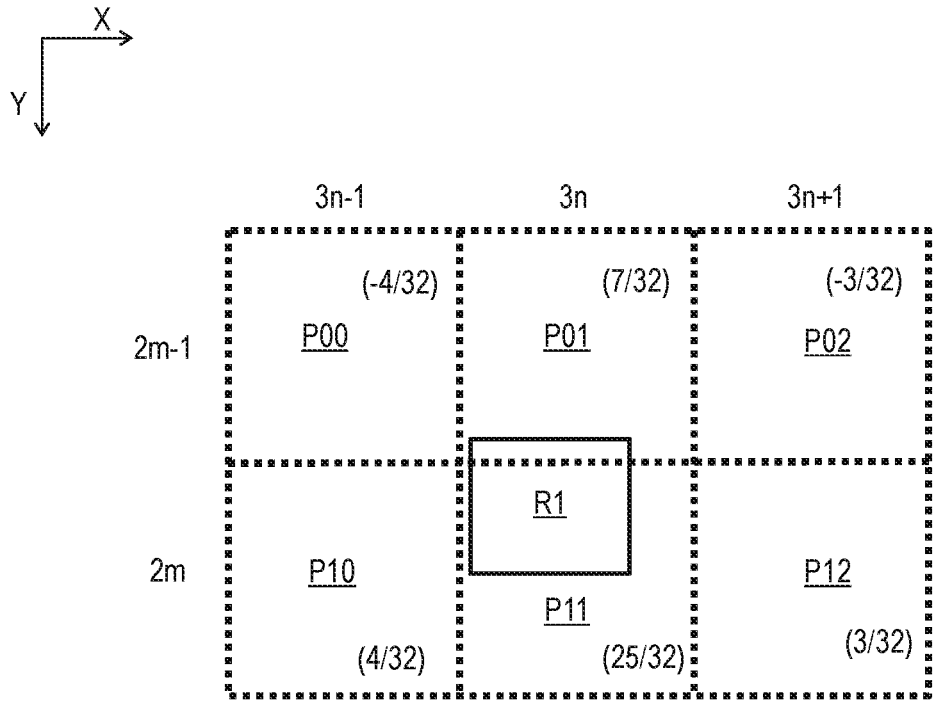
FIG. 28 illustrates a subpixel and frame pixels to assign their relative luminance values to the subpixel in Embodiment 1.

Next, relative luminance values to be assigned from frame pixels to each subpixel included in a panel unit region 45 is described. Each subpixel is assigned relative luminance values from a plurality of frame pixels. FIG. 28 illustrates the subpixel R1 and the frame pixels to assign their relative luminance values to the subpixel R1. The red relative luminance values of the frame pixels P01 and P11 each including a part of the subpixel R1 and the frame pixels P00, P02, P10, and P12 adjacent to the frame pixel P01 or P11 at outside of the subpixel R1 are assigned to the subpixel R1. These frame pixels surround the subpixel R1.

The product sum of the relative luminance values of these frame pixels and the assigned weights is the relative luminance value for the subpixel R1:

$$L_R1=(-4/32)L_P00+(7/32)L_P01+(-3/32)L_P02+(4/32)L_P10+(25/32)L_P11+(3/32)L_P12$$

The frame pixel column including the frame pixels P01 and P11 includes the entirety of the subpixel R1 (the frame pixel column overlaps the entirety of the subpixel R1) and the frame pixel P01 and P11 are assigned positive weights. The centroid of the subpixel R1 is closer to the frame pixel P11; the weight of the frame pixel P11 is larger than the weight of the frame pixel P01. The sum of the weights of the frame pixels P01 and P11 is 1.

The frame pixels P10 and P12 in the frame pixel row including the frame pixel P11 are assigned positive weights. The values of those weights are smaller than the weights of the frame pixels P11 and P01. The sum of the weights of the frame pixels P10, P11, and P12 is 1.

The frame pixel column including the frame pixels P00 and P10 does not overlap the subpixel R1 at all. The frame pixel P00 is assigned a negative weight. The sum of the weights of the frame pixels P00 and P10 is 0.

The frame pixel column including the frame pixels P02 and P12 does not overlap the subpixel R1 at all. The frame pixel P02 is assigned a negative weight. The sum of the weights of the frame pixels P02 and P12 is 0.

The frame pixel row including the frame pixels P00, P01, and P02 includes a part of the subpixel R1 (overlaps the subpixel R1) but the overlap area is smaller than the overlap area of the other pixel row. The sum of the weights of the frame pixels P00, P01, and P02 is 0. The sum of the weights of all frame pixels to assign their relative luminance values to the subpixel R1 is 1.

Figure 29:
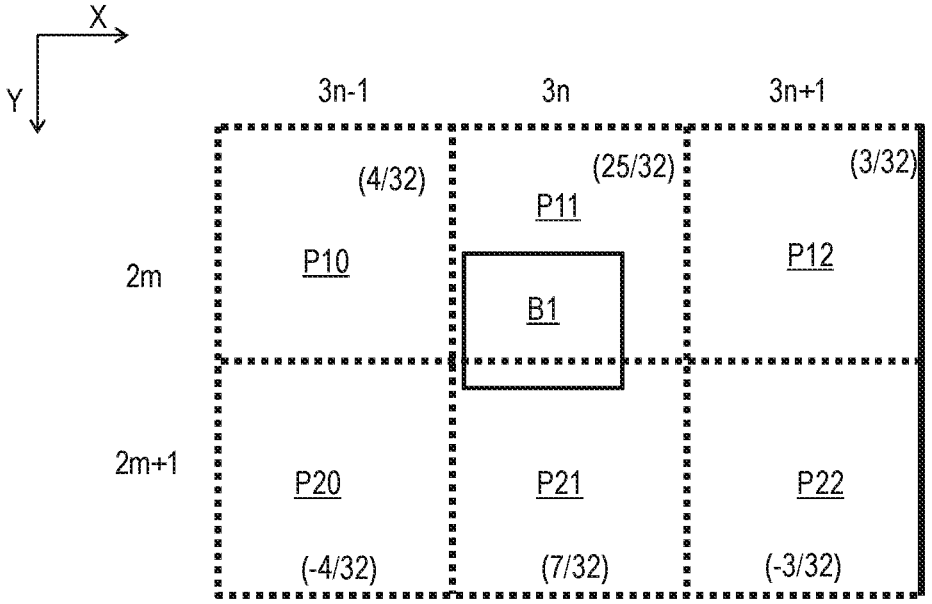
FIG. 29 illustrates a subpixel and frame pixels to assign their relative luminance values to the subpixel in Embodiment 1.

FIG. 29 illustrates the subpixel B1 and the frame pixels to assign their relative luminance values to the subpixel B1. The blue relative luminance values of the frame pixels P11 and P21 each including a part of the subpixel B1 and the frame pixels P10, P12, P20, and P22 adjacent to the frame pixel P11 or P21 at outside of the subpixel B1 are assigned to the subpixel B1. These frame pixels surround the subpixel B1.

The product sum of the relative luminance values of these frame pixels and the assigned weights is the relative luminance value for the subpixel B1:

$$L_B1=(4/32)L_P10+(25/32)L_P11+(3/32)L_P12+(-4/32)L_P20+(7/32)L_P21+(-3/32)L_P22$$

The frame pixel column including the frame pixels P11 and P21 includes the entirety of the subpixel B1; the frame pixel P11 and P21 are assigned positive weights. The centroid of the subpixel B1 is closer to the frame pixel P11; the weight of the frame pixel P11 is larger than the weight of the frame pixel P21. The sum of the weights of the frame pixels P11 and P21 is 1.

The frame pixels P10 and P12 in the frame pixel row including the frame pixel P11 are assigned positive weights. The values of those weights are smaller than the weights of the frame pixels P11 and P21. The sum of the weights of the frame pixels P10, P11, and P12 is 1.

The frame pixel column including the frame pixels P10 and P20 does not overlap the subpixel B1 at all. The frame pixel P20 is assigned a negative weight. The sum of the weights of the frame pixels P10 and P20 is 0.

The frame pixel column including the frame pixels P12 and P22 does not overlap the subpixel B1 at all. The frame pixel P22 is assigned a negative weight. The sum of the weights of the frame pixels P12 and P22 is 0.

The frame pixel row including the frame pixels P20, P21, and P22 includes a part of the subpixel B1 (overlaps the subpixel B1) but the overlap area is smaller than the overlap area of the other pixel row. The sum of the weights of the frame pixels P20, P21, and P22 is 0. The sum of the weights of all frame pixels to assign their relative luminance values to the subpixel B1 is 1.

Figure 30:
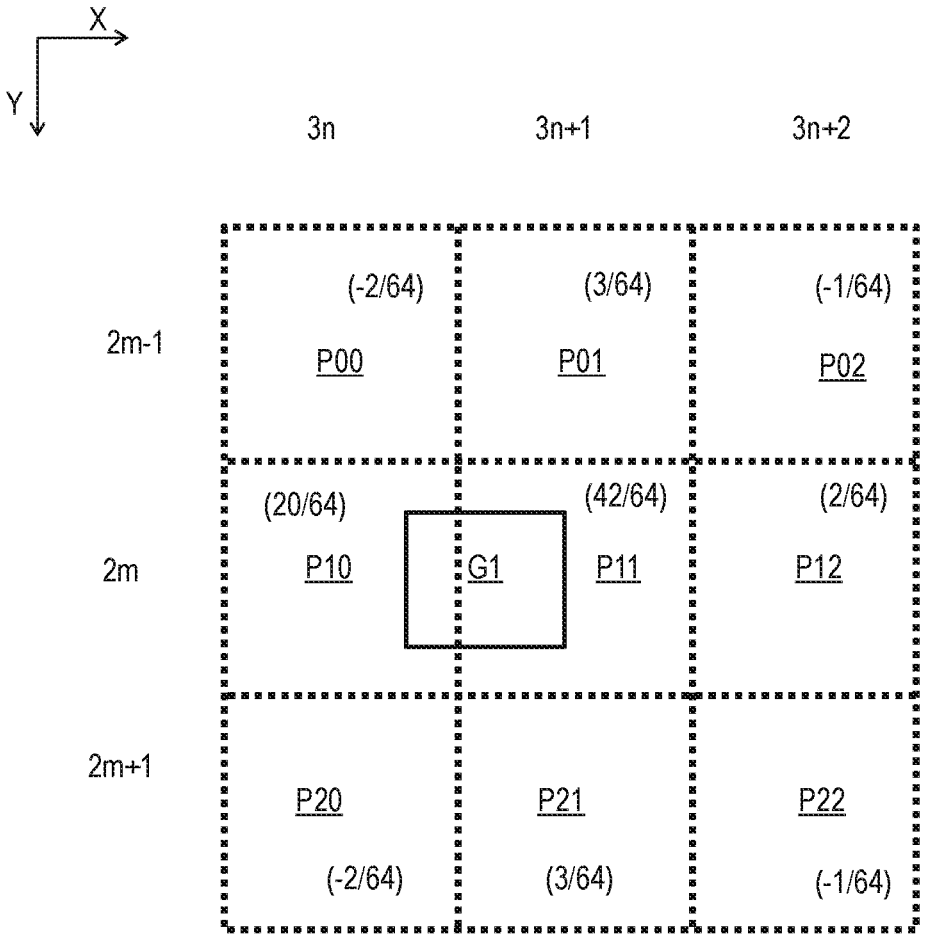
FIG. 30 illustrates a subpixel and frame pixels to assign their relative luminance values to the subpixel in Embodiment 1.

FIG. 30 illustrates the subpixel G1 and the frame pixels to assign their relative luminance values to the subpixel G1. The green relative luminance values of the frame pixels P10 and P11 each including a part of the subpixel G1 and the frame pixels P00, P01, P02, P12, P20, P21, and P22 disposed outside of the subpixel G1 are assigned to the subpixel G1. The frame pixel P11 includes the largest part of the subpixel G1 and the other frame pixels surround the frame pixel P11.

The product sum of the relative luminance values of these frame pixels and the assigned weights is the relative luminance value for the subpixel G1:

$$L_G1 = (-2/64)L_P00 + (3/64)L_P01 + (-1/64)L_P02 + (20/64)L_P10 + (42/64)L_P11 + (2/64)L_P12 + (-2/64)L_P20 + (3/64)L_P21 + (-1/64)L_P22$$

The frame pixels P10 and P11 each include a part of the subpixel G1 (overlap the subpixel G1). The part of the subpixel G1 included in the frame pixel P11 is larger than the part included in the frame pixel P10. In other words, the part of the subpixel G1 included in the frame pixel P11 is the largest.

The frame pixel column including the frame pixels P01, P11, and P21 includes a part of the subpixel G1. The frame pixels P01, P11, and P21 are assigned positive weights. The frame pixel column including the frame pixels P00, P10, and P20 includes a part of the subpixel G1 but the overlap area is smaller than the overlap area included in the frame pixel column including the frame pixels P01, P11, and P21. The frame pixel P10 is assigned a positive weight and the frame pixels P00 and P20 are assigned negative weights.

The sum of the weights of the frame pixels P00, P10, and P20 is a positive value. The sum of the weights of the frame pixels P01, P11, and P21 is a positive value and the value is larger than sum of the weights of the frame pixels P00, P10, and P20. The weight of the frame pixel P11 is larger than the weight of the frame pixel P10. The sum of the weights of the frame pixels in these two columns is 1.

The frame pixel row including the frame pixels P10, P11, and P12 includes the entirety of the subpixel G1. The frame pixel P12 is assigned a positive weight and its value is smaller than the one for the frame pixel P10. The sum of the weights of the frame pixels P10, P11, and P12 is 1.

The frame pixel row including the frame pixels P00, P01, and P02 does not overlap the subpixel G1 at all. The sum of the weights of the frame pixels P00, P01, and P02 is 0. The frame pixel row including the frame pixels P20, P21, and P22 does not overlap the subpixel G1 at all. The sum of the weights of the frame pixels P20, P21, and P22 is 0. The sum of the weights of all frame pixels is 1.

Figure 31:
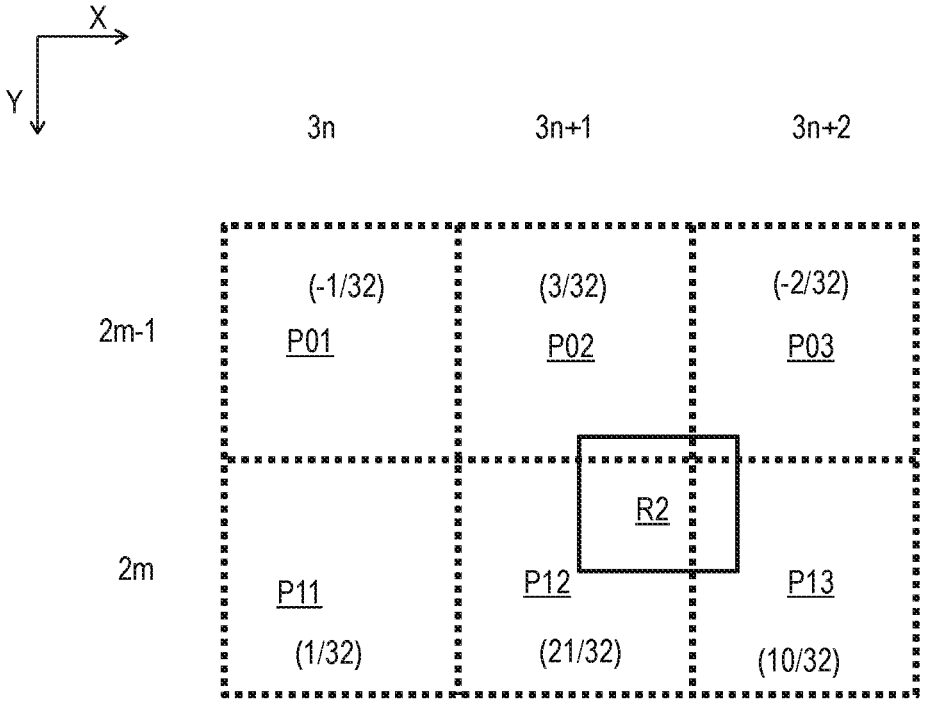
FIG. 31 illustrates a subpixel and frame pixels to assign their relative luminance values to the subpixel in Embodiment 1.

FIG. 31 illustrates the subpixel R2 and the frame pixels to assign their relative luminance values to the subpixel R2. The red relative luminance values of the frame pixels P02, P03, P12, and P13 each including a part of the subpixel R2 and the frame pixels P01 and P11 adjacent to the frame pixel P02 or P12 at outside of the subpixel R2 are assigned to the subpixel R2. These frame pixels surround the subpixel R2. The part of the subpixel R2 included in the frame pixel P12 is the largest; in other words, the centroid of the frame pixel P12 is the closest to the centroid of the subpixel R2.

The product sum of the relative luminance values of the frame pixels and the assigned weights is the relative luminance value for the subpixel R2:

$$L_R2=(-1/32)L_P01+(3/32)L_P02+(-2/32)L_P03+(1/32)L_P11+(21/32)L_P12+(10/32)L_P13$$

The frame pixel column including the frame pixels P02 and P12 includes a part of the subpixel R2 (overlaps the subpixel R2); the frame pixels P02 and P12 are assigned positive weights. The centroid of the subpixel R2 is closer to the frame pixel P12; the weight of the frame pixel P12 is larger than the weight of the frame pixel P02.

The frame pixel column including the frame pixels P03 and P13 includes a part of the subpixel R2 (overlaps the subpixel R2) but the overlap area is smaller than the overlap area included in the frame pixel column including the frame pixels P02 and P12. The frame pixel P03 is assigned a negative weight and the frame pixel P13 is assigned a positive weight.

The sum of the weights of the frame pixels P02 and P12 is a positive value. The sum of the weights of the frame pixels P03 and P13 is a positive value and the value is smaller than the sum of the weights of the frame pixels P02 and P12. The sum of the weights of the frame pixels P02, P12, P03, and P13 is 1.

The frame pixels P11 and P13 in the frame pixel row including the frame pixel P12 are assigned positive weights. Their values are smaller than the value of the weight of the frame pixel P12. The weight of the frame pixel P13 is larger than the weight of the frame pixel P11. The sum of the weights of the frame pixels P11, P12, and P13 is 1.

The frame pixel column including the frame pixels P01 and P11 does not overlap the subpixel R2 at all. The frame pixel P01 is assigned a negative weight. The sum of the weights of the frame pixels P01 and P11 is 0.

The frame pixel row including the frame pixels P01, P02, and P03 includes a part of the subpixel R2 (overlaps the subpixel R2) but the overlap area is smaller than the overlap area of the other pixel row. The sum of the weights of the frame pixels P01, P02, and P03 is 0. The sum of the weights of all frame pixels to assign their relative luminance values to the subpixel R2 is 1.

Figure 32:
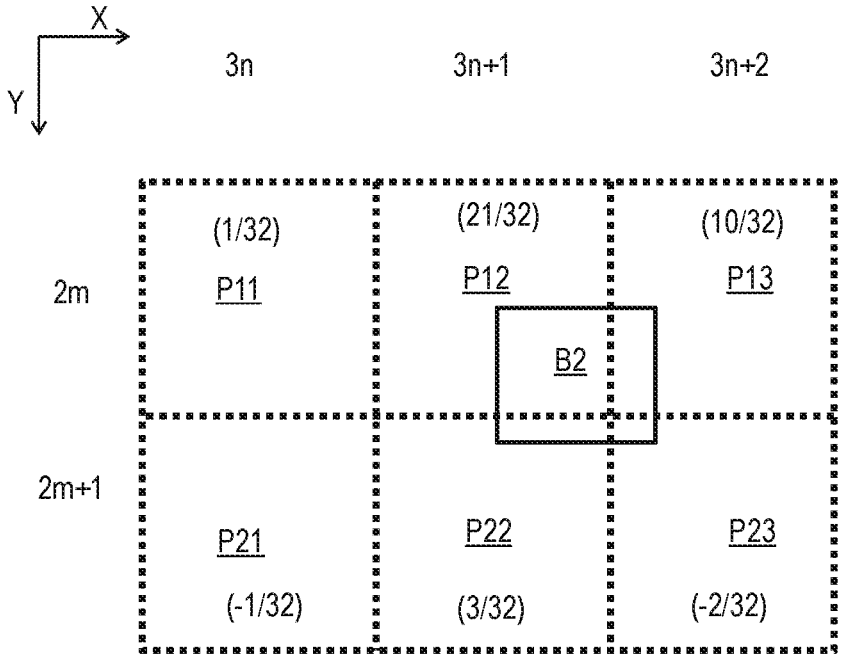
FIG. 32 illustrates a subpixel and frame pixels to assign their relative luminance values to the subpixel in Embodiment 1.

FIG. 32 illustrates the subpixel B2 and the frame pixels to assign their relative luminance values to the subpixel B2. The blue relative luminance values of the frame pixels P12, P13, P22, and P23 each including a part of the subpixel B2 and the frame pixels P11 and P21 adjacent to the frame pixel P12 or P22 at outside of the subpixel B2 are assigned to the subpixel B2. These frame pixels surround the subpixel B2. The part of the subpixel B2 included in the frame pixel P12 is the largest; in other words, the centroid of the frame pixel P12 is the closest to the centroid of the subpixel B2.

The product sum of the relative luminance values of these frame pixels and the assigned weights is the relative luminance value for the subpixel B2:

$$L_B2=(1/32)L_P11+(21/32)L_P12+(10/32)L_P13+(-1/32)L_P21+(3/32)L_P22+(-2/32)L_P23$$

The frame pixel column including the frame pixels P12 and P22 includes a part of the subpixel B2 (overlaps the subpixel B2); the frame pixels P12 and P22 are assigned positive weights. The centroid of the subpixel B2 is closer to the frame pixel P12; the weight of the frame pixel P12 is larger than the weight of the frame pixel P22.

The frame pixel column including the frame pixels P13 and P23 includes a part of the subpixel B2 (overlaps the subpixel B2) but the overlap area is smaller than the overlap area included in the frame pixel column including the frame pixels P12 and P22. The frame pixel P23 is assigned a negative weight and the frame pixel P13 is assigned a positive weight.

The sum of the weights of the frame pixels P12 and P22 is a positive value. The sum of the weights of the frame pixels P13 and P23 is a positive value and the value is smaller than the sum of the weights of the frame pixels P12 and P22. The sum of the weights of the frame pixels P12, P22, P13, and P23 is 1.

The frame pixels P11 and P13 in the frame pixel row including the frame pixel P12 are assigned positive weights. Their values are smaller than the value of the weight of the frame pixel P12. The weight of the frame pixel P13 is larger than the weight of the frame pixel P11. The sum of the weights of the frame pixels P11, P12, and P13 is 1.

The frame pixel column including the frame pixels P11 and P21 does not overlap the subpixel B2 at all. The frame pixel P21 is assigned a negative weight. The sum of the weights of the frame pixels P11 and P21 is 0.

The frame pixel row including the frame pixels P21, P22, and P23 includes a part of the subpixel B2 (overlaps the subpixel B2) but the overlap area is smaller than the overlap area of the other pixel row. The sum of the weights of the frame pixels P21, P22, and P23 is 0. The sum of the weights of all frame pixels to assign their relative luminance values to the subpixel B2 is 1.

Figure 33:
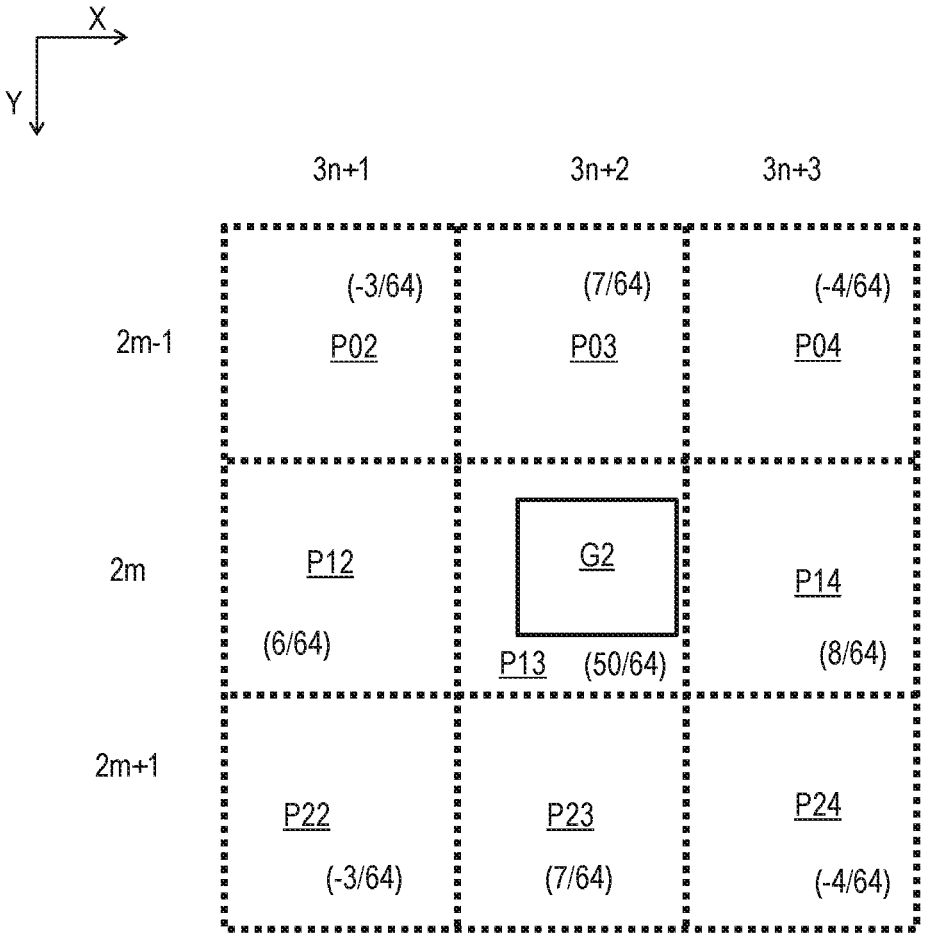
FIG. 33 illustrates a subpixel and frame pixels to assign their relative luminance values to the subpixel in Embodiment 1.

FIG. 33 illustrates the subpixel G2 and the frame pixels to assign their relative luminance values to the subpixel G2. The green relative luminance values of the frame pixel P13 including the entirety of the subpixel G2 and the frame pixels P02, P03, P04, P12, P14, P22, P23, and P24 surrounding the frame pixel P13 are assigned to the subpixel G2.

The product sum of the relative luminance values of the frame pixels and the assigned weights is the relative luminance value for the subpixel G2:

$$L_G2 = (-3/64)L_P02 + (7/64)L_P03 + (-4/64)L_P04 + (6/64)L_P12 + (50/64)L_P13 + (8/64)L_P14 + (-3/64)L_P22 + (7/64)L_P23 + (-4/64)L_P24$$

The frame pixel column including the frame pixels P03, P13, and P23 includes the entirety of the subpixel G2. The frame pixels P03, P13, and P23 are assigned positive weights. The weight of the frame pixel P13 is the largest. The sum of the weights of the frame pixels P03, P13, and P23 is 1.

The frame pixel row including the frame pixels P12, P13, and P14 includes the entirety of the subpixel G2. The frame pixels P12 and P14 are assigned positive weights and their values are smaller than the weight of the frame pixel P13. The centroid of the subpixel G2 is closer to the frame pixel P14 than the frame pixel P12; the weight of the frame pixel P14 is larger than the weight of the frame pixel P12. The sum of the weights of the frame pixels P12, P13, and P14 is 1.

The frame pixel column including the frame pixels P02, P12, and P22 does not overlap the subpixel G2 at all. The frame pixels P02 and P22 are assigned negative weights. The sum of the weights of the frame pixels P02, P12, and P22 is 0. The frame pixel column including the frame pixels P04, P14, and P24 does not overlap the subpixel G2 at all. The frame pixels P04 and P24 are assigned negative weights. The sum of the weights of the frame pixels P04, P14, and P24 is 0.

The frame pixel row including the frame pixels P02, P03, and P04 does not overlap the subpixel G2 at all. The sum of the weights of the frame pixels P02, P03, and P04 is 0. The frame pixel row including the frame pixels P22, P23, and P24 does not overlap the subpixel G2 at all. The sum of the weights of the frame pixels P22, P23, and P24 is 0. The sum of the weights of all frame pixels is 1.

Figure 34:
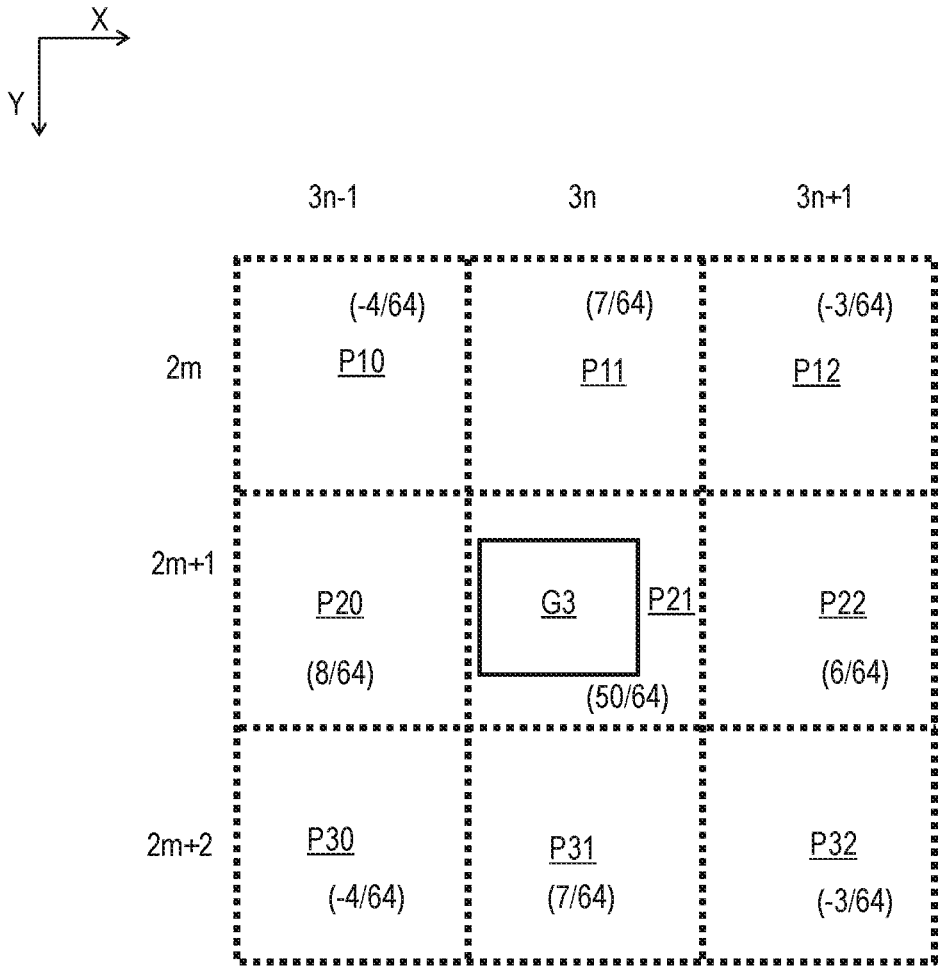
FIG. 34 illustrates a subpixel and frame pixels to assign their relative luminance values to the subpixel in Embodiment 1.

FIG. 34 illustrates the subpixel G3 and the frame pixels to assign their relative luminance values to the subpixel G3. The green relative luminance values of the frame pixel P21 including the entirety of the subpixel G3 and the frame pixels P10, P11, P12, P20, P22, P30, P31, and P32 surrounding the frame pixel P21 are assigned to the subpixel G3.

The relation (weight pattern) of the relative luminance values of the frame pixels P10, P11, P12, P20, P21, P22, P30, P31, and P32 to the relative luminance value of the subpixel G3 is the same as the relation (weight pattern) of the relative luminance values of the frame pixels P04, P03, P02, P14, P13, P12, P24, P23, and P22 to the relative luminance value of the subpixel G2.

Figure 35:
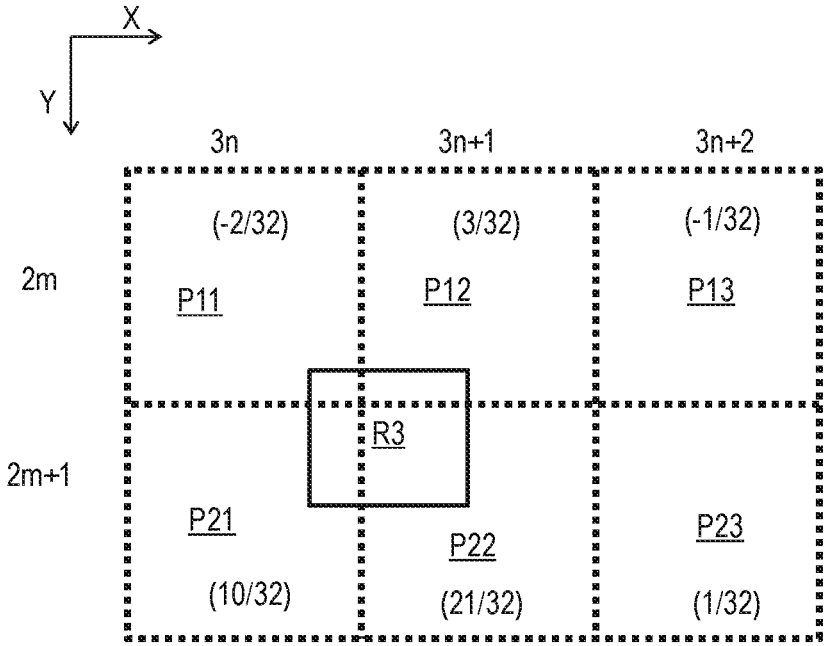
FIG. 35 illustrates a subpixel and frame pixels to assign their relative luminance values to the subpixel in Embodiment 1.

FIG. 35 illustrates the subpixel R3 and the frame pixels to assign their relative luminance values to the subpixel R3. The red relative luminance values of the frame pixels P11, P12, P21, and P22 each including a part of the subpixel R3 and the frame pixels P13 and P23 adjacent to the frame pixel P12 or P22 at outside of the subpixel R3 are assigned to the subpixel R3. These frame pixels surround the subpixel R3. The part of the subpixel R3 included in the frame pixel P22 is the largest; in other words, the centroid of the frame pixel P22 is the closest to the centroid of the subpixel R3.

The relation (weight pattern) of the relative luminance values of the frame pixels P11, P12, P13, P21, P22, and P23 to the relative luminance value of the subpixel R3 is the same as the relation (weight pattern) of the relative luminance values of the frame pixels P03, P02, P01, P13, P12, and P11 to the relative luminance value of the subpixel R2.

Figure 36:
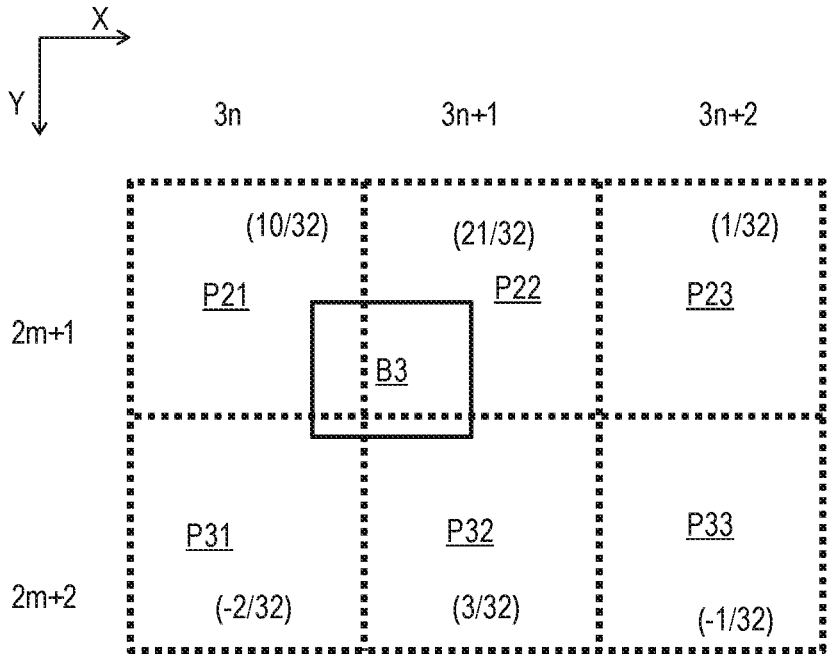
FIG. 36 illustrates a subpixel and frame pixels to assign their relative luminance values to the subpixel in Embodiment 1.

FIG. 36 illustrates the subpixel B3 and the frame pixels to assign their relative luminance values to the subpixel B3. The blue relative luminance values of the frame pixels P21, P22, P31, and P32 each including a part of the subpixel B3 and the frame pixels P23 and P33 adjacent to the frame pixel P22 or P32 at outside of the subpixel B3 are assigned to the subpixel B3. These frame pixels surround the subpixel B3. The part of the subpixel B3 included in the frame pixel P22 is the largest; in other words, the centroid of the frame pixel P22 is the closest to the centroid of the subpixel B3.

The relation (weight pattern) of the relative luminance values of the frame pixels P21, P22, P23, P31, P32, and P33 to the relative luminance value of the subpixel B3 is the same as the relation (weight pattern) of the relative luminance values of the frame pixels P13, P12, P11, P23, P22, and P21 to the relative luminance value of the subpixel B2.

Figure 37:
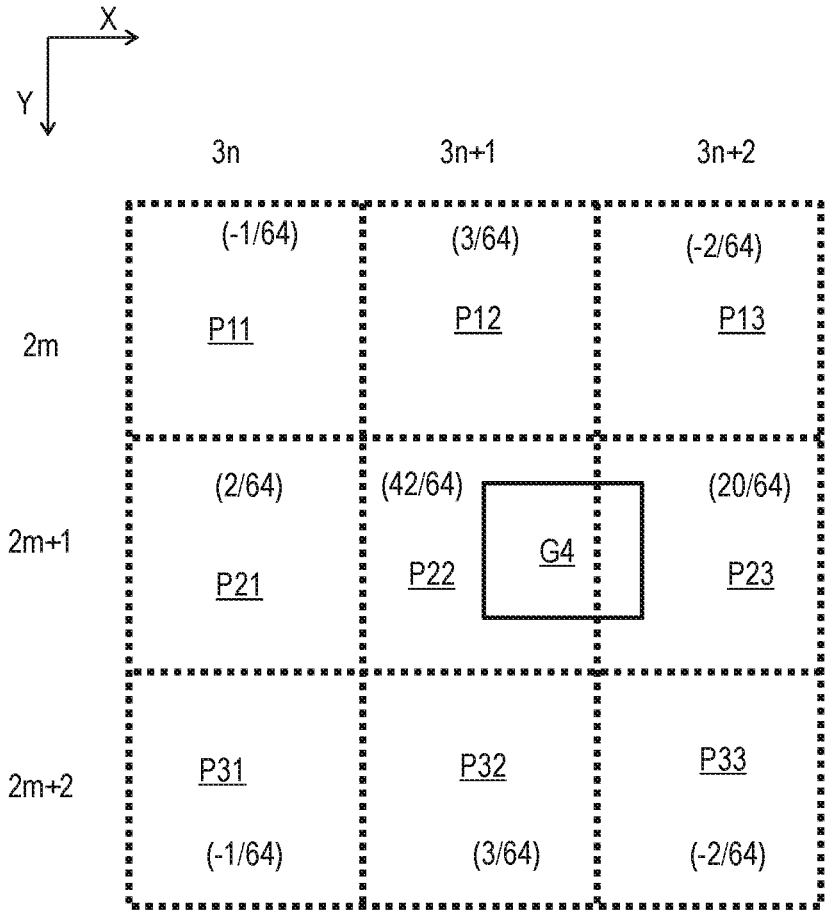
FIG. 37 illustrates a subpixel and frame pixels to assign their relative luminance values to the subpixel in Embodiment 1.

FIG. 37 illustrates the subpixel G4 and the frame pixels to assign their relative luminance values to the subpixel G4. The blue relative luminance values of the frame pixels P22 and P23 each including a part of the subpixel G4 and the frame pixels P11, P12, P13, P21, P31, P32, and P33 disposed outside of the subpixel G4 are assigned to the subpixel G4. The frame pixel P22 includes the largest part of the subpixel G4 and the other frame pixels surround the frame pixel P22.

The relation (weight pattern) of the relative luminance values of the frame pixels P11, P12, P13, P21, P22, P23, P31, P32, and P33 to the relative luminance value of the subpixel G4 is the same as the relation (weight pattern) of the relative luminance values of the frame pixels P02, P01, P00, P12, P11, P10, P22, P21, and P20 to the relative luminance value of the subpixel G1.

Figure 38:
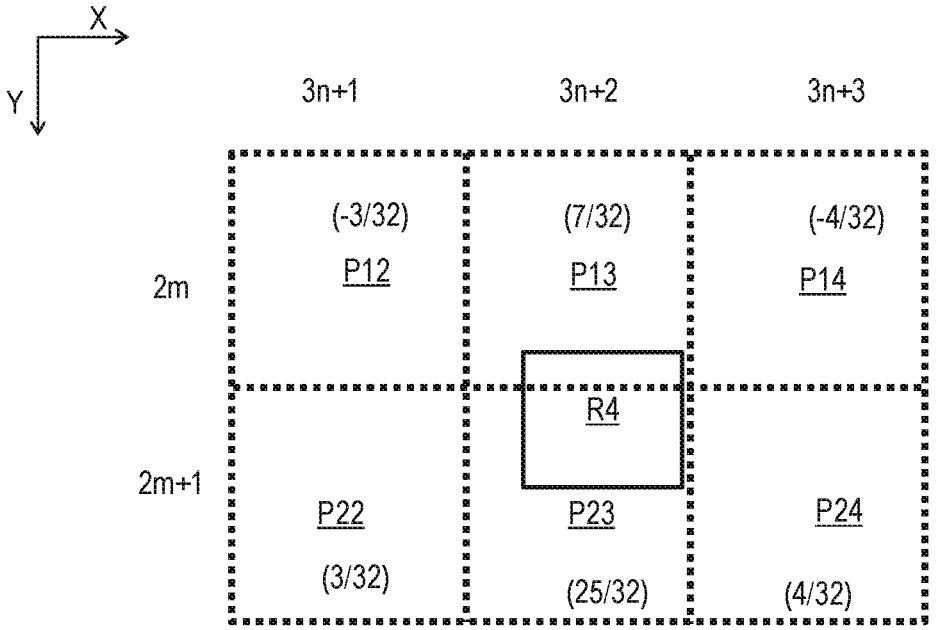
FIG. 38 illustrates a subpixel and frame pixels to assign their relative luminance values to the subpixel in Embodiment 1.

FIG. 38 illustrates the subpixel R4 and the frame pixels to assign their relative luminance values to the subpixel R4. The red relative luminance values of the frame pixels P13 and P23 each including a part of the subpixel R4 and the frame pixels P12, P14, P22, and P24 adjacent to the frame pixel P13 or P23 at outside of the subpixel R4 are assigned to the subpixel R4. These frame pixels surround the subpixel R4.

The relation (weight pattern) of the relative luminance values of the frame pixels P12, P13, P14, P22, P23, and P24 to the relative luminance value of the subpixel R4 is the same as the relation (weight pattern) of the relative luminance values of the frame pixels P02, P01, P00, P12, P11, and P10 to the relative luminance value of the subpixel R1.

Figure 39:
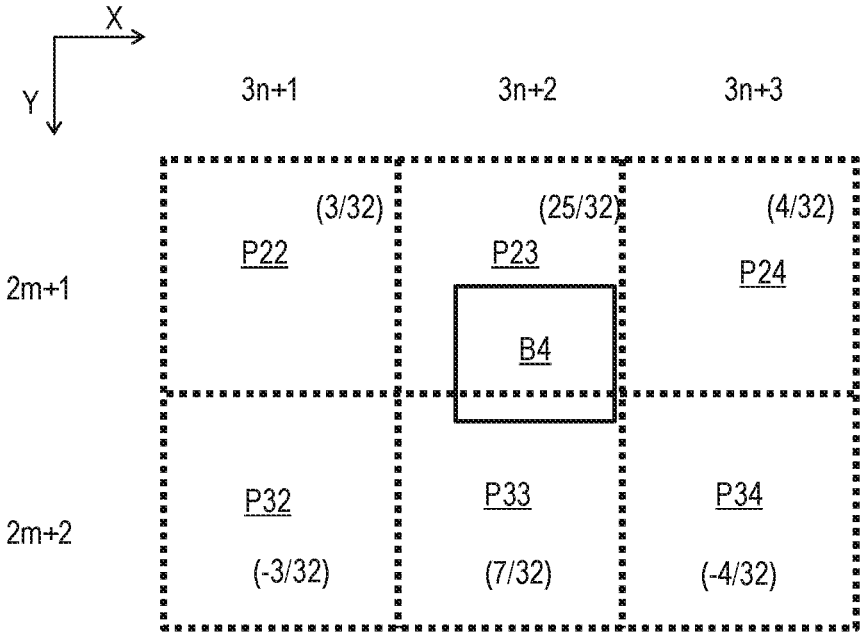
FIG. 39 illustrates a subpixel and frame pixels to assign their relative luminance values to the subpixel in Embodiment 1.

FIG. 39 illustrates the subpixel B4 and the frame pixels to assign their relative luminance values to the subpixel B4. The blue relative luminance values of the frame pixels P23 and P33 each including a part of the subpixel B4 and the frame pixels P22, P24, P32, and P34 adjacent to the frame pixel P23 or P33 at outside of the subpixel B4 are assigned to the subpixel B4. These frame pixels surround the subpixel B4.

The relation (weight pattern) of the relative luminance values of the frame pixels P22, P23, P24, P32, P33, and P34 to the relative luminance value of the subpixel B4 is the same as the relation (weight pattern) of the relative luminance values of the frame pixels P12, P11, P10, P22, P21, and P20 to the relative luminance value of the subpixel B1.

As described with reference to FIGS. 28 to 39, the frame pixels to determine a relative luminance value for a red or blue subpixel are the frame pixel closest to the subpixel, the frame pixels adjacent on both sides along the X-axis to the frame pixel closest to the subpixel, the frame pixel second closest to the subpixel along the Y-axis, and the frame pixels adjacent on both sides along the X-axis to the frame pixel second closest to the subpixel.

The frame pixels to determine a relative luminance value for a green subpixel are the frame pixel closest to the subpixel, the frame pixels adjacent on both sides along the X-axis to the frame pixel closest to the subpixel, the frame pixel adjacent in the upward direction to the frame pixel closest to the subpixel, the frame pixels adjacent on both sides along the X-axis to the frame pixel adjacent in the upward direction, the frame pixel adjacent in the downward direction to the frame pixel closest to the subpixel, and the frame pixels adjacent on both sides along the X-axis to the frame pixel adjacent in the downward direction.

As described with reference to FIGS. 28 to 39, among the frame pixels to assign their relative luminance values to a subpixel, only one frame pixel row and one frame pixel column including the frame pixel closest to the subpixel are composed of only frame pixels assigned positive weights. This configuration makes a line extending in the row direction or a line extending in the column direction seen narrower, achieving fine display of a graphic drawn with lines like a letter.

Moreover, among the frame pixels to assign their relative luminance values to a subpixel, every frame pixel row except for the one frame pixel row includes a frame pixel assigned a negative weight and the sum of the weights of the frame pixels therein is 0. Among the frame pixels to assign their relative luminance values to a subpixel, a frame pixel column that does not include the subpixel (overlap the subpixel) at all includes a frame pixel assigned a negative weight and the sum of the weights of the frame pixels therein is 0. This configuration achieves finer display of a line.

A frame pixel column that includes a part of a subpixel but the part of the subpixel is smaller than the remaining part of the subpixel included in a different frame pixel column includes a frame pixel assigned a negative weight. The sum of the weights of the frame pixels therein is smaller than the sum of the weights of the frame pixels in the frame pixel column including the larger part of the subpixel. This configuration enables natural display of a planar image as well as fine display of a line.

As described above, the sum of the weights of the frame pixels to assign their relative luminance values to each subpixel is the same; specifically, the value of the sum is 1. Since the sums of the weights are the same among all subpixels, colors more consistent with the colors of a picture frame can be displayed. Furthermore, since the sum of the weights of the relative luminance values for a subpixel is 1, the dynamic range (the difference between the maximum luminance value and the minimum luminance value) of the subpixel can be utilized maximally.

The sum of the weights of the relative luminance values for each subpixel can be less than 1. The sum of the weights of the relative luminance values for each subpixel can be different as far as the design allows. The weights of the relative luminance values assigned from frame pixels to a subpixel can be different color by color. The relative luminance value for a subpixel can be determined by a calculation using the relative luminance values of frame pixels and their weights that is different from the product sum. These apply to the other embodiments.

The relative luminance converter 342 of the driver IC 134 can determine the relative luminance values for each panel subpixel from the relative luminance values of the frame pixels associated therewith using the weights described with reference to FIGS. 28 to 39. The relative luminance value of a subpixel in a panel unit region is the product sum of the relative luminance values of the associated frame pixels and the weights. In other words, it is the sum of predetermined rates of the relative luminance values of the associated frame pixels.

The driver IC 134 can calculate relative luminance values for mediatory pixels from the relative luminance values of frame pixels and determine the relative luminance values for panel subpixels from the relative luminance values of the mediatory pixels. The results of these two ways of calculation are the same.

Panel Wiring

Figure 40:
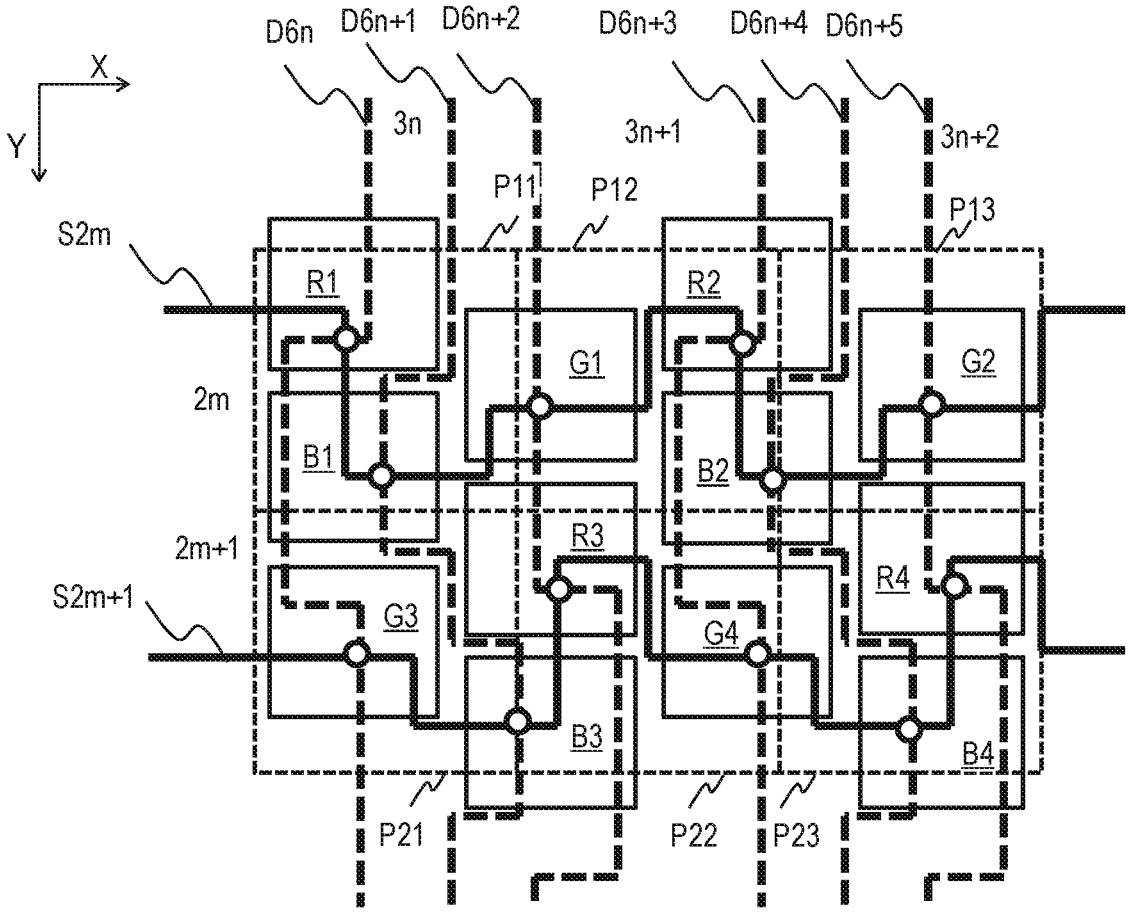
FIG. 40 schematically illustrates connection of subpixels (anode electrodes thereof) and lines in a panel unit region in Embodiment 1.

FIG. 40 schematically illustrates connection of subpixels (anode electrodes thereof) and lines in a panel unit region 45. In FIG. 40, the scanning line and the data line passing through the circle within each subpixel are connected through the pixel circuit for the subpixel to control the subpixel.

All subpixels to be assigned relative luminance values from one pixel row in the frame unit region 41 are connected with the same scanning line. Specifically, the panel subpixels R1, B1, G1, R2, B2, and G2 are connected with a scanning line S2$m$. The panel subpixels R3, B3, G3, R4, B4, and G4 are connected with a scanning line S2$m$+1.

The panel subpixels R1, B1, G1, R2, B2, and G2 are assigned relative luminance values only from the 2m-th frame pixel row in the picture frame. The panel subpixels R3, B3, G3, R4, B4, and G4 are assigned relative luminance values only from the (2m+1)th frame pixel row in the picture frame.

In the display region 125, all panel subpixels associated with one frame pixel row are connected with the same scanning line. The relative luminance value for a panel subpixel is determined only from the relative luminance values for frame pixels in one frame pixel row and does not rely on the relative luminance values for the other frame pixel rows. Accordingly, a line memory for storing relative luminance values for other frame pixel rows is not necessary to calculate the signal to be provided to the subpixel through a data line.

In the example of FIG. 40, the subpixels connected with one scanning line are connected with different data lines. Specifically, the panel subpixels R1 and G3 are connected with a data line D6*n*. The panel subpixels B1 and B3 are connected with a data line D6*n*+1. The panel subpixels G1 and R3 are connected with a data line D6*n*+2. The panel subpixels R2 and G4 are connected with a data line D6*n*+3. The panel subpixels B2 and B4 are connected with a data line D6*n*+4. The panel subpixels G2 and R4 are connected with a data line D6*n*+5.

The connection of the subpixels and the lines illustrated in FIG. 40 is an example and other connection is available. For example, a plurality of subpixels connected with one scanning line can be connected with one data line.

To avoid impairment of display quality between a picture frame and a display panel that are different in number of pixels, this embodiment converts relative luminance values for a frame pixel to relative luminance values for panel subpixels with simple calculations (circuit configuration).

Embodiment 2

Hereinafter, Embodiment 2 is described. Differences from Embodiment 1 are mainly described. This embodiment describes another example of the relation between the relative luminance values of frame pixels and the relative luminance values of mediatory pixels. The foregoing example utilizes linear interpolation to determine the relative luminance value of a mediatory pixel from the relative luminance values of frame pixels. The following example utilizes the nearest neighbor algorithm to determine the relative luminance value of a mediatory pixel from the relative luminance value of a frame pixel. The nearest neighbor algorithm assigns a mediatory pixel the relative luminance value of the frame pixel closest to the mediatory pixel. Specifically, in the locational relation between the mediatory pixels and the frame pixels illustrated in FIG. 4, the following relations are satisfied:

$$L_V11=L_P11$$

$$L_V12=L_P12$$

$$L_V13=L_P12$$

$$L_V14=L_P13$$

$$L_V21=L_P21$$

$$L_V22=L_P22$$

$$L_V23=L_P22$$

$$L_V24=L_P23$$

Next, relations between the relative luminance values of the frame pixels and the relative luminance values of the panel subpixels in the case where the relative luminance values of the frame pixels and the relative luminance values of the mediatory pixels have the above relations are described. The relations between the relative luminance values of the mediatory pixels and the relative luminance values of the panel subpixels are the same as those described with reference to FIGS. 7 to 27.

Figure 41:
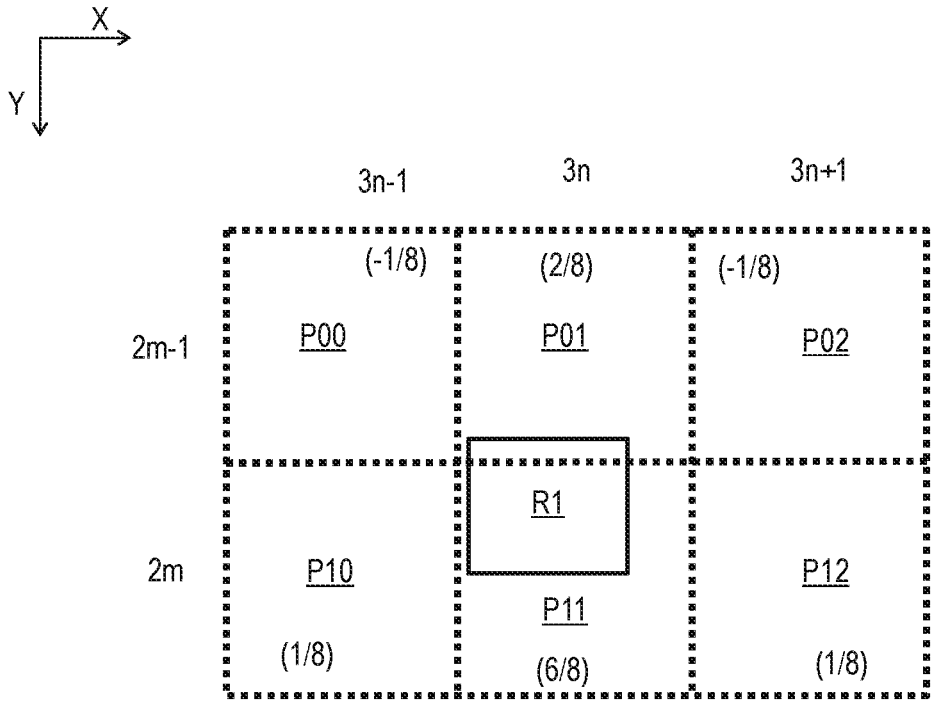
FIG. 41 illustrates a subpixel and frame pixels to assign their relative luminance values to the subpixel in Embodiment 2.

FIG. 41 illustrates the subpixel R1 and the frame pixels to assign their relative luminance values to the subpixel R1. The red relative luminance values of the frame pixels P01 and P11 each including a part of the subpixel R1 and the frame pixels P00, P02, P10, and P12 adjacent to the frame pixel P01 or P11 at outside of the subpixel R1 are assigned to the subpixel R1. These frame pixels surround the subpixel R1.

The product sum of the relative luminance values of these frame pixels and the assigned weights is the relative luminance value for the subpixel R1:

$$L_R1=(-1/8)L_P00+(2/8)L_P01+(-1/8)L_P02+(1/8)L_P10+(6/8)L_P11+(1/8)L_P12$$

The frame pixel column including the frame pixels P01 and P11 includes the entirety of the subpixel R1; the frame pixel P01 and P11 are assigned positive weights. The centroid of the subpixel R1 is closer to the frame pixel P11; the weight of the frame pixel P11 is larger than the weight of the frame pixel P01. The sum of the weights of the frame pixels P01 and P11 is 1.

The frame pixels P10 and P12 in the frame pixel row including the frame pixel P11 are assigned positive weights. The values of those weights are smaller than the weights of the frame pixels P11 and P01. The sum of the weights of the frame pixels P10, P11, and P12 is 1.

The frame pixel column including the frame pixels P00 and P10 does not overlap the subpixel R1 at all. The frame pixel P00 is assigned a negative weight. The sum of the weights of the frame pixels P00 and P10 is 0.

The frame pixel column including the frame pixels P02 and P12 does not overlap the subpixel R1 at all. The frame pixel P02 is assigned a negative weight. The sum of the weights of the frame pixels P02 and P12 is 0.

The frame pixel row including the frame pixels P00, P01, and P02 includes a part of the subpixel R1 (overlaps the subpixel R1) but the overlap area is smaller than the overlap area of the other pixel row. The sum of the weights of the frame pixels P00, P01, and P02 is 0. The sum of the weights of all frame pixels to assign their relative luminance values to the subpixel R1 is 1.

Figure 42:
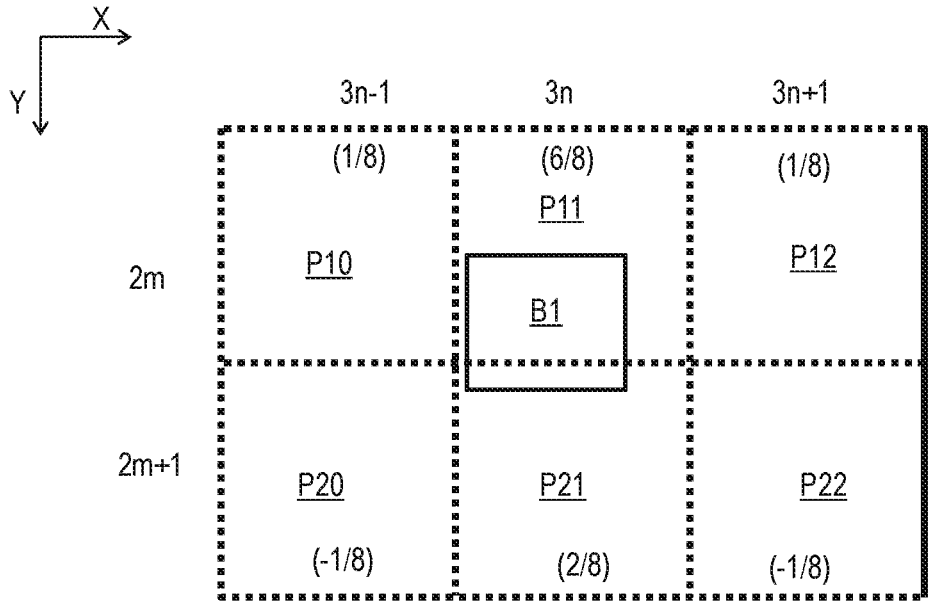
FIG. 42 illustrates a subpixel and frame pixels to assign their relative luminance values to the subpixel in Embodiment 2.

FIG. 42 illustrates the subpixel B1 and the frame pixels to assign their relative luminance values to the subpixel B1. The blue relative luminance values of the frame pixels P11 and P21 each including a part of the subpixel B1 and the frame pixels P10, P12, P20, and P22 adjacent to the frame pixel P11 or P21 at outside of the subpixel B1 are assigned to the subpixel B1. These frame pixels surround the subpixel B1.

The product sum of the relative luminance values of these frame pixels and the assigned weights is the relative luminance value for the subpixel B1:

$$L_B1=(1/8)L_P10+(6/8)L_P11+(1/8)L_P12+(-1/8)L_P20+(2/8)L_P21+(-1/8)L_P22$$

The frame pixel column including the frame pixels P11 and P21 includes the entirety of the subpixel B1; the frame pixel P11 and P21 are assigned positive weights. The centroid of the subpixel B1 is closer to the frame pixel P11; the weight of the frame pixel P11 is larger than the weight of the frame pixel P21. The sum of the weights of the frame pixels P11 and P21 is 1.

The frame pixels P10 and P12 in the frame pixel row including the frame pixel P11 are assigned positive weights. The values of those weights are smaller than the weights of the frame pixels P11 and P21. The sum of the weights of the frame pixels P10, P11, and P12 is 1.

The frame pixel column including the frame pixels P10 and P20 does not overlap the subpixel B1 at all. The frame pixel P20 is assigned a negative weight. The sum of the weights of the frame pixels P10 and P20 is 0.

The frame pixel column including the frame pixels P12 and P22 does not overlap the subpixel B1 at all. The frame pixel P22 is assigned a negative weight. The sum of the weights of the frame pixels P12 and P22 is 0.

The frame pixel row including the frame pixels P20, P21, and P22 includes a part of the subpixel B1 (overlaps the subpixel B1) but the overlap area is smaller than the overlap area of the other pixel row. The sum of the weights of the frame pixels P20, P21, and P22 is 0. The sum of the weights of all frame pixels to assign their relative luminance values to the subpixel B1 is 1.

Figure 43:
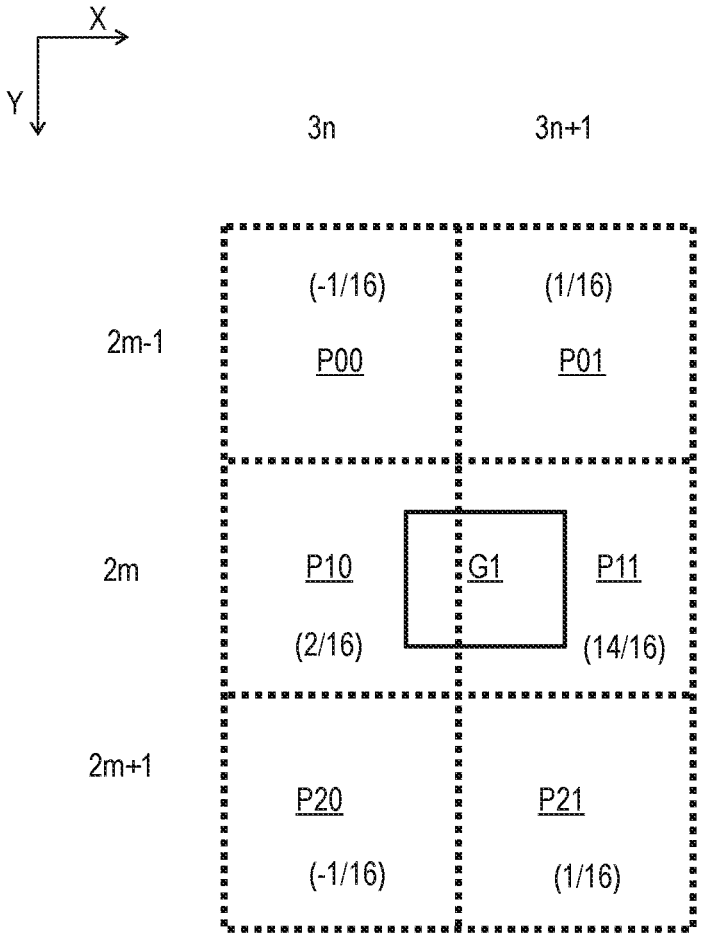
FIG. 43 illustrates a subpixel and frame pixels to assign their relative luminance values to the subpixel in Embodiment 2.

FIG. 43 illustrates the subpixel G1 and the frame pixels to assign their relative luminance values to the subpixel G1. The green relative luminance values of the frame pixels P10 and P11 each including a part of the subpixel G1 and the frame pixels P00, P01, P20, and P21 disposed outside of the subpixel G1 are assigned to the subpixel G1. The frame pixel P11 includes the largest part of the subpixel G1.

The product sum of the relative luminance values of these frame pixels and the assigned weights is the relative luminance value for the subpixel G1:

$$L_G1=(-1/16)L_P00+(1/16)L_P01+(2/16)L_P10+(14/16)L_P11+(-1/16)L_P20+(1/16)L_P21$$

The frame pixels P10 and P11 each include a part of the subpixel G1 (overlap the subpixel G1). The part of the subpixel G1 included in the frame pixel P11 is larger than the part included in the frame pixel P10. In other words, the part of the subpixel G1 included in the frame pixel P11 is the largest.

The frame pixel column including the frame pixels P01, P11, and P21 includes a part of the subpixel G1. The frame pixels P01, P11, and P21 are assigned positive weights. The sum of the weights of the frame pixels P01, P11, and P21 is 1.

The frame pixel column including the frame pixels P00, P10, and P20 includes a part of the subpixel G1 but the overlap area is smaller than the overlap area included in the frame pixel column including the frame pixels P01, P11, and P21. The frame pixels P00 and P20 are assigned negative weights. The sum of the weights of the frame pixels P01, P11, and P21 is 0.

The frame pixel row including the frame pixels P10 and P11 includes the entirety of the subpixel G1. The sum of the weights of the frame pixels P10 and P11 is 1. The frame pixel row including the frame pixels P00 and P01 does not overlap the subpixel G1 at all. The sum of the weights of the frame pixels P00 and P01 is 0. The frame pixel row including the frame pixels P20 and P21 does not overlap the subpixel G1 at all. The sum of the weights of the frame pixels P20 and P21 is 0.

Figure 44:
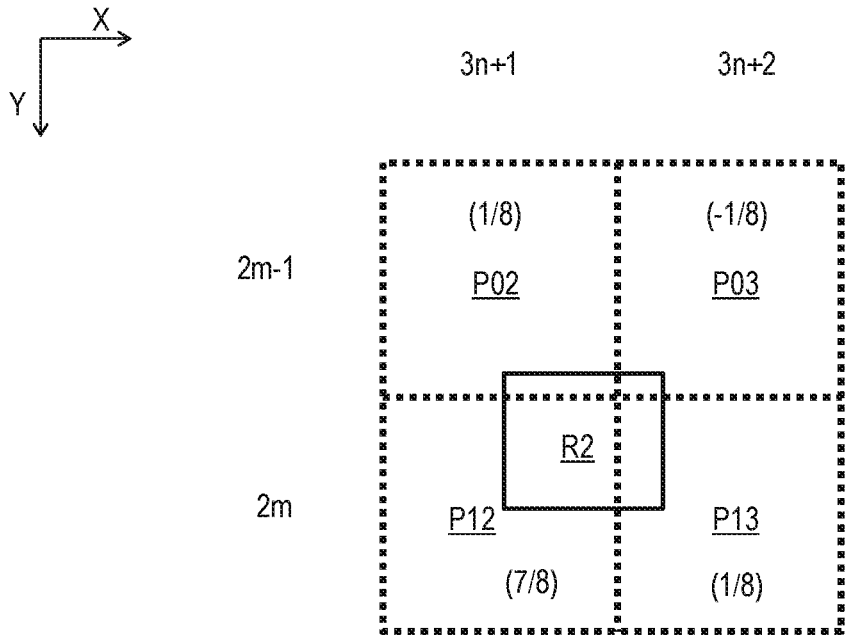
FIG. 44 illustrates a subpixel and frame pixels to assign their relative luminance values to the subpixel in Embodiment 2.

FIG. 44 illustrates the subpixel R2 and the frame pixels to assign their relative luminance values to the subpixel R2. The red relative luminance values of the frame pixels P02, P03, P12, and P13 each including a part of the subpixel R2 are assigned to the subpixel R2. These frame pixels surround the subpixel R2. The part of the subpixel R2 included in the frame pixel P12 is the largest; in other words, the centroid of the frame pixel P12 is the closest to the centroid of the subpixel R2.

The product sum of the relative luminance values of the frame pixels and the assigned weights is the relative luminance value for the subpixel R2:

$$L_R2=(1/8)L_P02+(-1/8)L_P03+(7/8)L_P12+(1/8)L_P13$$

The frame pixel column including the frame pixels P02 and P12 includes a part of the subpixel R2 (overlaps the subpixel R2); the frame pixels P02 and P12 are assigned positive weights. The centroid of the subpixel R2 is closer to the frame subpixel P12; the weight of the frame pixel P12 is larger than the weight of the frame pixel P02. The sum of the weights of the frame pixels P02 and P12 is 1.

The frame pixel column including the frame pixels P03 and P13 includes a part of the subpixel R2 (overlaps the subpixel R2) but the overlap area is smaller than the overlap area included in the frame pixel column including the frame pixels P02 and P12. The frame pixel P03 is assigned a negative weight and the frame pixel P13 is assigned a positive weight. The sum of the weights of the frame pixels P03 and P13 is 0.

The frame pixel P13 in the frame pixel row including the frame pixel P12 is assigned a positive weight. Its value is smaller than the value of the weight of the frame pixel P12. The sum of the weights of the frame pixels P12 and P13 is 1.

The frame pixel row including the frame pixels P02 and P03 includes a part of the subpixel R2 (overlaps the subpixel R2) but the overlap area is smaller than the overlap area of the other pixel row. The sum of the weights of the frame pixels P02 and P03 is 0. The sum of the weights of all frame pixels to assign their relative luminance values to the subpixel R2 is 1.

Figure 45:
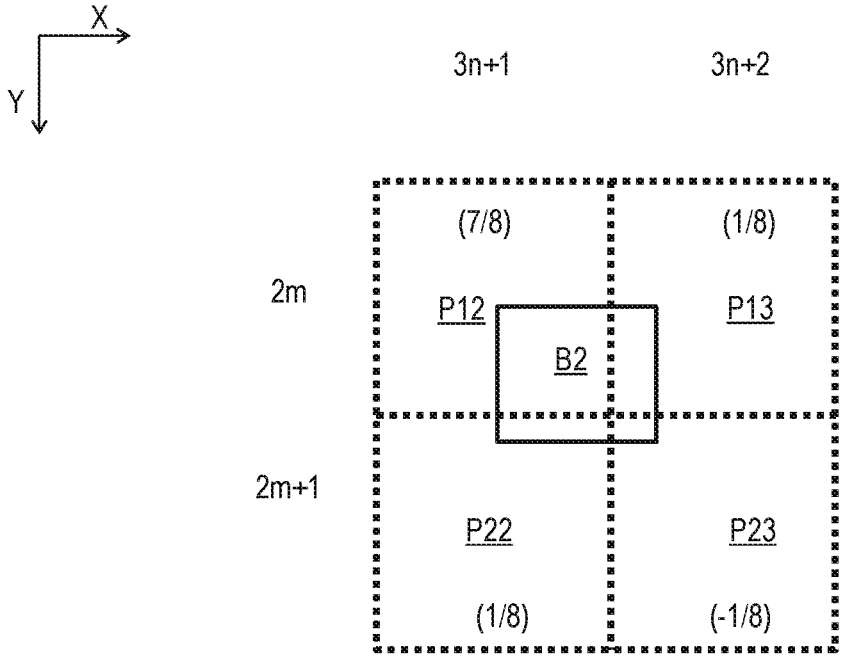
FIG. 45 illustrates a subpixel and frame pixels to assign their relative luminance values to the subpixel in Embodiment 2.

FIG. 45 illustrates the subpixel B2 and the frame pixels to assign their relative luminance values to the subpixel B2. The blue relative luminance values of the frame pixels P12, P13, P22, and P23 each including a part of the subpixel B2 are assigned to the subpixel B2. These frame pixels surround the subpixel B2. The part of the subpixel B2 included in the frame pixel P12 is the largest; in other words, the centroid of the frame pixel P12 is the closest to the centroid of the subpixel B2.

The product sum of the relative luminance values of these frame pixels and the assigned weights is the relative luminance value for the subpixel B2:

$$L_B2=(7/8)L_P12+(1/8)L_P13+(1/8)L_P22+(-1/8)L_P23$$

The frame pixel column including the frame pixels P12 and P22 includes a part of the subpixel B2 (overlaps the subpixel B2); the frame pixels P12 and P22 are assigned positive weights. The centroid of the subpixel B2 is closer to the frame pixel P12; the weight of the frame pixel P12 is larger than the weight of the frame pixel P22. The sum of the weights of the frame pixels P12 and P22 is 1.

The frame pixel column including the frame pixels P13 and P23 includes a part of the subpixel B2 (overlaps the subpixel B2) but the overlap area is smaller than the overlap area included in the frame pixel column including the frame pixels P12 and P22. The frame pixel P23 is assigned a negative weight and the frame pixel P13 is assigned a positive weight. The sum of the weights of the frame pixels P13 and P23 is 0.

The frame pixel P13 in the frame pixel row including the frame pixel P12 is assigned a positive weight. Its value is smaller than the value of the weight of the frame pixel P12. The sum of the weights of the frame pixels P12 and P13 is 1.

The frame pixel row including the frame pixels P22 and P23 includes a part of the subpixel B2 (overlaps the subpixel B2) but the overlap area is smaller than the overlap area of the other pixel row. The sum of the weights of the frame pixels P22 and P23 is 0. The sum of the weights of all frame pixels to assign their relative luminance values to the subpixel B2 is 1.

Figure 46:
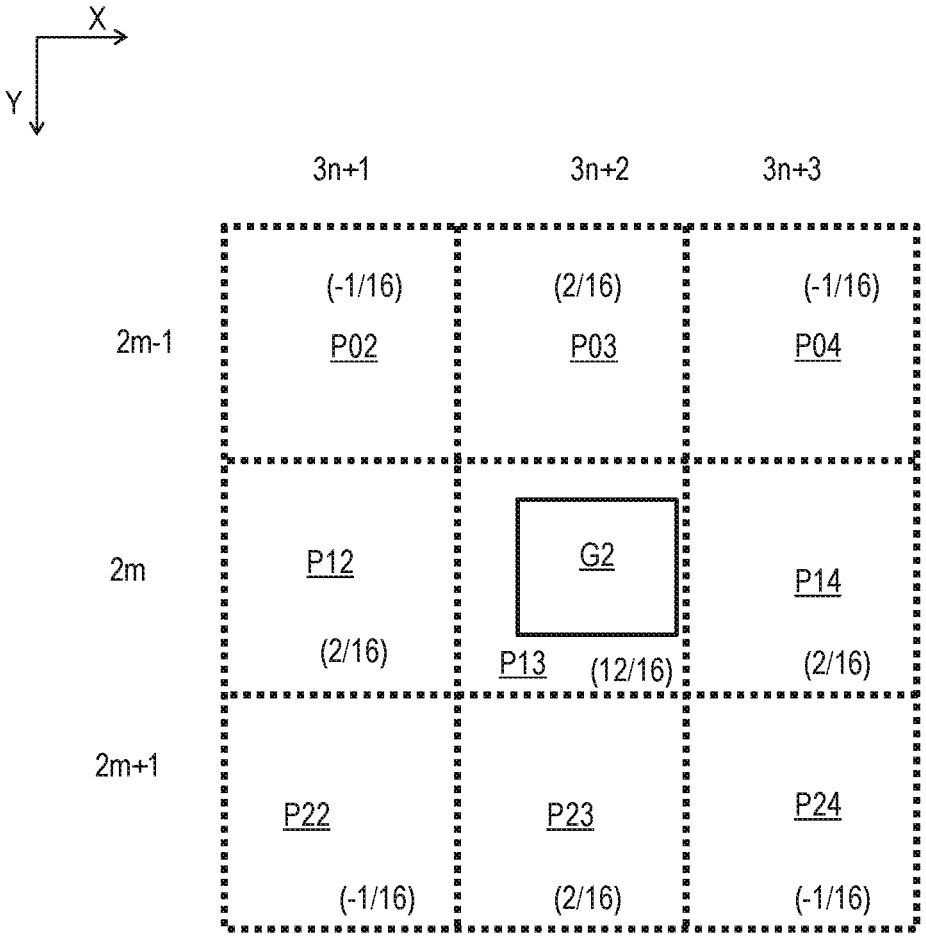
FIG. 46 illustrates a subpixel and frame pixels to assign their relative luminance values to the subpixel in Embodiment 2.

FIG. 46 illustrates the subpixel G2 and the frame pixels to assign their relative luminance values to the subpixel G2. The green relative luminance values of the frame pixel P13 including the entirety of the subpixel G2 and the frame pixels P02, P03, P04, P12, P14, P22, P23, and P24 surrounding the frame pixel P13 are assigned to the subpixel G2.

The product sum of the relative luminance values of the frame pixels and the assigned weights is the relative luminance value for the subpixel G2:

$$L_G2 = (-1/16)L_P02 + (2/16)L_P03 + (-1/16)L_P04 + (2/16)L_P12 + (12/16)L_P13 + (2/16)L_P14 + (-1/16)L_P22 + (2/16)L_P23 + (-1/16)L_P24$$

The frame pixel column including the frame pixels P03, P13, and P23 includes the entirety of the subpixel G2. The frame pixels P03, P13, and P23 are assigned positive weights. The weight of the frame pixel P13 is the largest. The sum of the weights of the frame pixels P03, P13, and P23 is 1.

The frame pixel row including the frame pixels P12, P13, and P14 includes the entirety of the subpixel G2. The frame pixels P12 and P14 are assigned positive weights and their values are smaller than the weight of the frame pixel P13. The centroid of the subpixel G2 is closer to the frame pixel P14 than the frame pixel P12. The sum of the weights of the frame pixels P12, P13, and P14 is 1.

The frame pixel column including the frame pixels P02, P12, and P22 does not overlap the subpixel G2 at all. The frame pixels P02 and P22 are assigned negative weights. The sum of the weights of the frame pixels P02, P12, and P22 is 0. The frame pixel column including the frame pixels P04, P14, and P24 does not overlap the subpixel G2 at all. The frame pixels P04 and P24 are assigned negative weights. The sum of the weights of the frame pixels P04, P14, and P24 is 0.

The frame pixel row including the frame pixels P02, P03, and P04 does not overlap the subpixel G2 at all. The sum of the weights of the frame pixels P02, P03, and P04 is 0. The frame pixel row including the frame pixels P22, P23, and P24 does not overlap the subpixel G2 at all. The sum of the weights of the frame pixels P22, P23, and P24 is 0. The sum of the weights of all frame pixels is 1.

Figure 47:
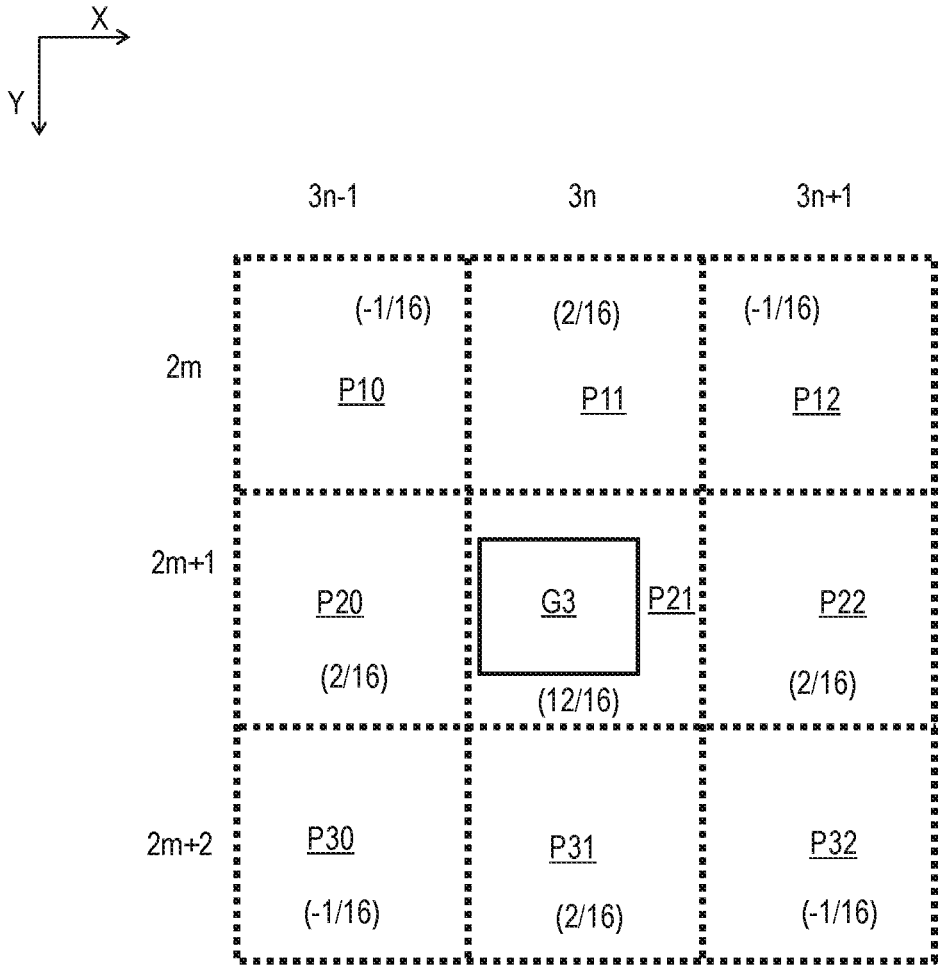
FIG. 47 illustrates a subpixel and frame pixels to assign their relative luminance values to the subpixel in Embodiment 2.

FIG. 47 illustrates the subpixel G3 and the frame pixels to assign their relative luminance values to the subpixel G3. The green relative luminance values of the frame pixel P21 including the entirety of the subpixel G3 and the frame pixels P10, P11, P12, P20, P22, P30, P31, and P32 surrounding the frame pixel P21 are assigned to the subpixel G3.

The relation (weight pattern) of the relative luminance values of the frame pixels P10, P11, P12, P20, P21, P22, P30, P31, and P32 to the relative luminance value of the subpixel G3 is the same as the relation (weight pattern) of the relative luminance values of the frame pixels P04, P03, P02, P14, P13, P12, P24, P23, and P22 to the relative luminance value of the subpixel G2.

Figure 48:
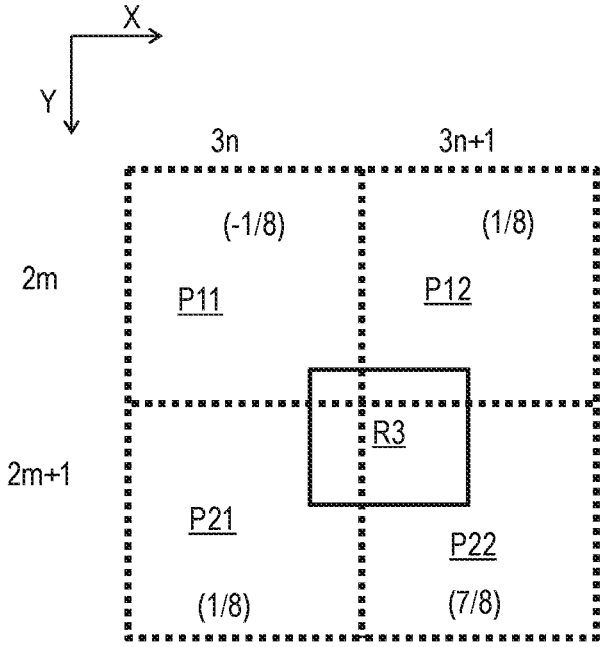
FIG. 48 illustrates a subpixel and frame pixels to assign their relative luminance values to the subpixel in Embodiment 2.

FIG. 48 illustrates the subpixel R3 and the frame pixels to assign their relative luminance values to the subpixel R3. The red relative luminance values of the frame pixels P11, P12, P21, and P22 each including a part of the subpixel R3 are assigned to the subpixel R3. These frame pixels surround the subpixel R3. The part of the subpixel R3 included in the frame pixel P22 is the largest; in other words, the centroid of the frame pixel P22 is the closest to the centroid of the subpixel R3.

The relation (weight pattern) of the relative luminance values of the frame pixels P11, P12, P21, and P22 to the relative luminance value of the subpixel R3 is the same as the relation (weight pattern) of the relative luminance values of the frame pixels P03, P02, P13, and P12 to the relative luminance value of the subpixel R2.

Figure 49:
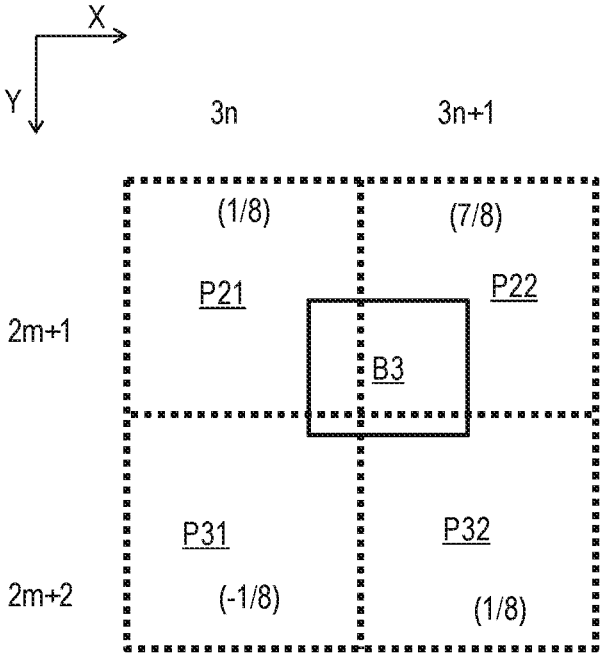
FIG. 49 illustrates a subpixel and frame pixels to assign their relative luminance values to the subpixel in Embodiment 2.

FIG. 49 illustrates the subpixel B3 and the frame pixels to assign their relative luminance values to the subpixel B3. The blue relative luminance values of the frame pixels P21, P22, P31, and P32 each including a part of the subpixel B3 are assigned to the subpixel B3. These frame pixels surround the subpixel B3. The part of the subpixel B3 included in the frame pixel P22 is the largest; in other words, the centroid of the frame pixel P22 is the closest to the centroid of the subpixel B3.

The relation (weight pattern) of the relative luminance values of the frame pixels P21, P22, P31, and P32 to the relative luminance value of the subpixel B3 is the same as the relation (weight pattern) of the relative luminance values of the frame pixels P13, P12, P23, and P22 to the relative luminance value of the subpixel B2.

Figure 50:
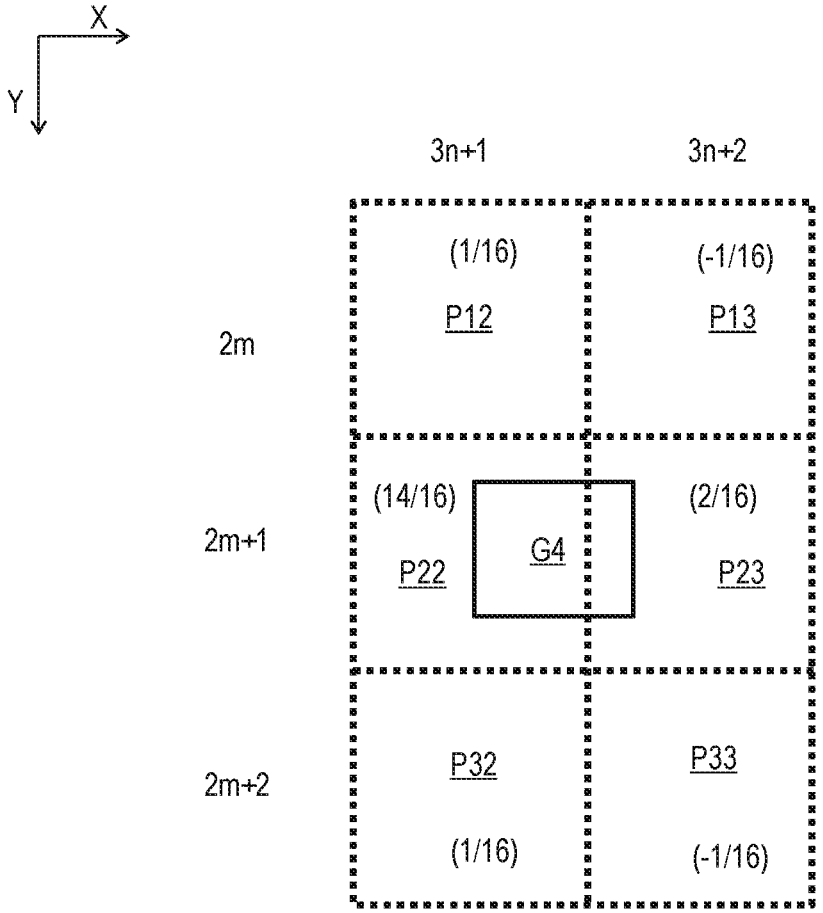
FIG. 50 illustrates a subpixel and frame pixels to assign their relative luminance values to the subpixel in Embodiment 2.

FIG. 50 illustrates the subpixel G4 and the frame pixels to assign their relative luminance values to the subpixel G4. The blue relative luminance values of the frame pixels P22 and P23 each including a part of the subpixel G4 and the frame pixels P12, P13, P32, and P33 disposed outside of the subpixel G4 are assigned to the subpixel G4. The frame pixel P22 includes the largest part of the subpixel G4 and the other frame pixels surround the frame pixel P22.

The relation (weight pattern) of the relative luminance values of the frame pixels P12, P13, P22, P23, P31, and P32 to the relative luminance value of the subpixel G4 is the same as the relation (weight pattern) of the relative luminance values of the frame pixels P01, P00, P11, P10, P21, and P20 to the relative luminance value of the subpixel G1.

Figure 51:
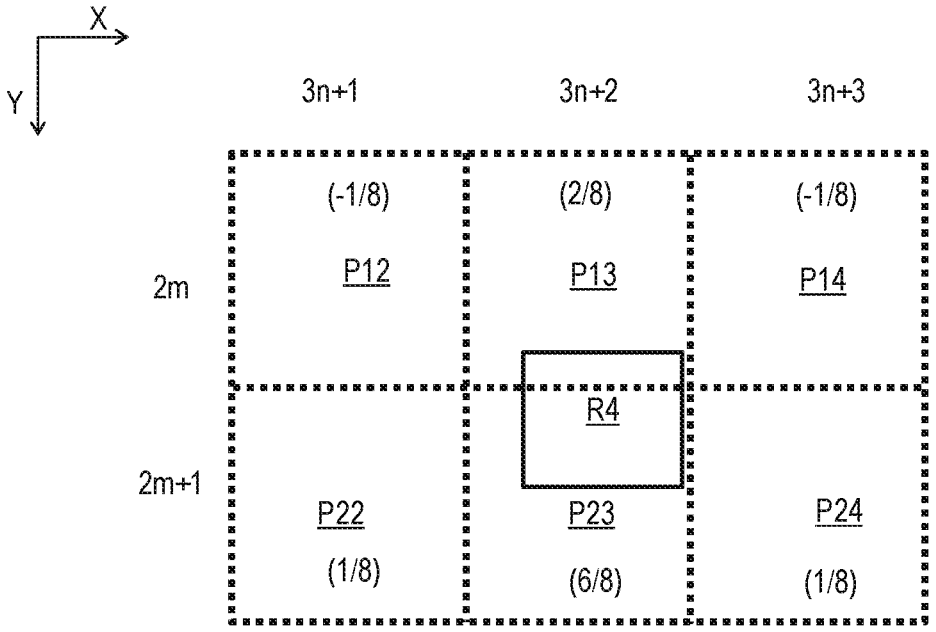
FIG. 51 illustrates a subpixel and frame pixels to assign their relative luminance values to the subpixel in Embodiment 2.

FIG. 51 illustrates the subpixel R4 and the frame pixels to assign their relative luminance values to the subpixel R4. The red relative luminance values of the frame pixels P13 and P23 each including a part of the subpixel R4 and the frame pixels P12, P14, P22, and P24 adjacent to the frame pixel P13 or P23 at outside of the subpixel R4 are assigned to the subpixel R4. These frame pixels surround the subpixel R4.

The relation (weight pattern) of the relative luminance values of the frame pixels P12, P13, P14, P22, P23, and P24 to the relative luminance value of the subpixel R4 is the same as the relation (weight pattern) of the relative luminance values of the frame pixels P02, P01, P00, P12, P11, and P10 to the relative luminance value of the subpixel R1.

Figure 52:
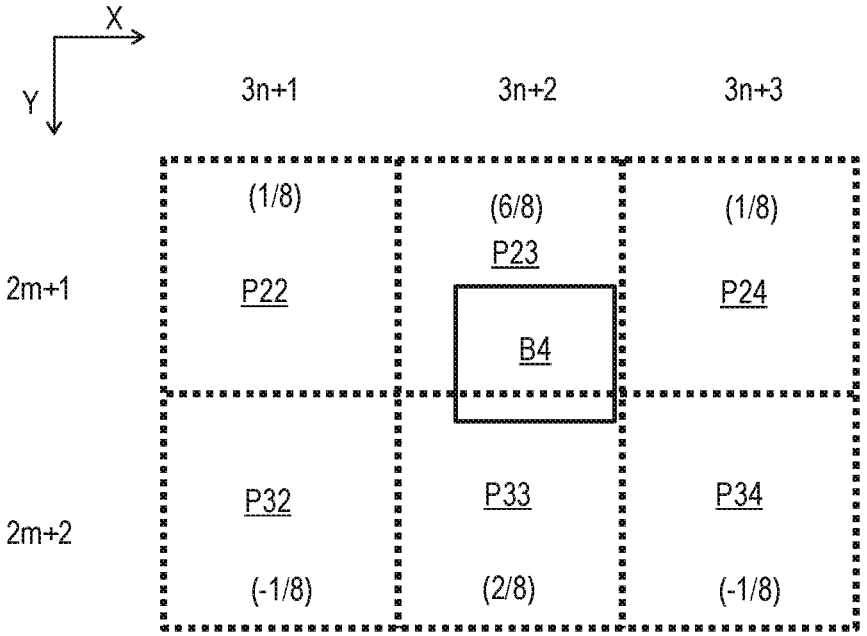
FIG. 52 illustrates a subpixel and frame pixels to assign their relative luminance values to the subpixel in Embodiment 2.

FIG. 52 illustrates the subpixel B4 and the frame pixels to assign their relative luminance values to the subpixel B4.

The blue relative luminance values of the frame pixels P23 and P33 each including a part of the subpixel B4 and the frame pixels P22, P24, P32, and P34 adjacent to the frame pixel P23 or P33 at outside of the subpixel B4 are assigned to the subpixel B4. These frame pixels surround the subpixel B4.

The relation (weight pattern) of the relative luminance values of the frame pixels P22, P23, P24, P32, P33, and P34 to the relative luminance value of the subpixel B4 is the same as the relation (weight pattern) of the relative luminance values of the frame pixels P12, P11, P10, P22, P21, and P20 to the relative luminance value of the subpixel B1.

The subpixels R1, B1, R4, and B4 are examples of the third type of subpixel. The plurality of frame pixels to determine the relative luminance value for a third type of subpixel are the frame pixel closest to the subpixel, the frame pixels adjacent on both sides along the X-axis to the closest frame pixel, the frame pixel second closest to the subpixel along the Y-axis, and the frame pixels adjacent on both sides along the X-axis to the second closest frame pixel.

The subpixels R2, B2, R3, and B3 are examples of the fourth type of subpixel. The plurality of frame pixels to determine the relative luminance value for a fourth type of subpixel are the frame pixel closest to the subpixel, the frame pixel second closest to the subpixel along the X-axis, the frame pixel second closest to the subpixel along the Y-axis, and the frame pixel adjacent to both of the frame pixel second closest to the subpixel along the X-axis and the frame pixel second closest to the subpixel along the Y-axis.

The subpixels G1 and G4 are examples of the fifth type of subpixel. The plurality of frame pixels to determine the relative luminance value for a fifth type of subpixel are the frame pixel closest to the subpixel, the frame pixel second closest to the subpixel along the X-axis, the frame pixels adjacent on both sides along the Y-axis to the frame pixel closest to the subpixel, and the frame pixels adjacent on both sides along the Y-axis to the frame pixel second closest to the subpixel along the X-axis.

The subpixels G2 and G3 are examples of the sixth type of subpixel. The plurality of frame pixels to determine the relative luminance value for a sixth type of subpixel are the frame pixel closest to the subpixel, the frame pixels adjacent on both sides along the X-axis to the frame pixel closest to the subpixel, the frame pixel adjacent in the upward direction to the frame pixel closest to the subpixel, the frame subpixels adjacent on both sides along the X-axis to the frame pixel adjacent in the upward direction, the frame pixel adjacent in the downward direction to the frame pixel closest to the subpixel, and the frame pixels adjacent on both sides along the X-axis to the frame pixel adjacent to the closest frame pixel in the downward direction.

As described above, among the frame pixels to assign their relative luminance values to a subpixel, only one frame pixel row and one frame pixel column including the frame pixel closest to the subpixel are composed of only frame pixels assigned positive weights. Moreover, among the frame pixels to assign their relative luminance values to the subpixel, every frame pixel row except for the one frame pixel row includes a frame pixel assigned a negative weight and the sum of the weights of the frame pixels therein is 0. Among the frame pixels to assign their relative luminance values to the subpixel, every frame pixel column except for the one frame pixel column includes a frame pixel assigned a negative weight and the sum of the weights of the frame pixels therein is 0. As a result, a line extending in the column direction can be displayed narrower than the case of linear interpolation.

Embodiment 3

As described in Embodiments 1 and 2, the relative luminance values of the subpixels in a panel unit region 45 are based on the relative luminance values of the corresponding frame unit region 41 and further, the relative luminance values of the frame pixels surrounding the frame unit region 41. Accordingly, the frame pixels included in a picture frame are not enough to determine the relative luminance value for a subpixel located on the periphery of the panel display region 125 from the relative luminance values of frame pixels through the above-described methods.

This embodiment adds dummy frame pixels around a picture frame. This configuration reduces the impairment of display quality in the periphery of the display region 125. Although the dummy frames are essential to neither Embodiment 1 nor Embodiment 2, they are applicable to either embodiment.

Figure 53:
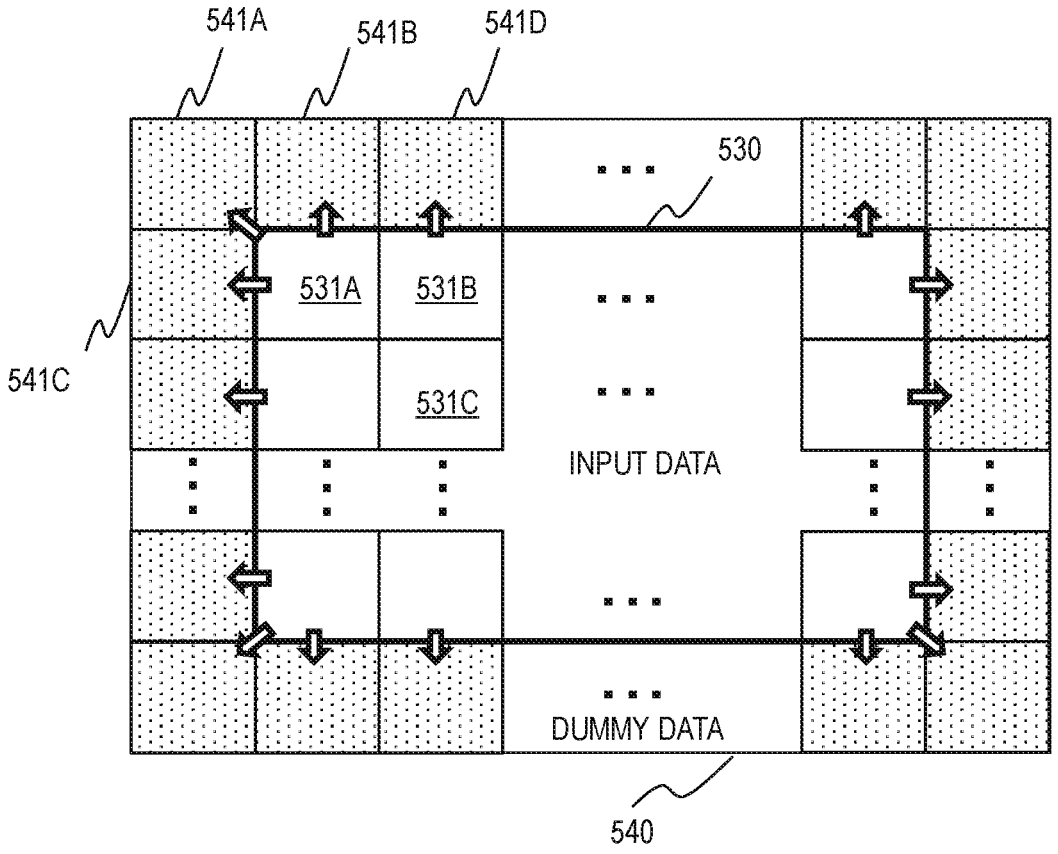
FIG. 53 illustrates a picture frame (input data) and dummy data provided around the picture frame in Embodiment 3.

FIG. 53 illustrates a picture frame (input data) 530 and dummy data 540 provided around the picture frame. The dummy data 540 is data for dummy pixels provided around the picture frame. In FIG. 53, only parts of the frame pixels are indicated with reference signs 531A, 531B, and 531C. Furthermore, only parts of the dummy pixels are indicated with reference signs 541A to 541D.

An example assigns a dummy pixel the same relative luminance values (a tuple of R, G, and B relative luminance values) as those for the adjacent (closest) frame pixel. Taking the example of FIG. 53, the relative luminance values for the dummy pixels 541A, 541B, and 541C are the same as the relative luminance values for the adjacent frame pixel 531A. The relative luminance values for the dummy pixel 541D is the same as the relative luminance values for the adjacent frame pixel 531B. This example assigns the relative luminance values for the outermost frame pixels to the dummy pixels adjacent in the row direction or the column direction and further, assigns the relative luminance values for the frame pixels on a corner to the dummy pixels adjacent in the row direction, column direction, and the diagonal direction.

The relative luminance converter 342 in the driver IC 134 calculates the relative luminance values for the dummy pixels from the relative luminance values for the frame pixels. The relative luminance converter 342 determines the relative luminance value for each panel subpixel from the relative luminance values for a frame pixel and dummy pixel(s). The method of determining the relative luminance values for a dummy pixel depends on the design and is not limited to the above-described relations. For example, the relative luminance values for one dummy pixel can be determined from the product sum of the relative luminance values for one or more frame pixels and the weights assigned thereto.

As set forth above, embodiments of this disclosure have been described; however, this disclosure is not limited to the foregoing embodiments. Those skilled in the art can easily modify, add, or convert each element in the foregoing embodiment within the scope of this disclosure. A part of the configuration of one embodiment can be replaced with a configuration of another embodiment or a configuration of an embodiment can be incorporated into a configuration of another embodiment.

What is claimed is:

1. A display device comprising:

a display panel; and a controller configured to convert relative luminance data for a picture frame to relative luminance data for the display panel, wherein the picture frame includes a region composed of a plurality of frame unit regions disposed in a matrix, wherein each of the plurality of frame unit regions includes:

a first frame pixel, a second frame pixel, and a third frame pixel disposed in a first direction along a first axis in order of the first frame pixel, the second frame pixel, and the third frame pixel; and a fourth frame pixel, a fifth frame pixel, and a sixth frame pixel disposed in the first direction to be adjacent to the first frame pixel, the second frame pixel, and the third frame pixel, respectively, in a second direction along a second axis perpendicular to the first axis, wherein a display region of the display panel includes a region composed of a plurality of panel unit regions disposed in a matrix, wherein each of the plurality of panel unit regions includes:

a first subpixel line including a first subpixel of a first color, a first subpixel of a second color, and a first subpixel of a third color disposed in the second direction in order of the first subpixel of the first color, the first subpixel of the second color, and the first subpixel of the third color;

a second subpixel line including a second subpixel of the third color, a second subpixel of the first color, and a second subpixel of the second color disposed in the second direction in order of the second subpixel of the third color, the second subpixel of the first color, and the second subpixel of the second color, the second subpixel line being adjacent to the first subpixel line in the first direction;

a third subpixel line including a third subpixel of the first color, a third subpixel of the second color, and a third subpixel of the third color disposed in the second direction in order of the third subpixel of the first color, the third subpixel of the second color, and the third subpixel of the third color, the third subpixel line being adjacent to the second subpixel line in the first direction; and a fourth subpixel line including a fourth subpixel of the third color, a fourth subpixel of the first color, and a fourth subpixel of the second color disposed in the second direction in order of the fourth subpixel of the third color, the fourth subpixel of the first color, and the fourth subpixel of the second color, the fourth subpixel line being adjacent to the third subpixel line in the first direction, wherein a relative luminance value for each subpixel in the panel unit region is determined by calculation of relative luminance values of a plurality of frame pixels with weights, wherein the plurality of frame pixels include a frame pixel closest to the subpixel, wherein the plurality of frame pixels are disposed in a plurality of frame pixel lines each extending in the first direction and in a plurality of frame pixel lines each extending in the second direction, wherein a first frame pixel line extending in the first direction that includes the closest frame pixel and a second frame pixel line extending in the second direction that includes the closest frame pixel are composed of frame pixels assigned positive weights, wherein each of the frame pixel lines except for the first frame pixel line and the second frame pixel line includes a frame pixel assigned a negative weight, wherein a sum of weights for the first frame pixel line is larger than a sum of weights for any one of the other frame pixel lines extending in the first direction, and wherein a sum of weights for the second frame pixel line is larger than a sum of weights for any one of the other frame pixel line extending in the second direction.

2. The display device according to claim 1, wherein a sum of weights for each of the frame pixel lines extending in the first direction except for the first frame pixel line is 0.

3. The display device according to claim 1, wherein a sum of weights for at least one of the frame pixel lines extending in the second direction except for the second frame pixel line is 0.

4. The display device according to claim 1, wherein each of the first to the fourth subpixels of the first color and the first to the fourth subpixels of the second color is a first type of subpixel, wherein the plurality of frame pixels to determine the relative luminance value for the first type of subpixel are:

a frame pixel closest to the first type of subpixel;

frame pixels adjacent on both sides along the first axis to the frame pixel closest to the first type of subpixel;

a frame pixel second closest to the first type of subpixel along the second axis; and frame pixels adjacent on both sides along the first axis to the frame pixel second closest to the first type of subpixel, wherein each of the first to the fourth subpixels of the third color is a second type of subpixel, and wherein the plurality of frame pixels to determine the relative luminance value for the second type of subpixel are:

a frame pixel closest to the second type of subpixel;

frame pixels adjacent on both sides along the first axis to the frame pixel closest to the second type of subpixel;

a frame pixel adjacent in the opposite direction of the second direction to the frame pixel closest to the second type of subpixel;

frame pixels adjacent on both sides along the first axis to the frame pixel adjacent in the opposite direction of the second direction;

a frame pixel adjacent in the second direction to the frame pixel closest to the second type of subpixel; and frame pixels adjacent on both sides along the first axis to the frame pixel adjacent in the second direction.

5. The display device according to claim 1, wherein each of the first subpixel of the first color, the fourth subpixel of the first color, the first subpixel of the second color, and the fourth subpixel of the second color is a third type of subpixel, wherein the plurality of frame pixels to determine the relative luminance value for the third type of subpixel are:

a frame pixel closest to the third type of subpixel;

frame pixels adjacent on both sides along the first axis to the frame pixel closest to the third type of subpixel;

a frame pixel second closest to the third type of subpixel along the second axis; and frame pixels adjacent on both sides along the first axis to the frame pixel second closest to the third type of subpixel, wherein each of the second subpixel of the first color, the third subpixel of the first color, the second subpixel of the second color, and the third subpixel of the second color is a fourth type of subpixel, wherein the plurality of frame pixels to determine the relative luminance value for the fourth type of subpixel are:

a frame pixel closest to the fourth type of subpixel;

a frame pixel second closest to the fourth type of subpixel along the first axis;

a frame pixel second closest to the fourth type of subpixel along the second axis; and a frame pixel adjacent to both of the frame pixel second closest to the fourth type of subpixel along the first axis and the frame pixel second closest to the fourth type of subpixel along the second axis, wherein each of the first subpixel of the third color and the fourth subpixel of the third color is a fifth type of subpixel, wherein the plurality of frame pixels to determine the relative luminance value for the fifth type of subpixel are:

a frame pixel closest to the fifth type of subpixel;

a frame pixel second closest to the fifth type of subpixel along the first axis;

frame pixels adjacent on both sides along the second axis to the frame pixel closest to the fifth type of subpixel; and frame pixels adjacent on both sides along the second axis to the frame pixel second closest to the fifth type of subpixel along the first axis, wherein each of the second subpixel of the third color and the third subpixel of the third color is a sixth type of subpixel, and wherein the plurality of frame pixels to determine the relative luminance value for the sixth type of subpixel are:

a frame pixel closest to the sixth type of subpixel;

frame pixels adjacent on both sides along the first axis to the frame pixel closest to the sixth type of subpixel;

a frame pixel adjacent in the opposite direction of the second direction to the frame pixel closest to the sixth type of subpixel;

frame pixels adjacent on both sides along the first axis to the frame pixel adjacent in the opposite direction;

a frame pixel adjacent in the second direction to the frame pixel closest to the sixth type of subpixel; and frame pixels adjacent on both sides along the first axis to the frame pixel adjacent in the second direction.

6. The display device according to claim 1, wherein the relative luminance data for the picture frame and the relative luminance data for the display panel have a relation mediated by virtual mediatory pixels, wherein the mediatory pixels are included in a plurality of mediatory unit regions corresponding to the plurality of frame unit regions one to one, wherein each of the plurality of mediatory unit regions is composed of four sections obtained by dividing the corresponding frame unit region in the first direction, wherein each of the plurality of mediatory unit regions includes:

a first mediatory pixel, a second mediatory pixel, a third mediatory pixel, and a four mediatory pixel disposed in the first direction in order of the first mediatory pixel, the second mediatory pixel, the third mediatory pixel, and the four mediatory pixel; and a fifth mediatory pixel, a sixth mediatory pixel, a seventh mediatory pixel, and an eighth mediatory pixel disposed in the first direction to be adjacent to the first mediatory pixel, the second mediatory pixel, the third mediatory pixel, and the fourth mediatory pixel, respectively, in the second direction, wherein a relative luminance value for each mediatory pixel included in each of the plurality of mediatory unit regions is expressed by calculation of relative luminance values of one or two frame pixels closest to the mediatory pixel along the first axis with weights, wherein the relative luminance value for each subpixel in the panel unit region is expressed by calculation of relative luminance values of a plurality of mediatory pixels with weights, wherein the plurality of mediatory pixels include a mediatory pixel closest to the subpixel, wherein the plurality of mediatory pixels are disposed in a plurality of mediatory pixel lines each extending in the first direction and a plurality of mediatory pixel lines each extending in the second direction, wherein a first mediatory pixel line extending in the first direction that includes the closest mediatory pixel and a second mediatory pixel line extending in the second direction that includes the closest mediatory pixel are composed of mediatory pixels assigned positive weights, wherein each of the mediatory pixel lines except for the first mediatory pixel line and the second mediatory pixel line includes a mediatory pixel assigned a negative weight, wherein a sum of weights for the first mediatory pixel line is larger than a sum of weights for any one of the other mediatory pixel lines extending in the first direction, and wherein a sum of weights for the second mediatory pixel line is larger than a sum of weights for any one of the other mediatory pixel lines extending in the second direction.

7. The display device according to claim 6, wherein a sum of weights for each of the mediatory pixel lines except for the first mediatory pixel line and the second mediatory pixel line is 0.

8. The display device according to claim 7, wherein a sum of weights for each of the first mediatory pixel line and the second mediatory pixel line is 1.

9. The display device according to claim 6, wherein each mediatory pixel in a mediatory unit region is assigned a relative luminance value same as a relative luminance value of a frame pixel closest to the mediatory pixel along the first axis.

10. The display device according to claim 6, wherein a relative luminance value for each of at least a part of the mediatory pixels included in a mediatory unit region is determined by calculation of relative luminance values of two frame pixels closest to the mediatory pixel along the first axis with weights, and wherein a frame pixel closer to the mediatory pixel between the two frame pixels is assigned a larger weight.

11. The display device according to claim 6, wherein each of the first to the fourth subpixels of the first color and the first to the fourth subpixels of the second color is a first type of subpixel, wherein the plurality of mediatory pixels to determine a relative luminance value for the first type of subpixel are:

a mediatory pixel closest to the first type of subpixel;

mediatory pixels adjacent on both sides along the first axis to the mediatory pixel closest to the first type of subpixel;

a mediatory pixel second closest to the first type of subpixel along the second axis; and mediatory pixels adjacent on both sides along the first axis to the mediatory pixel second closest to the first type of subpixel, wherein each of the first to the fourth subpixels of the third color is a second type of subpixel, and wherein the plurality of mediatory pixels to determine a relative luminance value for the second type of subpixel are:

a mediatory pixel closest to the second type of subpixel;

mediatory pixels adjacent on both sides along the first axis to the mediatory pixel closest to the second type of subpixel;

a mediatory pixel adjacent in the opposite direction of the second direction to the mediatory pixel closest to the second type of subpixel;

mediatory pixels adjacent on both sides along the first axis to the mediatory pixel adjacent in the opposite direction of the second direction;

a mediatory pixel adjacent in the second direction to the mediatory pixel closest to the second type of subpixel; and mediatory pixels adjacent on both sides along the first axis to the mediatory pixel adjacent in the second direction.

12. The display device according to claim 1, wherein the relative luminance data for the display panel is converted from relative luminance data for the frame pixels of the picture frame and dummy frame pixels disposed outside of the frame pixels of the picture frame.

13. The display device according to claim 12, wherein a relative luminance values of each dummy frame pixel is the same as a relative luminance value of a frame pixel closest to the dummy frame pixel.

* * * * *